US010792716B2

(12) United States Patent
Sundquist et al.

(10) Patent No.: US 10,792,716 B2
(45) Date of Patent: Oct. 6, 2020

(54) MAGNETIC PRESS BRAKE AND MACHINE TOOLING ENGAGEMENT SYSTEMS

(71) Applicant: MATE PRECISION TOOLING, INC., Anoka, MN (US)

(72) Inventors: Dean Sundquist, Anoka, MN (US); Christopher Morgan, Minneapolis, MN (US)

(73) Assignee: Mate Precision Tooling, Inc., Anoka, MN (US)

( * ) Notice: Subject to any disclaimer, the term of this patent is extended or adjusted under 35 U.S.C. 154(b) by 503 days.

(21) Appl. No.: 15/637,893

(22) Filed: Jun. 29, 2017

(65) Prior Publication Data

US 2019/0001387 A1 Jan. 3, 2019

(51) Int. Cl.

| | |
|---|---|
| ***B21D 5/02*** | (2006.01) |
| ***B21D 37/04*** | (2006.01) |
| ***B21J 13/03*** | (2006.01) |
| ***B21J 13/08*** | (2006.01) |
| *B21D 37/14* | (2006.01) |
| *B21J 13/02* | (2006.01) |

(52) U.S. Cl.

CPC ..... *B21D 5/0236* (2013.01); *B21D 5/0281* (2013.01); *B21D 37/04* (2013.01); *B21J 13/03* (2013.01); *B21J 13/085* (2013.01); *B21D 37/14* (2013.01); *B21J 13/025* (2013.01)

(58) Field of Classification Search

CPC .... B21D 5/0236; B21D 5/0281; B21D 37/04; B23Q 1/25; B23Q 3/15546; B23Q 3/15553–15573; B23Q 17/006; B23B 31/28; Y10T 279/21; Y10T 279/23

USPC ..... 294/128; 72/482, 482.9

See application file for complete search history.

(56) References Cited

U.S. PATENT DOCUMENTS

| | | | |
|---|---|---|---|
| 2,912,249 | A | 11/1959 | Eckold |
| 3,377,887 | A | 4/1968 | Nelson et al. |
| 3,907,452 | A | 9/1975 | Tripp |

(Continued)

FOREIGN PATENT DOCUMENTS

| | | | |
|---|---|---|---|
| EP | 0387121 | A1 | 9/1990 |
| EP | 1321200 | A2 | 6/2003 |

(Continued)

OTHER PUBLICATIONS

Brisard, Translation of FR-2791590-A1 (Year: 2000).*

(Continued)

*Primary Examiner* — Adam J Eiseman
*Assistant Examiner* — Bobby Yeonjin Kim
(74) *Attorney, Agent, or Firm* — Dorsey & Whitney LLP

(57) ABSTRACT

A machine tool apparatus for a press brake, folding press or punch press system includes a tool holder body having a receiving portion configured for selective engagement with a coupling end of a machine tool. The apparatus also includes a magnetic coupling assembly comprising one or more magnetic elements configured to generate a magnetic coupling adapted for the selective engagement of the tool holder body with the coupling end of the machine tool. In some embodiments, the apparatus may further include an actuator configured to manipulate at least one of the magnetic elements to modulate the strength of the magnetic coupling for selective engagement and disengagement of the tool holder body with the coupling end of the machine tool.

35 Claims, 50 Drawing Sheets

(56) References Cited

U.S. PATENT DOCUMENTS

| | | | | |
|---|---|---|---|---|
| 4,135,770 | A | 1/1979 | Doherty et al. | |
| 4,197,772 | A | 4/1980 | Anderson et al. | |
| 4,787,237 | A | 11/1988 | Houston et al. | |
| 5,595,560 | A | 1/1997 | Kamada | |
| 5,782,308 | A | 7/1998 | Latten et al. | |
| 5,794,486 | A | 8/1998 | Sugimoto et al. | |
| 6,003,360 | A | 12/1999 | Runk et al. | |
| 6,557,390 | B2 | 5/2003 | Runk et al. | |
| 6,848,291 | B1 | 2/2005 | Johnson et al. | |
| 6,928,852 | B2 | 8/2005 | Enderink | |
| 8,099,992 | B2 * | 1/2012 | Rouweler | B21D 5/0209 72/481.2 |
| 2006/0174680 | A1 | 8/2006 | Shimota et al. | |
| 2011/0247389 | A1 * | 10/2011 | Rouweler | B21D 5/0209 72/389.3 |
| 2013/0019650 | A1 | 1/2013 | Rogers et al. | |
| 2015/0143867 | A1 * | 5/2015 | Sato | B21D 5/0236 72/482.93 |
| 2017/0066032 | A1 * | 3/2017 | Jarrier | B21D 43/26 |
| 2017/0144206 | A1 * | 5/2017 | Felder | B21D 5/02 |
| 2017/0297073 | A1 * | 10/2017 | Sato | B21D 37/04 |
| 2018/0071805 | A1 | 3/2018 | Sundquist et al. | |
| 2018/0304331 | A1 * | 10/2018 | Cavicchia | B21D 5/0254 |
| 2019/0134691 | A1 | 5/2019 | Sundquist et al. | |

FOREIGN PATENT DOCUMENTS

| | | | | |
|---|---|---|---|---|
| EP | 1479461 | A1 | 11/2004 | |
| EP | 1 321 200 | B1 | 3/2008 | |
| FR | 2781590 | A1 | 10/2000 | |
| FR | 2791590 | A1 * | 10/2000 | B21D 5/0236 |
| FR | 2791590 | A1 | 10/2000 | |
| WO | 2017067879 | A1 | 4/2017 | |
| WO | WO2018049056 | A1 | 3/2018 | |

OTHER PUBLICATIONS

Hyperphysics, Ferromagnetism (Year: 2000).*

Notification of Transmittal of the International Search Report and the Written Opinion of the International Searching Authority, or the Declaration (PCT/US2018/059407) dated Jan. 15 (10 pages).

Written Opinion of the International Preliminary Examining Authority for International Patent Application No. PCT/US2018/039931, dated Jul. 12, 2019 (6 pages).

International Search Report and Written Opinion of the International Searching Authority for International Patent Application No. PCT/US2017/050524, dated Dec. 1, 2017 (14 pages).

Notification of Transmittal of the International Search Report and the Written Opinion of the International Searching Authority, or the Declaration (PCT/US2018/039931) dated Nov. 7, 2018 (14 pages).

* cited by examiner

SECTION A-A

DETAIL B

SECTION B-B

SECTION A-A

MAGNETIC PRESS BRAKE AND MACHINE TOOLING ENGAGEMENT SYSTEMS

TECHNICAL FIELD

This application is directed to engagement systems for press brake tooling and other machine tool components. Applications include, but are not limited to, magnetic engagement mechanisms for press brake tooling and press brake tool holders. The technology can be adapted to punch press and press brake tooling for sheet metal fabrication, and other machine tool punch and die systems.

BACKGROUND

A typical machine press system includes a press apparatus with an upper table or ram arranged to move vertically with respect to a lower table or other (e.g., stationary) fixture. Different press brake and punch tooling components can be mounted to the upper and lower tables, and configured to bend or impress a sheet metal element or other workpiece by operation of the press. Generally, the upper table can be configured for coupling with (e.g., male) punch or press brake tooling components adapted for the desired sheet metal fabrication or other manufacturing applications, in cooperation with complementary (e.g., female) forming tools such as dies coupled with the lower table. Alternatively, the upper and lower table arrangement may be reversed, and the punch apparatus can be either horizontally or vertically oriented. A variety of different press brake and punch tooling components can also be employed, in order to perform selected forming operations on a range of different workpieces.

In operation, it can often be necessary to exchange tooling on either the upper or lower table (or both), in order to perform the desired press operations. On the upper table or ram, the forming tools may be held in place by a clamping mechanism configured to engage each machine tool component simultaneously within a tool holder. Upon unlocking or releasing the clamping mechanism, the tooling is disengaged and can be removed, for example by sliding the tooling components horizontally to an open end of the table, or by manipulating in a vertical or transverse direction to disengage the tooling from the holder.

The exchange of press brake and punch tooling can be time consuming and cumbersome due to proximity to the press apparatus and other tooling component in the upper or lower tables. This may necessitate the removal of some or all of the adjacent tooling components when only selected tools are being exchanged, and the clamping mechanism itself can also interfere with tooling selection. Similar shortcomings may exist with respect to both male and female tooling, e.g., whether supported from a tool holder in the upper table or ram, or from a lower table, die holder or similar fixture.

Tooling removal and insertion operations may introduce safety risks associated with handling the (often heavy) machine tool components. In particular, loosening the clamping mechanism without taking proper precautions may result in one or more tool components coming loose or falling, which can in turn result in process delays or tooling damage, or introduce a risk of operator injury. To prevent this, mechanisms such as safety tangs have been developed, e.g., with a tang member that protrudes laterally from an engagement surface of the tooling component, and is adapted to engage a complementary groove defined by the tool holder to secure the tool until is it clamped. Such mechanisms may require additional manipulations by the operator to actuate the safety mechanism, which may be concealed by the holder or otherwise not directly accessible. For these and other reasons, there is a need for improved techniques to engage and secure punch and press brake tooling to a table or ram while the clamping mechanism is disengaged. These techniques are also applicable to engage and secure machine tool, punch and die and components for which no clamping mechanism is provided.

SUMMARY

In accordance with the various examples and embodiments of the disclosure, a machine tool apparatus may include a tool holder or holder body defining a receiving portion configured for selective engagement with a coupling end of a machine tool, for example a press brake or punch tooling component. A magnetic coupling assembly or mechanism can be provided for engaging the machine tool with the holder, including one or more magnetic elements configured to generate a magnetic coupling adapted for selective engagement and disengagement of the holder with the coupling end of the machine tool.

The magnetic elements may include both field sources (e.g., permanent magnets or other sources of magnetic flux) and flux guides (e.g., ferromagnetic elements or similar materials with suitable magnetic properties). An actuator can be configured to manipulate at least one of the magnetic elements to modulate a strength of the magnetic coupling, in order to achieve selective engagement and disengagement of the holder with the coupling end of the machine tool. In some examples, the components of the magnetic assembly may be fixed or movable in position or rotation and switchable, selective, non-switchable or non-selective with respect to magnetic orientation, such that the magnetic coupling assembly is configured to generate a selective magnetic coupling adapted for engagement and disengagement of the tool holder with the coupling end of the machine tool insert.

In some embodiments, the actuator may be configured to manipulate at least one of the magnetic elements of the magnetic coupling assembly between a locked or engaged position, in which the coupling end of the machine tool is selectively engaged within the receiving portion of the holder body, and an alternate unlocked or disengaged position, in which the coupling end of the machine tool is selectively disengaged from the receiving portion of the holder body. For example, one or more of the magnetic elements may be responsive to actuation of the actuator, such that the locked and unlocked positions are bi-stable. In the locked position, the magnetic coupling may support a weight of the machine tool disposed within the receiving portion of the holder body, e.g., within a vertically oriented upper table or ram.

Some embodiments may include an adjustment mechanism configured to adjust a strength of the magnetic coupling, e.g., in order to support the weight of a selected machine tool component. Press brake and punch press apparatus embodiments are also encompassed, along with their associated punch press and press brake tooling components and corresponding methods of manufacture and fabrication of sheet metal elements and other workpieces.

Some embodiments may include a machine die apparatus. The machine die apparatus may include a tool holder body having a receiving portion configured for selective engagement with a coupling end of a machine die. The machine die apparatus may further include a magnetic coupling assembly comprising one or more magnetic elements configured to generate a magnetic coupling adapted for the selective engagement of the tool holder body with the coupling end of the machine die. In some examples, the magnetic components of the machine die apparatus may be fixed or movable in position or rotation and switchable, selective, non-switchable or non-selective with respect to magnetic orientation, such that the magnetic coupling assembly is configured to generate a selective magnetic coupling adapted for engagement and disengagement of the tool holder body with the coupling end of the machine die.

DETAILED DESCRIPTION

Figure 1A:
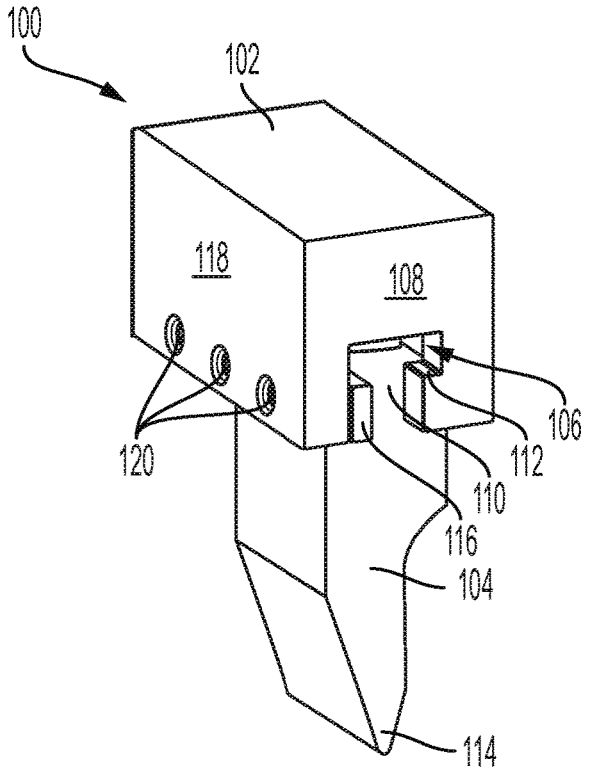
FIG. 1A PRIOR ART
FIG. 1A is an isometric view of a tool holder configured for magnetic engagement with a machine tool component, in a representative press brake or punch apparatus.

FIG. 1A is an isometric view of a press brake, punch or similar machine tool apparatus 100 having a tool holder 102 coupled with a machine tool or tool insert 104. While generally described as a press brake tool herein, tool 104 may alternatively be configured as a press brake punch, folding press, punch tool, or similar machine tool component for use with a press brake or punch press apparatus.

As illustrated in FIG. 1A, holder 102 may define a receiving portion or cavity 106 exposed at holder side surface 108. Tool 104 may be coupled with holder 102 by inserting an upper portion or tang 110 of the tool into receiving cavity 106, where at least one relief, groove, recess, shelf or ledge 112 may provide a surface for mounting tool 102. Opposite holder 102, tool 104 includes a tool end or working end 114.

To lock or otherwise secure tool 104 to holder 102, a movable clamp 116 secured to holder 102 may be tightened against a surface of tang 110, thereby laterally sandwiching tang 110 between clamp 116 and an opposing stationary surface of receiving cavity 106. To tighten and loosen clamp 116, a front surface 118 of holder 102 may be configured to receive one or more fasteners through at least one fastener aperture 120. In operation, such a press brake assembly may punch, impress, crimp, fold, crease or otherwise shape various workpieces inserted beneath working end 114 and optionally one or more forming dies. In embodiments, a workpiece may include a sheet material component or other material to be tooled.

Figure 1B:
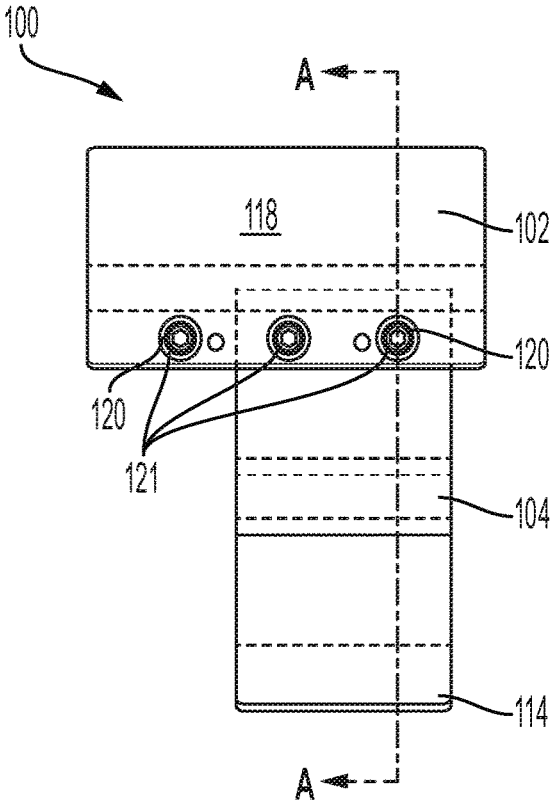
FIG. 1B PRIOR ART
FIG. 1B is a front view of the machine tool apparatus in FIG. 1A.

FIG. 1B is a front view of machine tool apparatus 100 with holder 102 coupled to tool 104, showing three fasteners 121 inserted within apertures 120 of front surface 118. Fasteners 121 may include various set screws, studs, T-handles, pins, cams, levers, or bolts. As such, the fasteners may be driven into and out of apertures 120 with a drill, screw driver, or hex key.

Figure 1C:
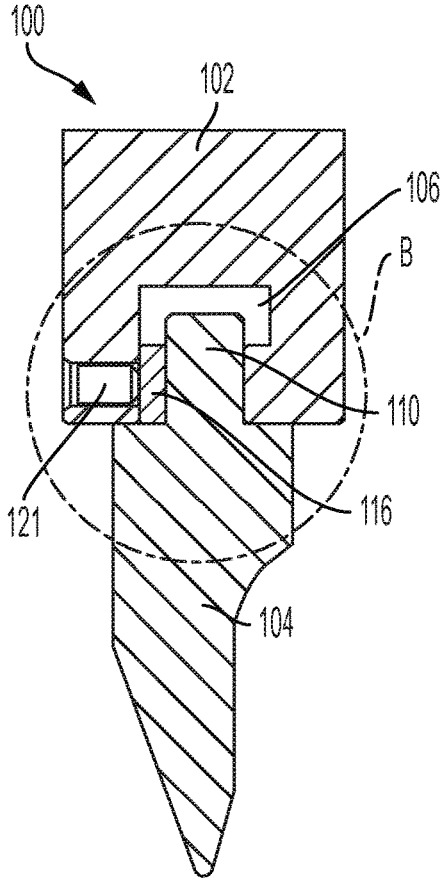
FIG. 1C PRIOR ART
FIG. 1C is a section view of the machine tool apparatus, taken along line A-A of FIG. 1B.

FIG. 1C is a section view of machine tool apparatus 100 with holder 102 coupled to tool 104, taken along line B-B of FIG. 1B. This section view illustrates the inner portion of holder 102 and tool 104. As shown, each fastener 121 may extend through a portion of holder 102, contacting clamp 116 at one end. By adjusting the distance by which clamping bar 116 protrudes into receiving cavity 106, via the fasteners, differently-sized tangs may be coupled tightly with holder 102.

Figure 1D:
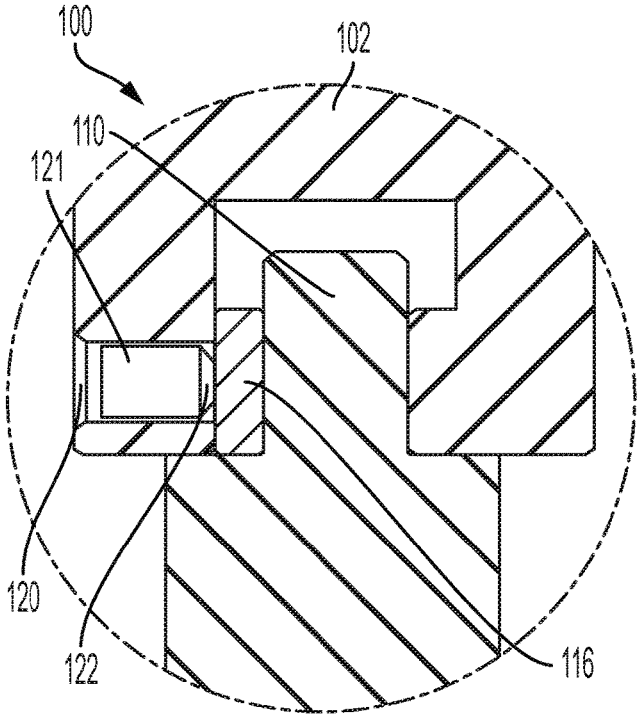
FIG. 1D PRIOR ART
FIG. 1D is a detail view of machine tool apparatus, taken at detail B of FIG. 1C.

FIG. 1D is a side view of machine tool apparatus 100 with holder 102 coupled to tool 104, taken at detail B of FIG. 1C. As more closely shown in FIG. 1D, fastener 121 may define a tapered edge 122, which may directly contact clamp 116 when fastener 121 is inserted through aperture 120. In the engaged configuration shown, the lateral gaps present between tapered edge 122, clamp 116 and tang 110 may be reduced or eliminated.

Magnetic Tooling Engagement

Figure 2A:
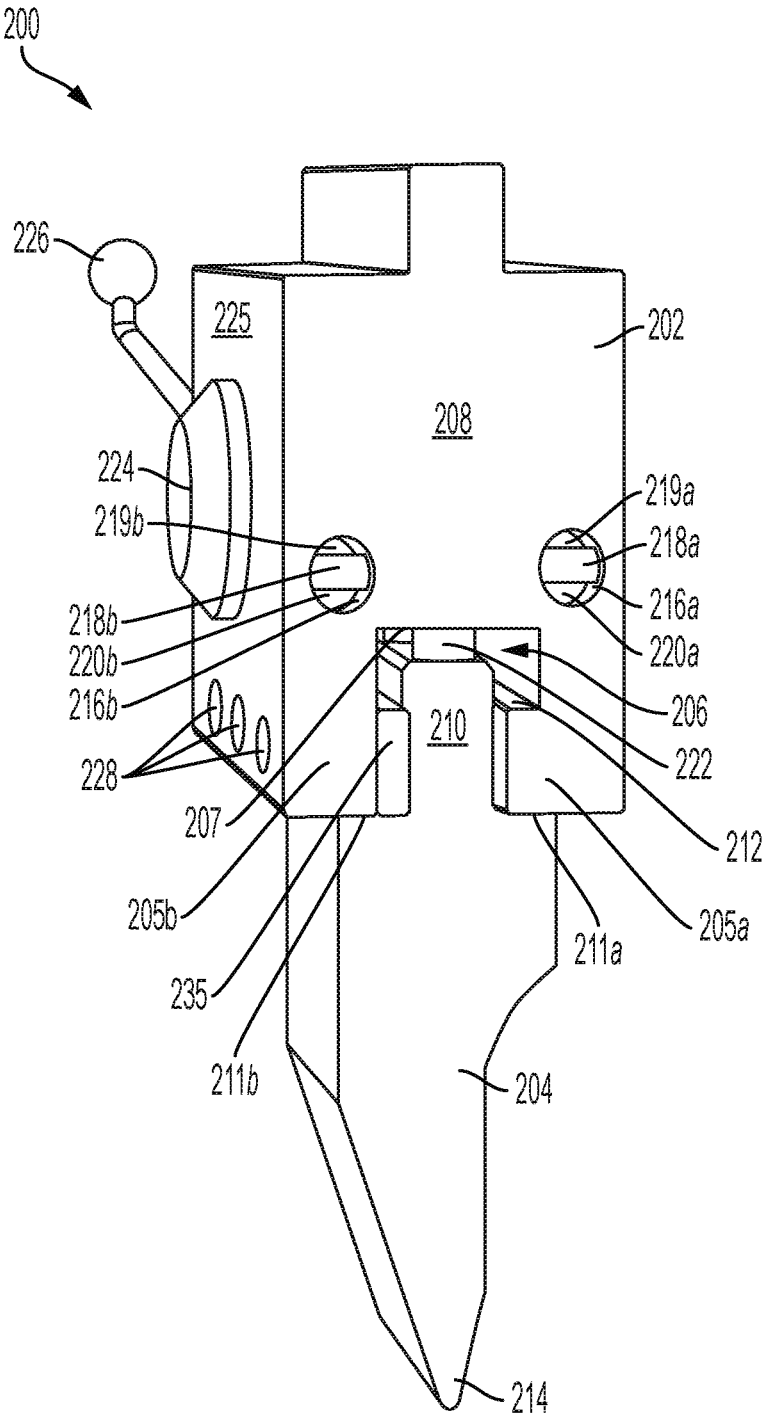
FIG. 2A is an isometric view of a magnetic engagement system for a machine tool holder.

FIG. 2A is an isometric view of a magnetic engagement system 200 for a tool holder 202 coupled with a machine tool or tool insert 204, e.g., a press brake or punch tooling component. As shown, magnetic tool holder 202 may define two opposing tool shoulders 205*a*, 205*b*. A receiving portion or cavity 206 comprising a cavity ceiling 207 is defined at side surface 208 of holder 202. Tool 204 may be coupled with holder 202 by inserting an upper portion or tang 210 of the tool into receiving cavity 206 such that two shoulders 211*a*, 211*b* of the tool abut shoulders 205*a*, 205*b* of the holder.

In some embodiments, the tool 204 may define only one shoulder, e.g., shoulder 211*a* or 211*b*, such that only one of the opposing tool shoulders 205*a* or 205*b* abuts the shoulder of the tool when inserted within receiving cavity 206. In some examples, receiving cavity 206 may define at least one relief, groove, recess, shelf or ledge 212. Like tool 104, tool 204 may define a working end 214 opposite the holder. Side surface 208 may define one or more apertures 216*a*, 216*b*, each exposing a portion of a slidable rack 218*a* and 218*b*, respectively.

An upper stator magnet 219*a*, 219*b* may be positioned above each rack 218*a*, 218*b*, and a lower stator magnet 220*a*, 220*b* may be positioned below each rack. In the embodiment shown, a portion of each stator magnet 219*a*, 219*b*, 220*a*, 220*b* is exposed through each aperture 216*a*, 216*b*. FIG. 2A also shows vertical center magnets 222 protruding from holder 202 into receiving cavity 206, where an end of each center magnet 222 may directly contact an upper surface of tang 210 after its insertion.

A handle, lever or other actuator 224 is attached to front surface 225 of holder 202. In this particular example, actuator 224 includes an elongated knob 226, but in various embodiments actuator 224 may comprise any protrusion or feature manipulable or graspable by an operator for manually securing holder 202 to tool 204. As described in greater detail below, actuator 224 may be operatively coupled with slidable racks 218*a*, 218*b* such that moving, rotating, or otherwise adjusting or manipulating actuator 224 may cause the racks to slide longitudinally within holder 202. A plurality of fastener apertures 228 are defined by front surface 225, the apertures configured to receive fasteners that may be tightened to urge a clamping bar or similar clamping mechanism 235 against a surface of tang 210.

Together, actuator 224, racks 218*a*, 218*b*, and various magnetic elements included within holder 202 may comprise at least a portion of a coupling mechanism configured to reversibly couple tool 204 with holder 202. More particularly, the magnetic elements may form a magnetic assembly configured to generate a magnetic flux coupling between holder 202 and tool 204. By selectively manipulating at least one of the magnetic elements, for example by physically moving the element(s), the coupling mechanism modulates the strength of the magnetic flux coupling by guiding the flux between the tool holder 202 and machine tool 204, thereby regulating the strength of the magnetic coupling to switch holder 202 between engaged (locked), disengaged (unlocked) and/or intermediate configurations with respect to tool 204. Tool 204 may include or be made of ferromagnetic materials selected to increase the strength of the magnetic coupling, and to guide the flux from the tool holder 202 to the tool 204, and back from the tool 204 to the tool holder 202.

The coupling mechanism may be used to couple tool 204 with holder 202 while arranging or staging additional tools within holder 202 and/or other holders. In some embodiments, the coupling mechanism may provide a safety mechanism for temporarily coupling tool 204 with holder 202, for example before an additional clamping mechanism is activated and the press brake apparatus begins operating to form a workpiece. In some examples, the magnetic coupling mechanism may suffice to secure tool 204 with holder 202 without additional support, for example as provided by clamping bar 235. Alternative examples may include fixed or stationary magnets, e.g., fixed, non-switchable magnets. Such embodiments may be sufficient for coupling smaller tools, in particular, and may exert a magnetic flux coupling readily overcome by manual engagement.

Figure 2B:
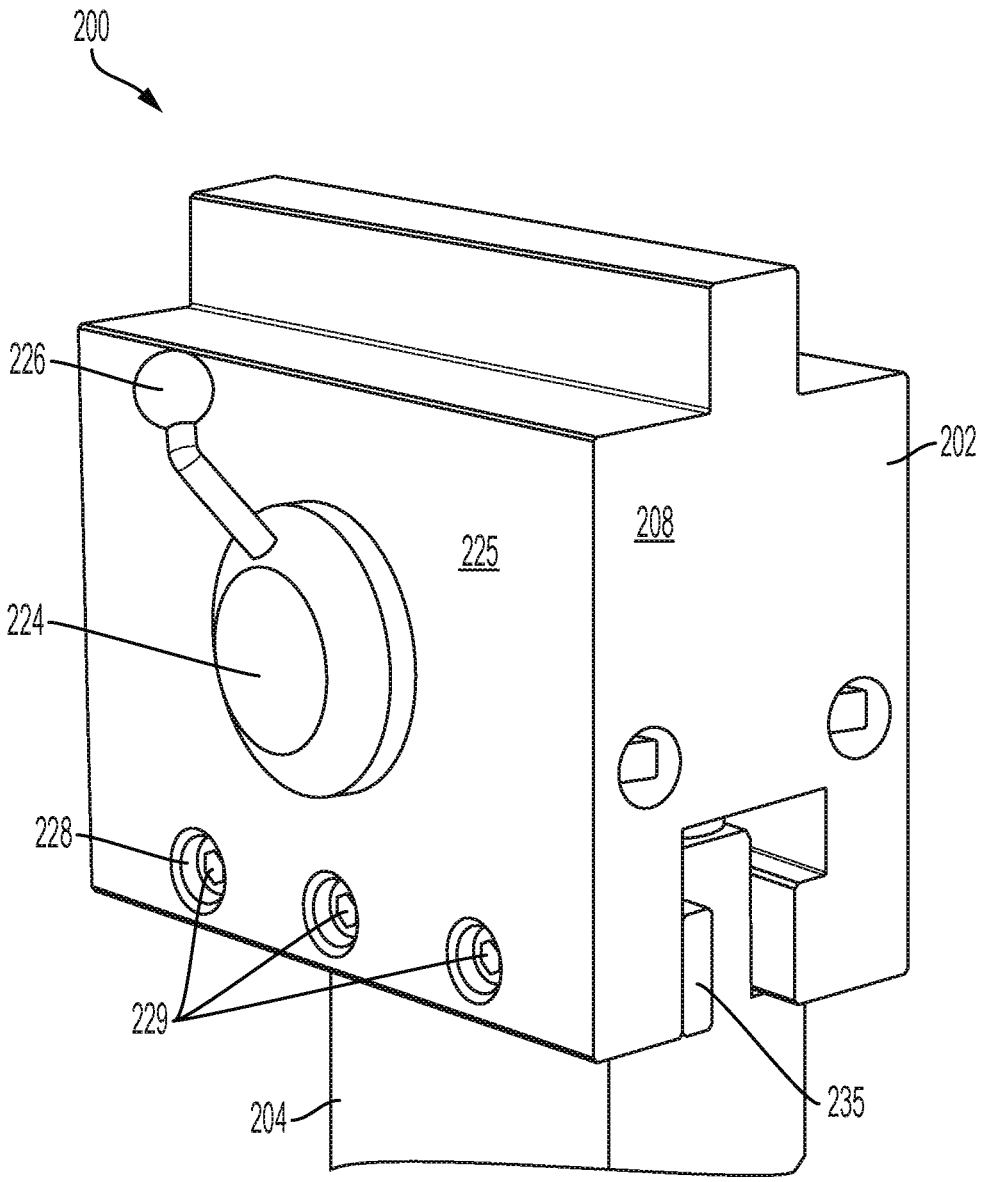
FIG. 2B is an alternate isometric view of the machine tool engagement system.

FIG. 2B is an alternate isometric view of magnetic engagement system 200 for tool holder 202 coupled with machine tool 204. As shown, actuator 224 may be positioned approximately near the center of front surface 225. Three fasteners 229, e.g., set screws, are also shown inserted into each of the fastener apertures 228. Fasteners 229 may be implemented in embodiments in which tool 204 is particularly heavy and/or an amount of side loading or torque may be applied against tool 204 during operation, thereby necessitating the supplemental clamping force provided by the fasteners applying a lateral force against clamping bar 235.

In some embodiments, where a basal or nominal level of magnetic coupling strength is sufficient to retain tool 204 within a disengaged holder 202, for example, fasteners 229 and tightening clamp 235 may be unnecessary. Such embodiments may thus lack fastener apertures 228 within front surface 225 or elsewhere on holder 202, and may also lack clamping bar 235. In some embodiments, however, the magnetic strength of the coupling mechanism provided by the magnetic elements may be relied upon to retain tool 204 on a temporary basis, e.g., while staging for tool installation. In such embodiments, the physical coupling mechanism provided by clamping bar 235 may provide the supplemental clamping strength necessary to secure tool 204 in place for use in metal forming operations.

In implementations that include clamping bar 235, receiving cavity 206 may be partially defined by a stationary side, e.g., the interior surface of shoulder 205*a*, and an opposing movable side comprised of clamping bar 235. In some examples, clamping bar 235 may be configured for selective engagement with a surface of the coupling end of the machine tool in response to activation of the magnetic flux coupling. Additional embodiments may include alternative mechanisms for adjusting clamping bar 235, e.g., other than fasteners 229. For example, clamping bar 235 may be movable by a cam and lever and/or an electric or hydraulic actuator.

Figure 2C:
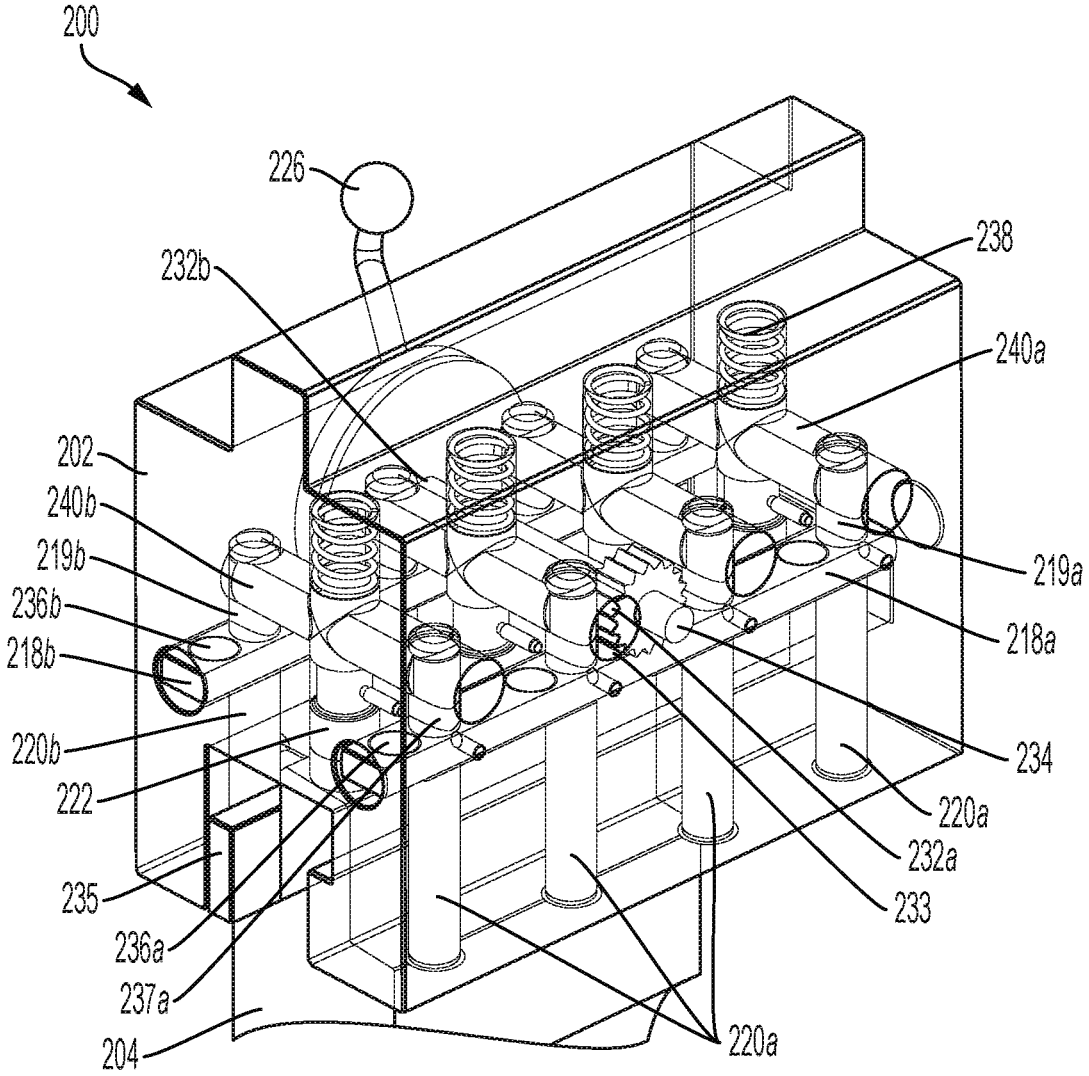
FIG. 2C is an isometric view showing the internal configuration of the machine tool engagement system.

FIG. 2C is an isometric view of engagement system 200 for tool holder 202 coupled with machine tool 204, showing the internal configuration of a magnetic assembly embedded within the holder. Pinions 232*a* and 232*b* are coupled with an axle 234, which begins at actuator 224 and extends laterally though the body of holder 202. Each pinion 232*a*, 232*b* is configured to engage a complementary gear surface 233 defined by each rack 218*a*, 218*b*, such that rotation of each pinion causes each rack to slide longitudinally within the holder, transverse to axle 234. Each of the racks 218*a*, 218*b* includes a plurality of alternately-oriented rack magnets, which may be embedded within or otherwise fixed or coupled with the racks.

In the example shown, rack 218*a* includes four pairs of rack magnets, each pair comprising a first rack magnet 236*a* and a second rack magnet 237*a*. Likewise, rack 218*b* includes four pairs of rack magnets, each pair comprising a first rack magnet 236*b* and a second rack magnet 237*b*. Four vertical center magnets 222 are included in this embodiment, each positioned proximate, e.g., beneath, a vertically oriented center spring 238. Pairs of ferromagnetic brushes 240*a*, 240*b* extend laterally outward from each center magnet 222, mating with a portion of each upper stator magnet 219*a*, 219*b*. In various embodiments, each brush may comprise a high-permeability, ferromagnetic material.

The magnetic assembly shown in FIG. 2C is configured to induce parallel magnetic circuits of adjustable, magnetic strength (e.g., switchable with respect to magnetic orientation) for selectively engaging and disengaging holder 202 with tool 204 by exerting a reversible pulling force thereon or a reversible attractive force therebetween. In an unclamped, unlocked or otherwise disengaged state, when the magnetic strength is reduced, the holder 202 may allow installation and removal of tool 204 with respect to receiving cavity 206. In a clamped, locked or otherwise engaged state, when the magnetic strength is increased, the holder 202 may hold the tool 204 in place for use in forming and/or folding operations. As shown, upper stator magnets 219*a*, 219*b* and lower stator magnets 220*a*, 220*b* may be included within both shoulders 205*a*, 205*b* of holder 202, so as to exert a magnetic pulling or attractive force on both shoulders 211*a*, 211*b* and tang 210 of tool 204.

In operation, the magnetic assembly of holder 202 is configured to generate a magnetic flux coupling adapted for the selective engagement of the tool 204, specifically at tang 210, which may be ferromagnetic and comprised of carbon steel or medium alloy steel in some embodiments. The magnetic flux coupling may be engaged, and disengaged, by manually manipulating actuator 224 via knob 226. In turn, actuator 224 manipulates at least one of the internal magnetic elements shown in FIG. 2C to modulate the strength of the magnetic flux coupling.

The strength of the magnetic flux coupling may be adjusted by altering the alignment of rack magnets 236*a/b*, 237*a/b* with the upper stator magnets 219*a*, 219*b* and lower stator magnets 220*a*, 220*b*. Adjusting the alignment of the rack magnets relative to the stator magnets is driven by rotation of the pinions 232*a/b*, which causes the racks, and thus the rack magnets embedded therein, to slide within the holder. In some examples, the slidable racks, along with the magnets embedded therein, are responsive only to the actuator, such that the locked and unlocked positions of the holder are bi-stable or non-momentary.

The number of parallel pairs of magnetic components, e.g., upper stator magnets 219*a/b*, lower stator magnets 220*a/b* and ferromagnetic brushes 240*a/b* may vary. The example shown includes four parallel magnetic subassemblies, each subassembly including single center magnet 222. The number of magnetic subassemblies may range from 1 to about 10, 1 to about 15, 1 to about 20, or any suitable range therebetween and may depend at least in part on the length of the holder and/or the weight of the tool to be coupled with the holder. In some examples, each subassembly may induce two magnetic circuits.

Figure 2D:
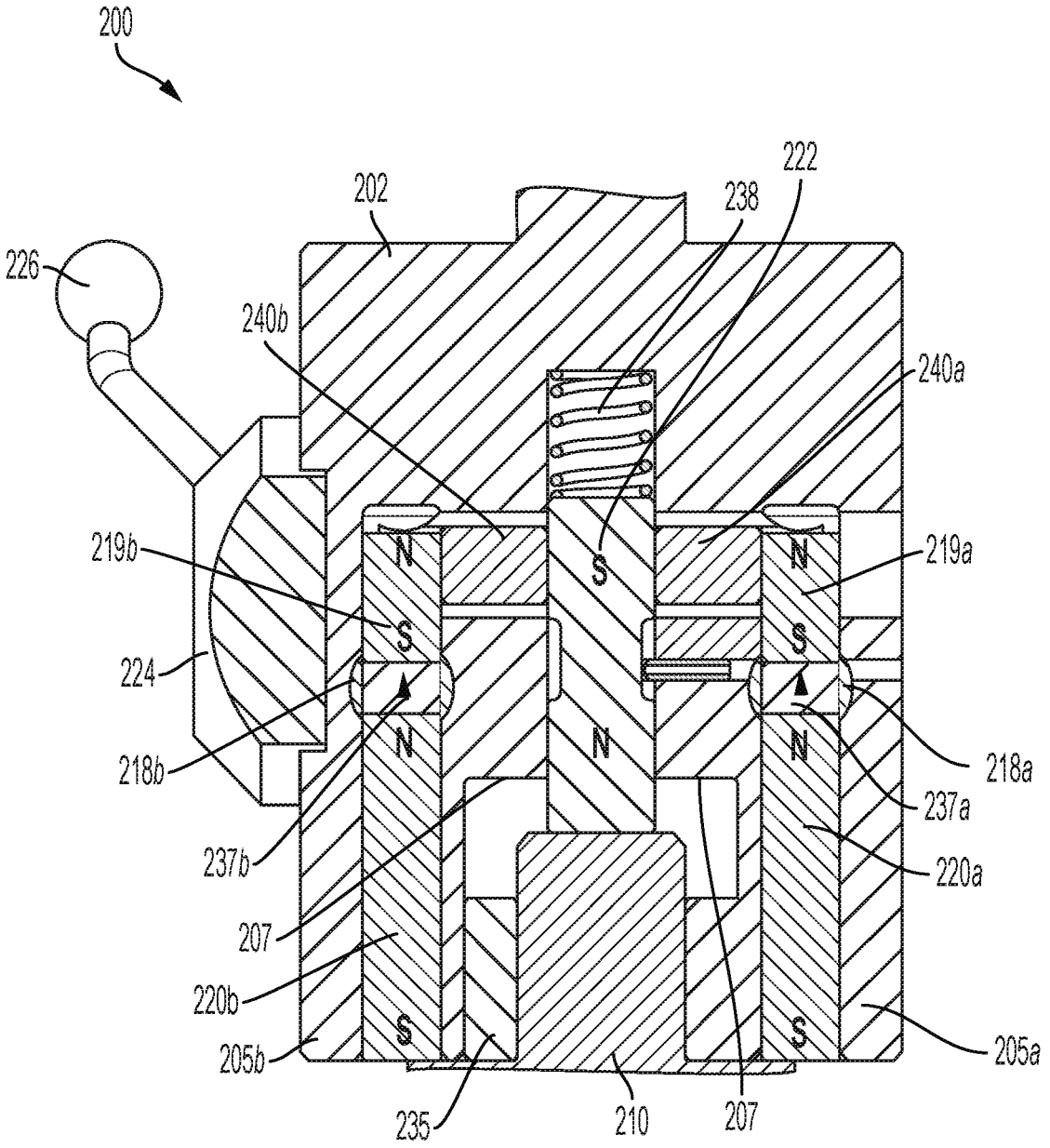
FIG. 2D is a section view of the machine tool engagement system.

FIG. 2D is a section view of engagement system 200 for tool holder 202 coupled with machine tool 204, showing the internal arrangement and magnetic orientation of a magnetic subassembly in an engaged configuration of holder 202. As illustrated in FIG. 2D, the magnetic elements within holder 202 are magnetically oriented to induce a magnetic circuit in the engaged configuration. In particular, each of the lower stator magnets 220*a*, 220*b* is oriented such that its north pole is positioned above its south pole, and each of the upper stator magnets 219*a*, 219*b*, positioned directly above the lower stator magnets, is also oriented such that its north pole is oriented above its south pole. The magnets may be arranged in the reverse orientation in additional examples. Similarly, rack magnets 237*a* and 237*b* are also oriented with the north pole facing up in this configuration.

The center magnet 222 is magnetically oriented with its south pole facing up, e.g., in the reverse orientation relative to the stator magnets and rack magnets. Ferromagnetic brushes 240*a*, 240*b* are positioned laterally between each upper stator magnet 219*a*, 219*b* and center magnet 222, and when inserted into receiving cavity 206, tang 210 of tool 204 is positioned below center magnet 222 and laterally between each lower stator magnet 220*a*, 220*b*. As a result, a magnetic circuit that generates a magnetic flux may be established through the magnetic elements included in holder 202.

The flux may pass vertically through upper stator magnet 219*a*, laterally through ferromagnetic brush 240*a*, vertically through center magnet 222, diagonally through tang 210, and vertically through lower stator magnet 220*a*. A similar magnetic circuit may be simultaneously established through lower stator magnet 220*b*, rack magnet 237*b*, upper stator magnet 219*b*, ferromagnetic brush 240*b*, center magnet 222 and tang 210. Thus, parallel magnetic circuits may be established in the configuration shown, collectively generating a total magnetic force sufficient to couple tool 204 with holder 202.

In some embodiments, clamping bar 235 may contribute and/or be affected by the magnetic circuits, particularly the circuits generated by the magnetic components embedded in shoulder 205*b*. As a result, clamping bar 235 may not drop, droop or otherwise hang down within receiving cavity 206. Securing clamping bar 235 via the magnetic circuits to prevent dropping may be necessary to properly position the clamping bar for tightening against tang 210 without, for example, lowering tool 204 onto a deformable material to force the tool and the clamping bar into an acceptable position for clamping.

Suitable configurations may also include one or more magnetic components coupled with clamping bar 235, for example embedded within clamping bar 235 or installed in a top portion of the clamping bar. Such magnetic components may urge clamping bar 235 against the inner surface of shoulder 205*b*, and may also contribute to the magnetic pulling or attractive force exerted on tool 204. In addition or alternatively, one or more magnetic components may be included within shoulder 205*b* to pull clamping bar 235 tightly against an inner surface thereof, preventing the clamping bar from drooping or dropping in a vertical direction. In addition or alternatively, one or more magnetic components may be installed in a bottom portion of clamping bar 235 to urge the clamping bar against shoulder 205*b*. Magnetic components included in both a top and bottom portion of clamping bar 235 may also be included.

To strengthen the magnetic circuits established by the magnetic components embedded within shoulders 205*a/b*, the clamping bar magnets can each be similarly oriented, e.g., either north-to-south or south-to-north. Clamping bar 235 may comprise a ferromagnetic material or a non-ferromagnetic material. In some embodiments, clamping bar 235 may include one or more high-permeability inserts aligned with the magnetic components included in shoulder 205*b* of the holder body such as to avoid interference with, and/or contribute to, the magnetic circuit passing therethrough.

As disclosed, each pair of rack magnets (e.g., 236*a* and 237*a*) may comprise oppositely oriented magnets, alternating between north pole-up and south pole-up along the length of each slidable rack 218*a*, 218*b*. Because each rack magnet within a rack magnet pair is oppositely oriented, and because the slidable racks are positioned between each pair of upper and lower stator magnets, sliding the racks alternately strengthens or disrupts the magnetic circuit established in the configuration depicted in FIG. 2D, depending on which rack magnet, e.g., 236*a* vs. 237*a*, is aligned with a pair of lower and upper stator magnets. For instance, rack magnet 237*a* is shown in magnetic alignment with lower stator magnet 220*a* and upper stator magnet 219*a*. However, upon manipulating actuator 224 via knob 226, rack 218*a* may slide longitudinally (into or out of the page), thereby moving rack magnet 237*a* out of alignment with upper stator magnet 219*a* and lower stator magnet 220*a*.

Because each rack magnet may comprise a relatively strong magnetic material, e.g., an NdFeB or similar permanent magnet material, such misalignment may disrupt the magnetic circuit and allow tang 210, and thus tool 204, to be released from holder 202. In this manner, actuator 224 may modulate the strength of the magnetic flux coupling between holder 202 and tool 204, switching the holder between locked and unlocked configurations by adjusting the alignment of the rack magnets with the other magnetic components of the holder via movement of the slidable racks.

In various embodiments, center magnets 222 may be vertically slidable to adapt to variation in the amount of clearance between the top surface of tang 210 and cavity ceiling 207. The amount of clearance may vary due to variation in punch tang heights, with greater clearance generally resulting from shorter tangs relative to taller tangs. Thus, to accommodate tangs of different heights, center magnets 222 may slide up and down within cylindrical holes in the body of holder 202, between the arcuate side surfaces of each ferromagnetic brush 240*a*, 240*b*.

Because tang 210 may contact center magnet 222, the vertical distance by which the center magnet protrudes into the holder body may depend on the height of the tang, such that taller tangs may force the center magnet further into the holder body. Center springs 238 positioned above each center magnet may accommodate such movement by compressing upon insertion of the tang. Upon release of the from the receiving cavity, the springs may urge center the magnet back downward, returning the magnet back to its resting state position ready to receive another tang.

To establish defined magnetic circuits between the magnetic components of holder 202, e.g., permanent magnets, ferromagnetic elements and/or electromagnets, the holder body may comprise a non-ferromagnetic material, including various stainless steels, e.g., austenitic stainless steel. In some embodiments, the holder body may include one or more high-permeability inserts aligned with the stator magnets and center magnets to optimize the magnetic circuits generated therethrough. In some embodiments, at least a portion of the body of the holder may be ferromagnetic.

Figure 2E:
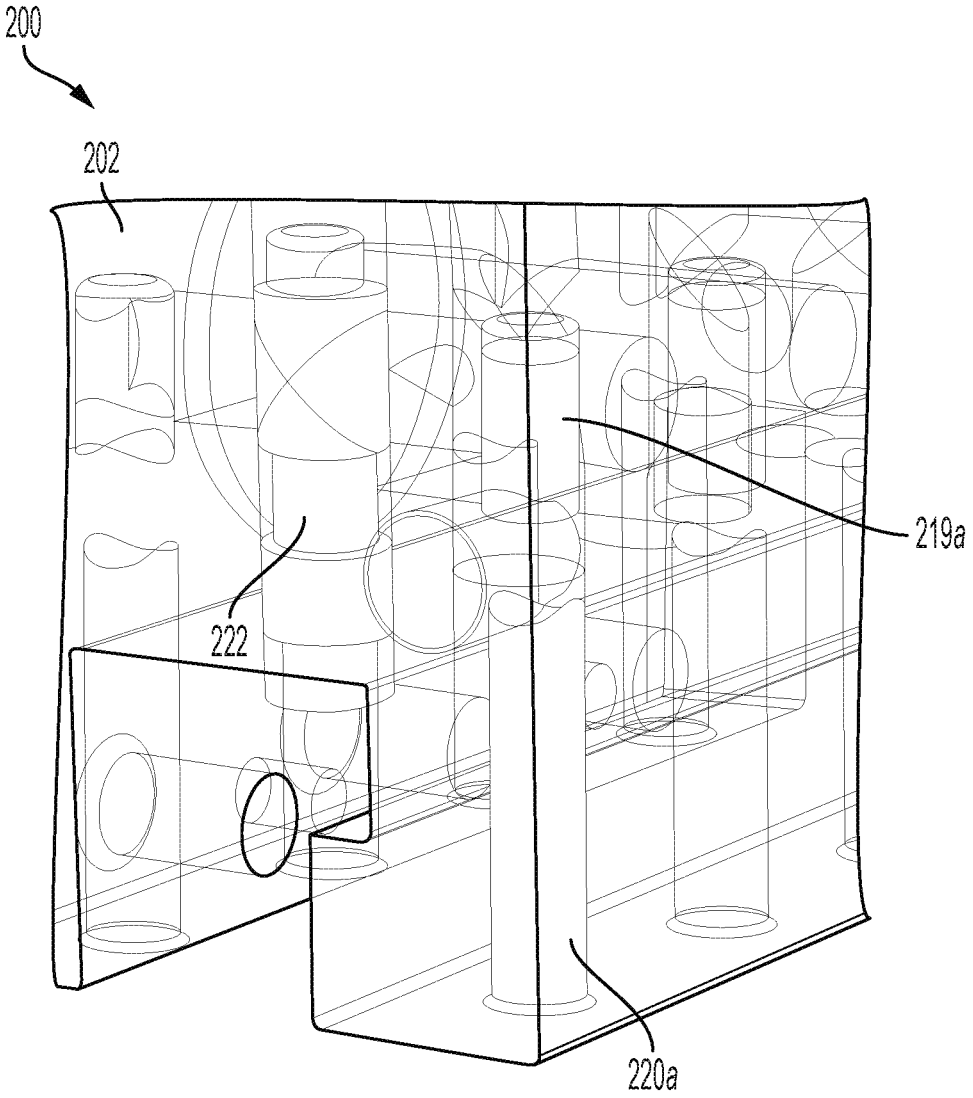
FIG. 2E is an isometric view of the machine tool engagement system, showing the internal magnetic assembly.

FIG. 2E is an isometric view of magnetic engagement system 200 for tool holder 202, highlighting the internal structure of upper stator magnet 219*a*, lower stator magnet 220*a*, and center magnet 222. As shown, each of these magnetic elements may be vertically oriented within holder 202, transverse to the ferromagnetic brushes. The relative dimensions of each magnet are merely examples, and other configurations may be acceptable. In this particular embodiment, lower stator magnet 220*a* and upper stator magnet 219*a* are approximately cylindrical and elongate. Center magnet 222 defines alternating wide and narrow portions, the narrow portions facilitating slidable retention within the holder body.

Figure 2F:
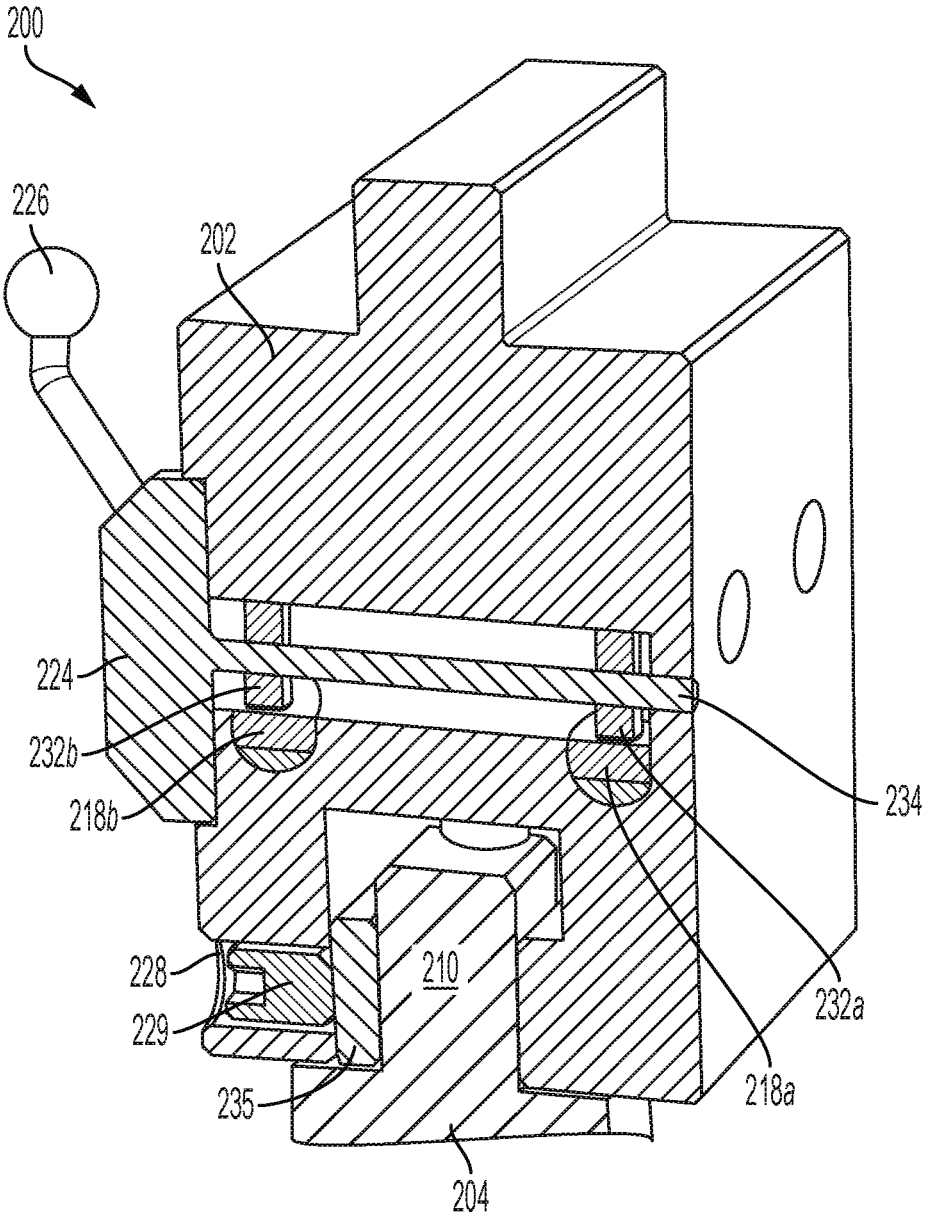
FIG. 2F is section view of the machine tool engagement system, in an embodiment with an internal rack and pinion assembly.

FIG. 2F is a section view of magnetic engagement system 200 for tool holder 202 coupled with machine tool 204, showing the internal configuration of pinions 232*a*, 232*b*, actuator 224 and axle 234. As shown, the length of axle 234 may be approximately equal to the width of holder 204. Pinion 232*a* is positioned directly above rack 218*a* and pinion 232*b* is positioned directly above rack 218*b*, such that rotation of pinion 232*a* causes rack 218*a* to slide, and rotation of pinion 232*b* causes rack 218*b* to slide. As further illustrated in FIG. 2F, fastener 229 may extend within aperture 228 through a portion of holder 204 such that an end of the fastener contacts clamp 235. Tightening of fastener 229 may thus apply a lateral force against clamp 235, urging the clamp against the side surface of tang 210. In this manner, fastener 229 may apply a mechanical coupling mechanism in addition to the adjustable magnetic coupling mechanism comprised of the magnetic elements discussed above.

Figure 2G:
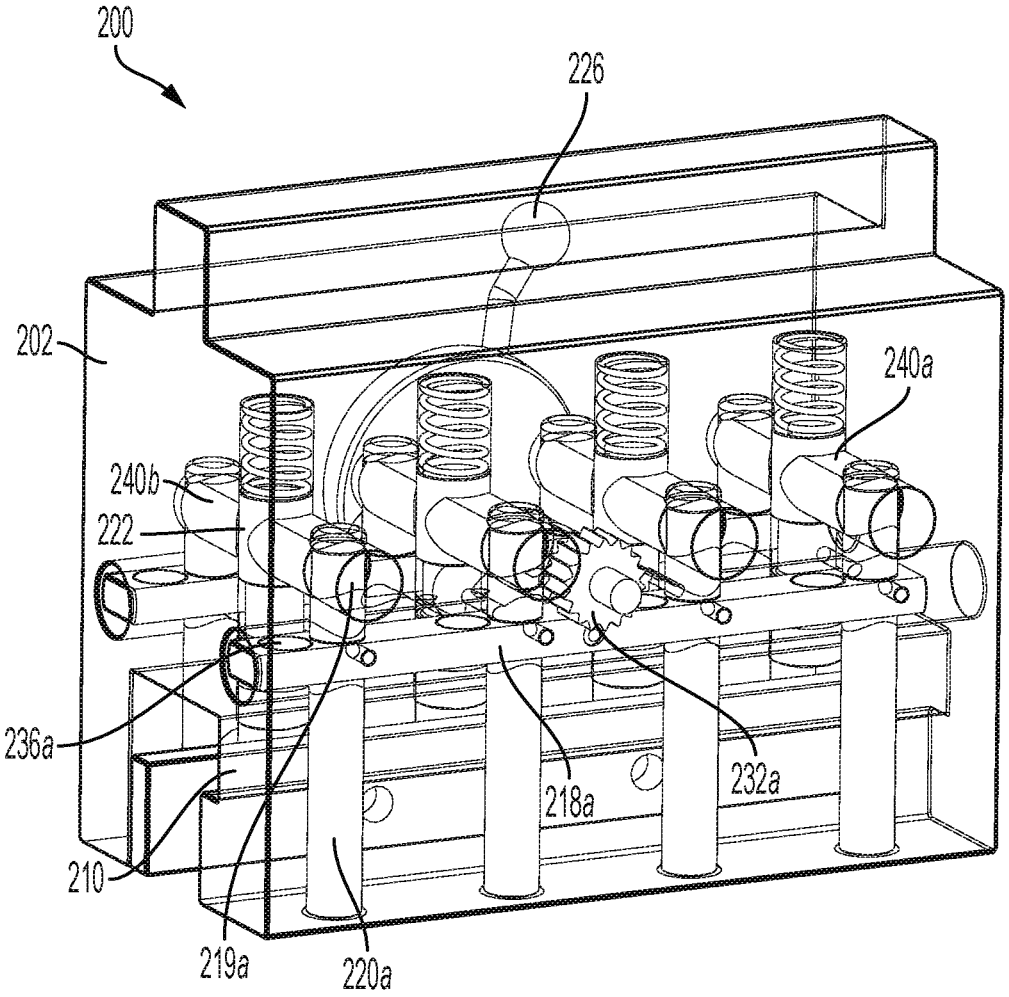
FIG. 2G is an isometric internal view of the machine tool engagement system, in an engaged configuration.

FIG. 2G is an isometric view of magnetic engagement system 200 for holder 202 coupled with machine tool 204, showing the internal structure of the holder 210 in an engaged configuration with the tool. In the engaged configuration, slidable racks 218*a* and 218*b* are positioned such that rack magnets 237*a* and 237*b*, respectively, are aligned with each set of the upper stator magnets 219*a*, 219*b* and lower stator magnets 220*a*, 220*b*. The polarity of the rack magnets strengthens a magnetic circuit with the upper and lower stator magnets, ferromagnetic brushes, center magnets, and tang sufficient to reversibly couple tool 204 with holder 202. As further shown, knob 226 is biased to the right in this configuration.

Figure 2H:
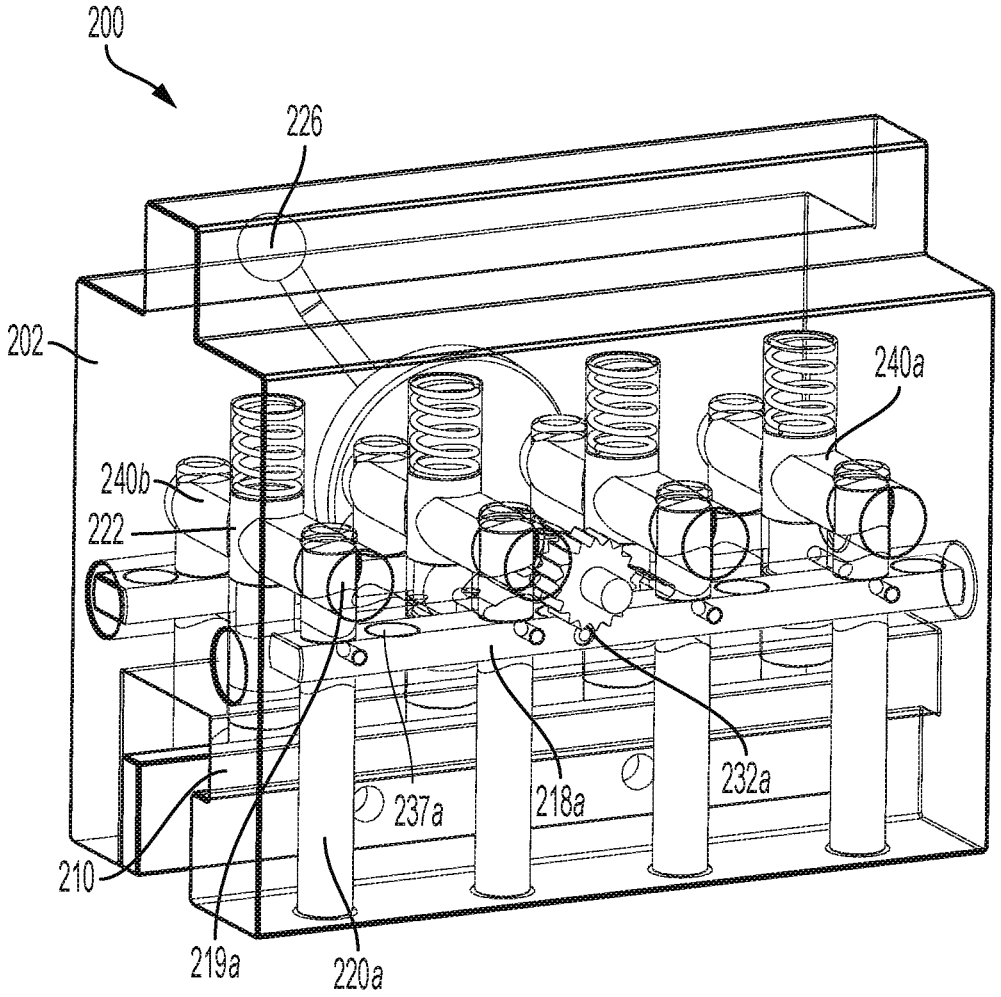
FIG. 2H is an isometric internal view of the machine tool engagement system, in a disengaged configuration.

FIG. 2H is an isometric view of magnetic engagement system 200 for holder 202 coupled with machine tool 204, showing the internal configuration of holder 202 in a disengaged configuration with the tool 204. In the disengaged configuration, slidable racks 218*a* and 218*b* are positioned such that rack magnets 236*a* and 236*b*, respectively, are aligned with each set of upper stator magnets 219*a*, 219*b* and lower stator magnets 220*a*, 220*b*. The reverse polarity of rack magnets 236*a* and 236*b* disrupts the magnetic circuit between the upper and lower stator magnets, ferromagnetic brushes, center magnets 222, and tang 210. Such disruption may be sufficient to disengage, or release, tool 204 from holder 202.

In some embodiments, an amount of residual magnetic strength or coupling force may remain even in the disengaged configuration. The magnetic strength of the holder remaining in the disengaged configuration may be sufficient to retain various tools, especially smaller or less heavy tools. This basal or residual magnetic strength may be particularly advantageous for coupling multiple tools within the same holder, as the first-inserted tools may remain coupled with the holder while additional tools are added. After all tools are coupled with such a holder, the actuator 224 may be manipulated to switch the holder into the engaged configuration, ready for operation. Relative to its orientation in FIG. 2G, knob 226 is biased to the left as a result of its engagement by a user. Slidable racks 218*a*, 218*b* are also positioned deeper within the body of holder 202.

In various examples, one or more control mechanisms may also be implemented to adjust the strength of the magnetic flux coupling between holder 202 and tool 204. For example, a control mechanism may be configured to reduce the strength of the magnetic circuit generated by the holder while various tools are being coupled with the holder. When all tools are correctly positioned, an operator can fully activate the control mechanism to secure all tools to the holder.

As further discussed below with reference to FIGS. 8A-8H, one or more magnetic elements of the holder may comprise an electromagnet. The electromagnet may be configured to modulate the strength of the magnetic flux coupling between the tool and the holder under the direction of an instruction received from a press control panel or directly at the press brake assembly. In some embodiments, the control mechanism may include an electronic controller. The electronic controller may include or be at least communicatively coupled with a sensor configured to detect the presence or absence of tool 204 within receiving cavity 206. Based on this detection, the sensor provides feedback signaling to the electronic controller. Additional components of the controller may then adjust the position of the slidable racks 218*a*, 218*b* to increase, decrease, or maintain the magnetic strength of holder 202. For example, the sensor may determine that tang 210 is positioned within, or in close proximity to, receiving cavity 206, prompting the sensor to provide an indication to the controller that a magnetic coupling should be established or strengthened to couple holder 202 with tool 204.

Figure 2I:
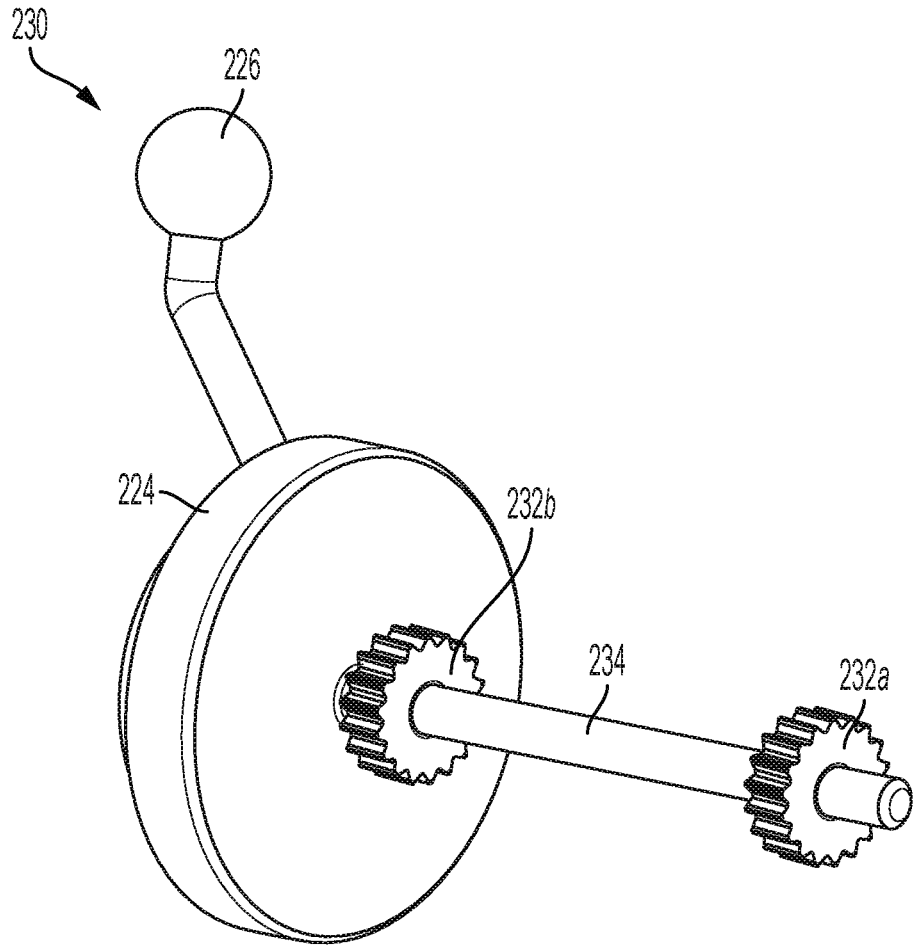
FIG. 2I is an isometric view of a rotatable pinion and actuator assembly for the machine tool engagement system.

FIG. 2I is an isometric view of a rotatable pinion and actuating handle assembly 230, e.g., for a magnetic engagement system 200 as described herein. As shown, each pinion 232*a*, 232*b* may define a central, circular aperture configured to receive axle 234. The pinions may each be fixed to axle 234 to prevent the pinions from sliding along the axle and ensure that rotation of axle 234 causes concurrent rotation of each pinion. The pinions may thus rotate in synchronized fashion upon engagement of actuator 224, which comprises a circular cap portion and protruding knob 226 in this embodiment. Actuator 224 may rotate relative to side surface 225 of holder 202 upon manual manipulation of knob 226. In additional embodiments, the actuator may be configured to slide along the length of holder 202 to effect rotation of the pinions. In embodiments that include an electronic controller, a manually manipulable actuator, such as actuator 224, may be absent.

Figure 2J:
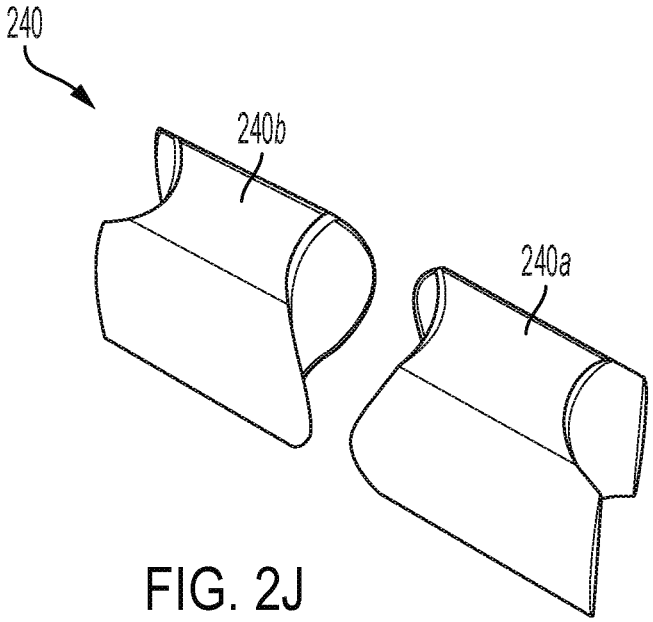
FIG. 2J is an isometric view of ferromagnetic brush assembly for the machine tool engagement system.

FIG. 2J is an isometric view of a ferromagnetic brush assembly 240 with a plurality of two or more ferromagnetic brushes 240*a* and 240*b*. Each ferromagnetic brush defines two arcuate, e.g., semicircular, end portions. One end portion of each brush is configured to mate with a complementary surface of center magnet 222, and a second end portion, opposite the first, is configured to mate with a complementary surface of upper stator magnet 219*a* (with respect to ferromagnetic brush 240*a*) or upper stator magnet 219*b* (with respect to ferromagnetic brush 240*b*). The brushes may be press-fit or affixed within holder 202. The ferromagnetic material comprising each brush may vary, provided the material is sufficient to propagate a magnetic flux between center magnet 222 and the upper stator magnets. In some examples, the brushes may be highly permeable and may comprise a magnetically soft material such as silicon steel or 47-50 Fe—Ni alloy.

Figure 2K:
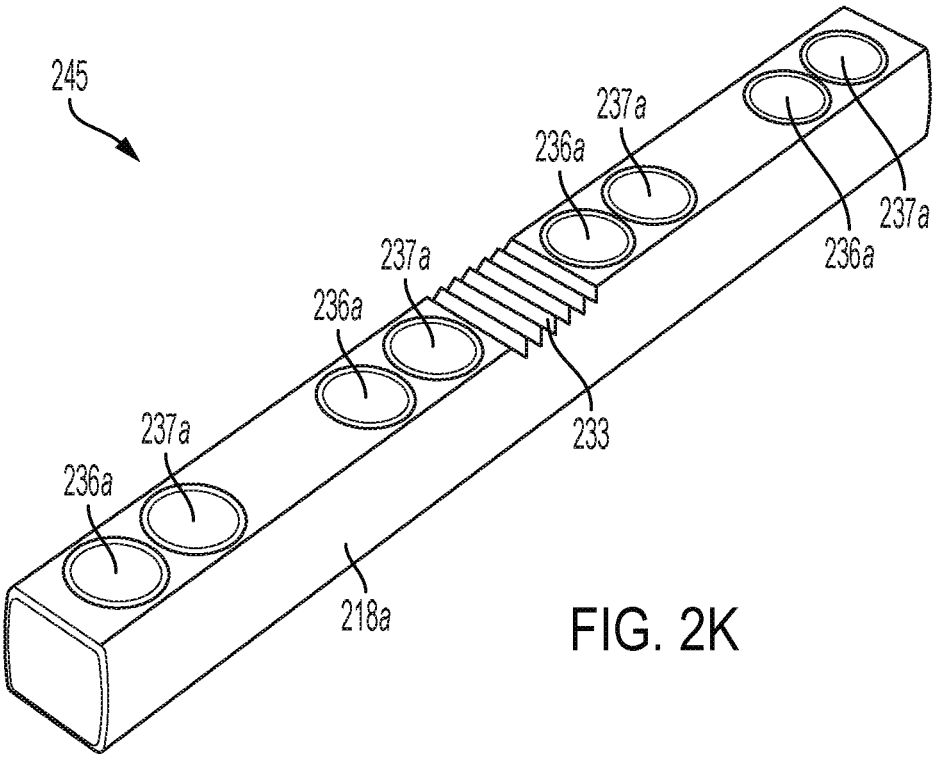
FIG. 2K is an isometric view of a slidable rack and magnet assembly for the machine tool engagement system.

FIG. 2K is an isometric view of a rack assembly 245 with slidable rack 218*a* and paired rack magnets 236*a*, 237*a* embedded therein. This particular rack comprises four pairs of rack magnets, but embodiments may comprise less or more rack magnets, ranging from 1 to about 5, 1 to about 10, 1 to about 15, or 1 to about 20 pairs of rack magnets. Gear surface 233 is positioned about the longitudinal center of rack 218*a*, where it can engage with pinion 232*a*. In examples, gear surface 225 may not be located at the center of the rack. The rack may be comprised of non-ferromagnetic material in various examples.

The magnetic strength of holder 202 in the disengaged configuration, and the movement of each rack 218*a*, 218*b* required to switch the holder between engaged and disengaged configurations, may depend on the strength and/or positioning of rack magnets 236*a*, 237*a*, 236*b*, 236*b*. As mentioned above, alternately oriented rack magnets 236*a*, 237*a* and 236*b*, 237*b* may comprise strong permanent magnets (for ease of explanation only the "a" magnet sets are referred to in this paragraph). Within each pair, rack magnet 236*a* is shown positioned relatively close to rack magnet 237*a*. In other implementations, the distance between the rack magnets in each pair may be adjusted.

Different distances between each rack magnet within a pair may modify the rate at which the magnetic strength of the magnetic circuit is adjusted. For example, oppositely-oriented rack magnets 236*a*, 237*a* positioned in close proximity may cause an abrupt switch between engaged and disengaged configurations of the holder 202 in response to even slight movement of rack 218*a*. By contrast, oppositely-oriented rack magnets 236*a*, 237*a* positioned further apart may cause a more gradual adjustment in the strength of the magnetic circuit upon movement of rack 218*a*, thereby causing a less abrupt switch between engaged and disengaged configurations of holder 202. According to such embodiments, greater movement of rack 218*a* may be required to toggle holder 202 between engaged and disengaged configurations.

Relatedly, rack 218*a* may be positioned in an intermediate configuration, between locked and unlocked configurations, in which the magnetic strength may be variable, e.g., at a level of magnetic strength capable of retaining some tools but not others. The strength of each rack magnet 236*a*, 237*a* (especially relative to the other magnets in the holder) may also impact the switch rate and/or the movement of rack 218*a* required to effect the switch. For example, if the rack magnet oriented to disrupt the magnetic circuit, e.g., the "reverse magnet," is stronger than its pairwise partner magnet, then the magnetic strength of the holder in the disengaged configuration may be nearly eliminated. Similarly, if upper stator magnets 219*a* and lower stator magnets 220*a* have a lower strength, the reduction in magnetic strength imparted by the reverse magnets in the disengaged configuration may be greater.

Figure 2L:
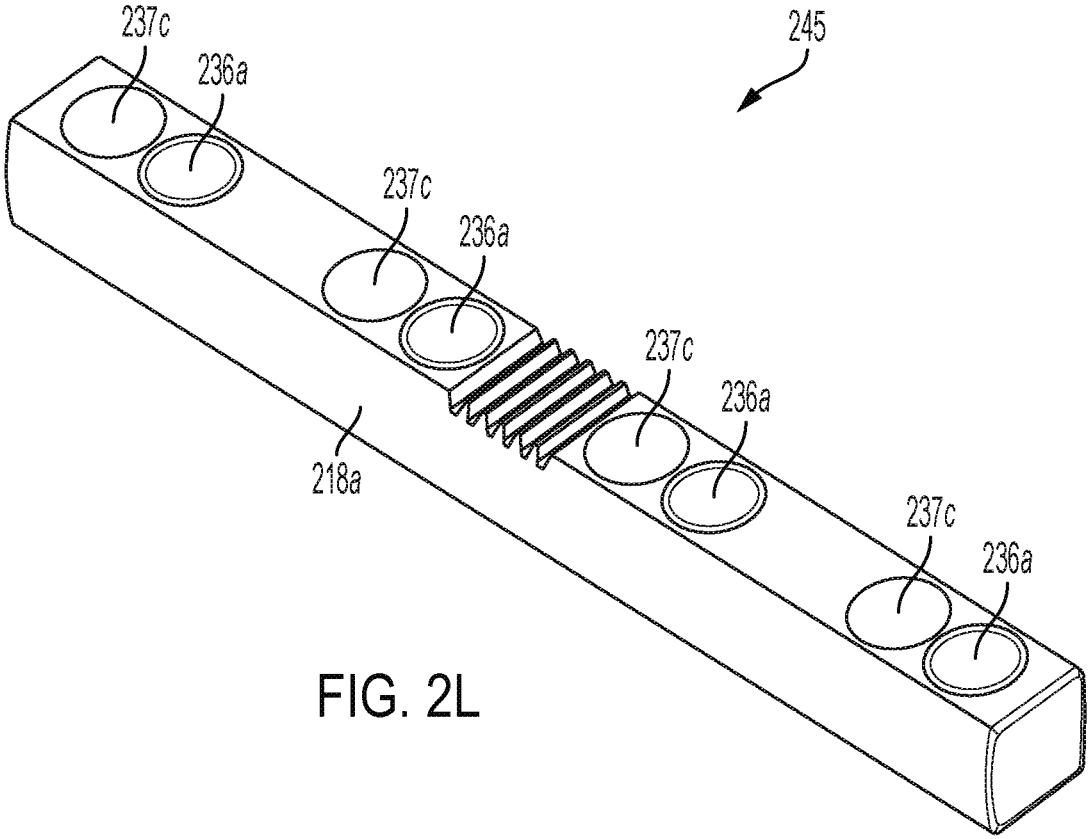
FIG. 2L is an isometric view of an alternate rack and magnet assembly for the machine tool engagement system.

FIG. 2L is an isometric view of an alternate rack assembly 245 with slidable rack 218*a* and magnets 236*a*, 237*c* embedded therein. As shown, each pair of rack magnets within slidable rack 218*a* may include rack magnet 236*a* and 237*c*. Each rack magnet 237*c* may comprise a ferromagnetic slug. Consequently, the magnetic circuit generated by alignment of rack magnets 237*c* with the upper and lower stator magnets may be weaker than the magnetic circuit generated by each rack magnet 237*b*, which may comprise a strong, permanent magnet. Additional embodiments may include different magnetic components. For example, in some embodiments the rack may include pairs of alternating magnets and air gaps. Additional embodiments may include pairs of alternating ferromagnetic slugs and air gaps. Various materials may be coupled with slidable rack 218*a* to alter the strength of the magnetic circuit generated by the rack in combination with the remaining components of holder 202.

Multiple Holder Assemblies

Figure 3:
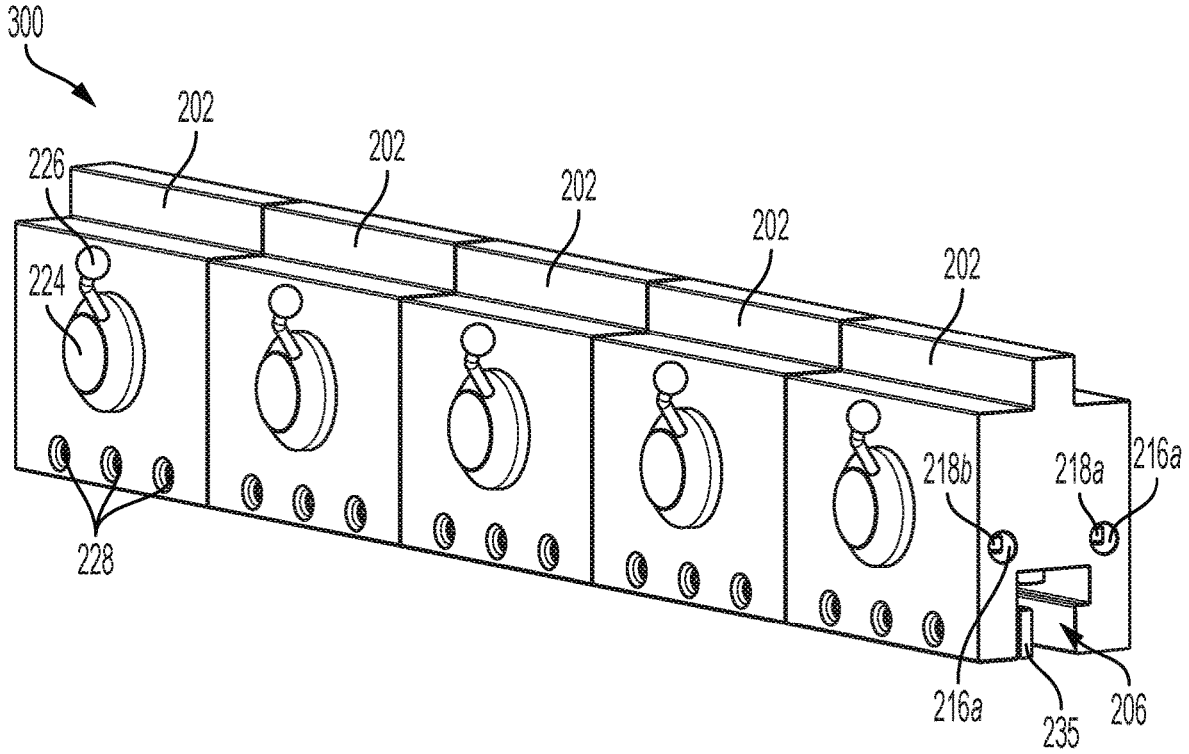
FIG. 3 is an isometric view of a magnetic machine tool holder assembly.

FIG. 3 is an isometric view of a plurality of magnetically engaged tool holders 202 arranged in a machine tool holder assembly 300. The battery or assembly 300 of holders may allow independent selective engagement of variously-sized tools within the same press brake assembly. For example, the arrangement shown in FIG. 3 may facilitate coupling of one or more tools by selectively placing the holders coupled with such tools into the engaged configuration. Meanwhile, additional holders within the same press brake assembly may remain in the disengaged configuration while tools are installed or rearranged in such holders. This arrangement of multiple holders, each independently adjustable via independent actuators 224, represents an improvement over traditional all-at-once (e.g., mechanical) clamping holders. The magnetic strength of each holder may vary, such that individual holders may generate magnetic circuits of equal or different magnetic strength. The number of individual holders included in an assembly may vary. Five holders 202 are illustrated in FIG. 3, but embodiments may include one to about ten, one to about fifteen, or one to about twenty holders 202, or more.

As a result, the length of assembly 300 may also vary. For instance, a 1-meter long assembly 300 may include as many as ten or more individual holders 202, each being approximately 100 mm in length, or more or less. In some embodiments, individual holders 202 may be differently sized, such that some holders include different numbers of magnetic subassemblies. According to such embodiments, shorter and/or lighter tools may be sufficiently coupled with holders having smaller numbers of magnetic subassemblies, e.g., one or two subassemblies, compared to longer and/or heavier tools, which may be paired with holders having a greater number of magnetic subassemblies, e.g., three, four, five, six, seven or more subassemblies. Generally, the greater the number of magnetic subassemblies exerting an upward pulling or attractive force on the tang of a tool, the greater the total force imposed on the tool, thus enabling holders having greater numbers of magnetic subassemblies to secure heavier tools.

Figure 4A:
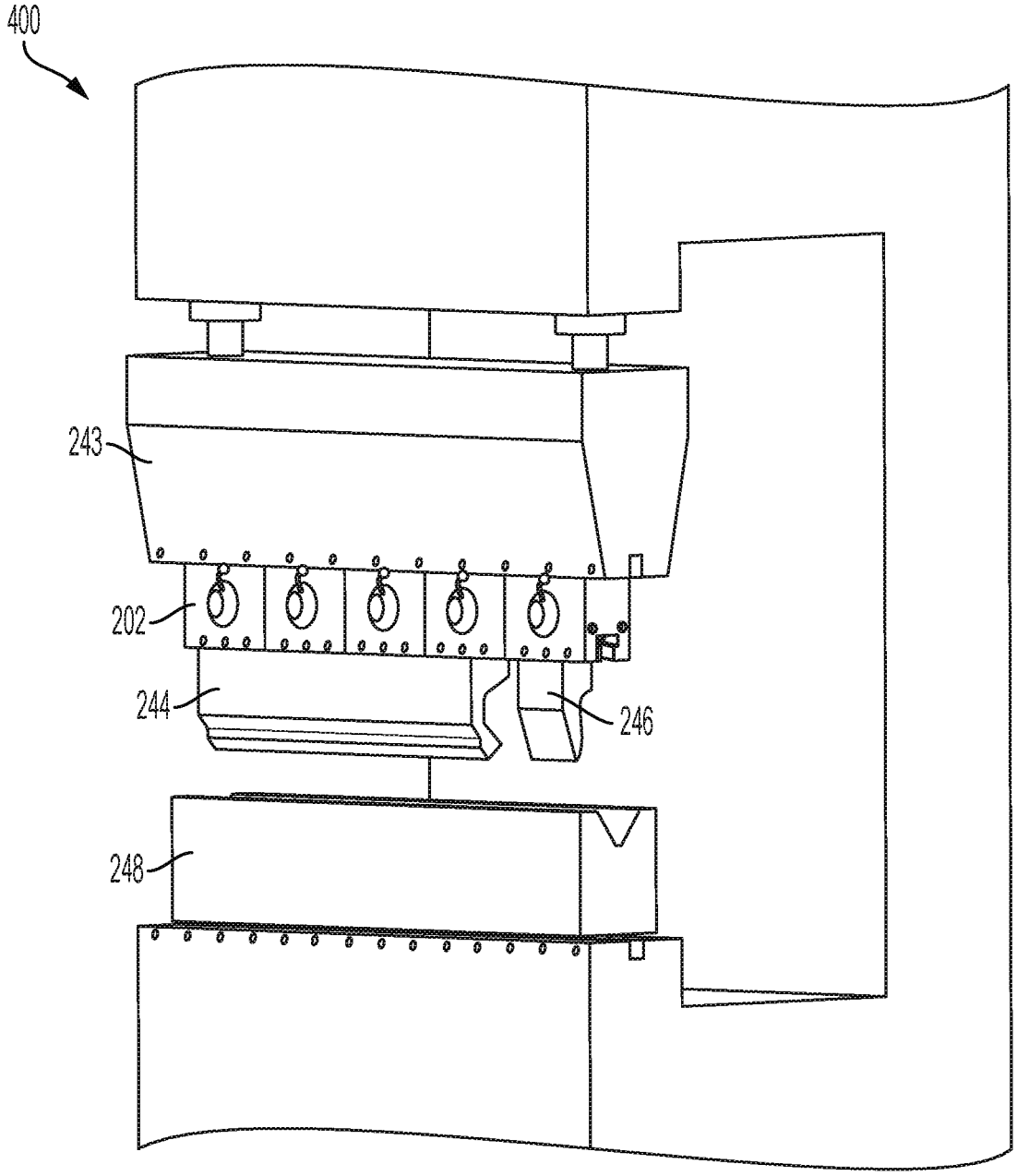
FIG. 4A is an isometric view of the machine tool holder assembly engaged with a plurality of press brake or punch components.

FIG. 4A is an isometric view of a plurality of multiple tool holders 202 arranged in a press brake or punch holder apparatus 400. Each holder 202 is coupled at a top end with an upper table 243. Several holders 202 are coupled with relatively larger tool component 244, and one holder 202 is coupled with a relatively smaller tool component 246. A machine die component 248 sits below the holders 202 and tool components 244, 246.

As shown in FIG. 4A, multiple holders 202 may accommodate a single machine tool component, especially where such a tool is heavy and/or elongate, such as tool 244. Even though each holder 202, individually, may be equal in maximum magnetic strength, the combination of multiple holders, collectively, may comprise greater maximum magnetic strength by inducing multiple magnetic circuits along the length of tool 244. By contrast, a single holder may be sufficient to accommodate lighter and/or smaller tools, such as tool 246. Because each holder 202 may be individually operable, tools 244 and 246 may be coupled to press apparatus 400 at different times without the need to rearrange either tool.

Figure 4B:
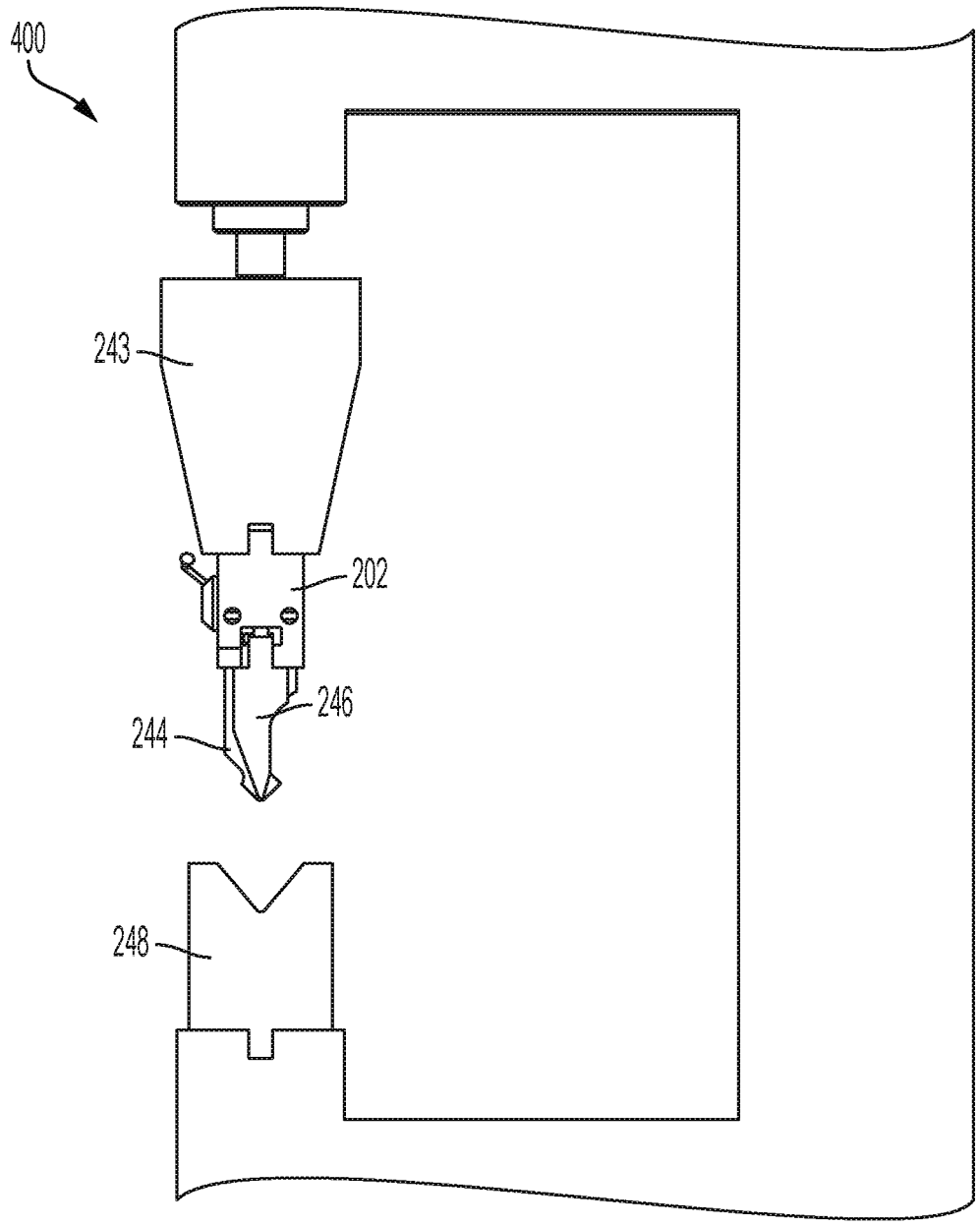
FIG. 4B is a side view of the machine tool holder assembly in FIG. 4A.

FIG. 4B is a side view of press apparatus 400, including tool holders 202 coupled with machine tooling components 244, 246. As shown, tools 244 and 246, despite their difference in length, may be equal in height, such that both tools may impress a workpiece overlaying die 248.

Press Brake, Punch and Die Tooling

Figure 5A:
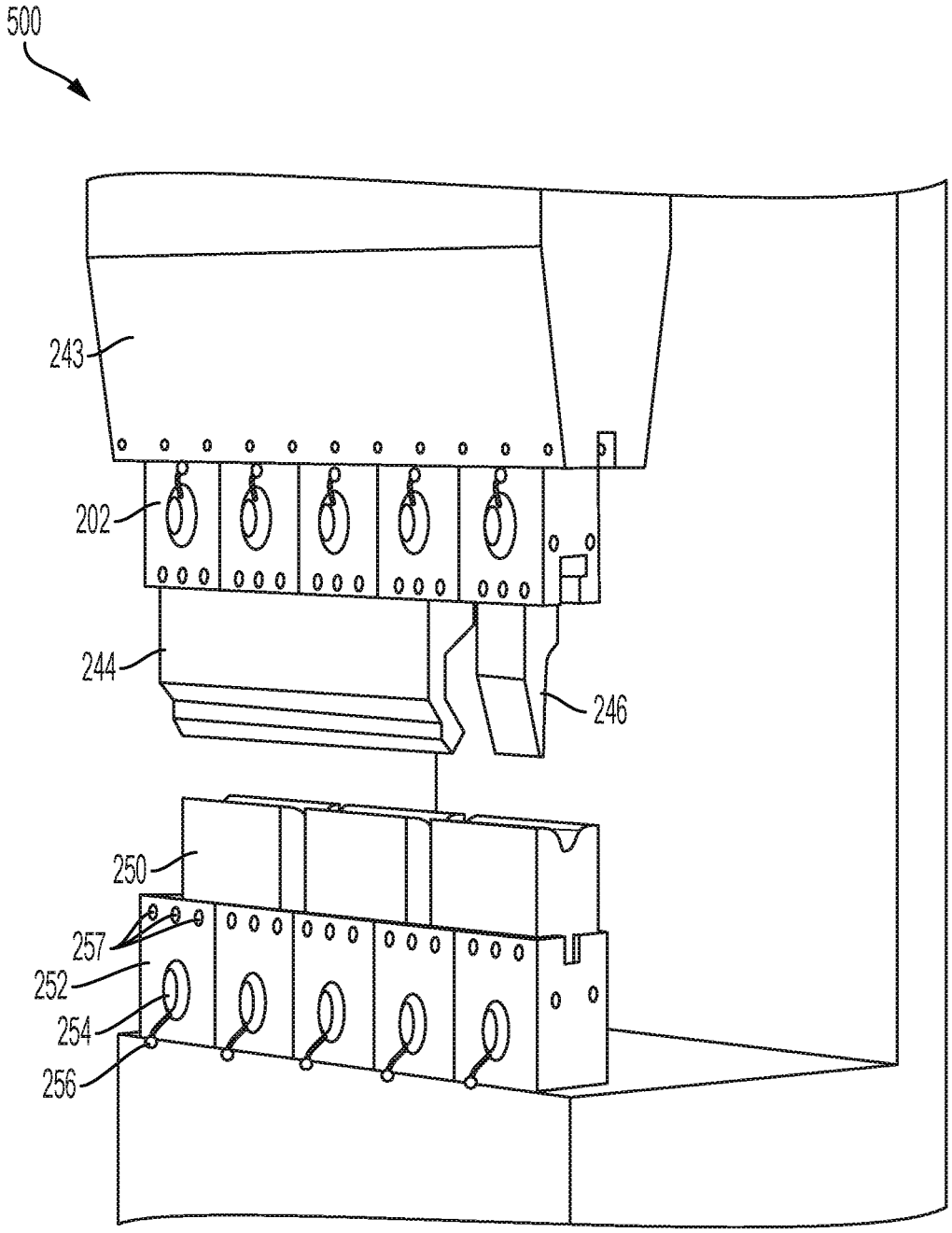
FIG. 5A is an isometric view showing a magnetic machine tool and die holder assembly engaged with a plurality of press brake or punch tool components.

FIG. 5A is an isometric view of a machine tool holder apparatus 500 with multiple magnetic tool holders 202 coupled with machine tool components 244, 246, and multiple magnetic dies 250 coupled with adjustable die holders 252. Each die holder 252 includes an actuator 254, which, similar to actuator 224 of holder 202, includes a knob or other mechanism 256 engageable by an operator, e.g., by manual operation or manipulation to selectively operate actuator 254. Multiple aperture fasteners 257 are defined by each die holder 252. To couple with dies 250, die holders 252 may apply a coupling mechanism analogous to that applied by holder 202. More specifically, each die holder 252 may be configured for selective engagement with one or more dies 250 by repositioning one or more internal magnetic elements configured to generate a magnetic flux coupling between the body of the die holder and the die.

Figure 5B:
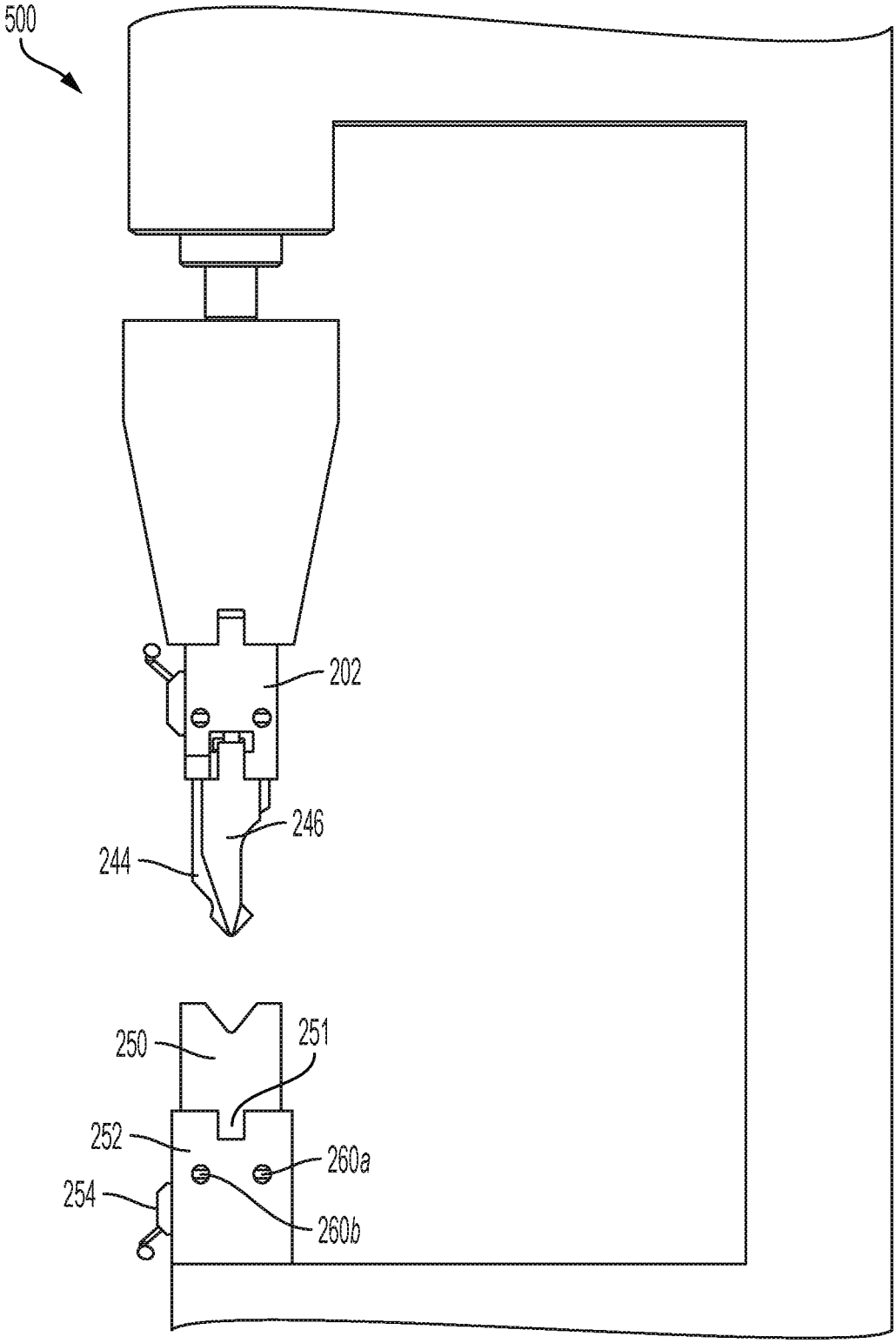
FIG. 5B is a side view of the magnetic machine tool and die holder assembly in FIG. 5A.

FIG. 5B is a side view of machine tool holder apparatus 500 with a plurality of tool holders 202 coupled with machine tool components 244, 246, and the magnetic die holders 252 coupled with the dies 250. As shown, slidable racks 260*a*, 260*b* may be partially exposed, each of which may include a plurality of alternately-oriented rack magnets (analogous to rack magnets 236*a/b*, 237*a/b* discussed above), which may be embedded within the racks. Actuator 254 may protrude laterally outward with respect to a front surface of die holder 252, and die 250 may define a die tang 251.

Figure 5C:
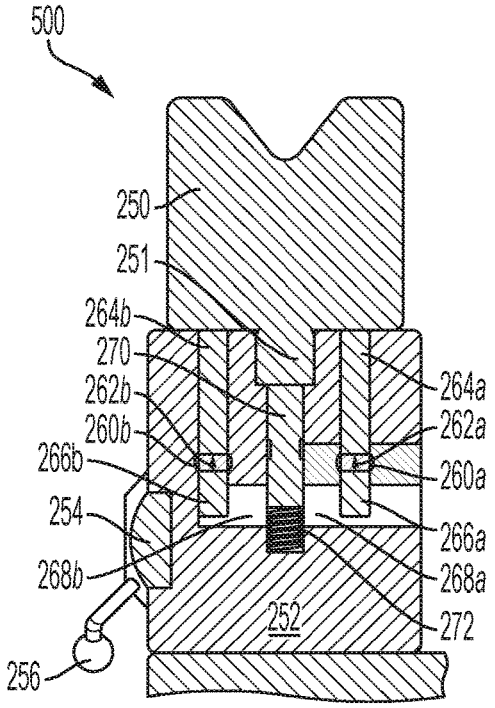
FIG. 5C is a section view of a magnetic die holder and die assembly, in an engaged configuration.

FIG. 5C is a section view of machine tool holder apparatus 500 with die holder 252 coupled with die 250 in an engaged configuration. Die holder 252 includes upper stator magnets 264*a*, 264*b* and lower stator magnets 266*a*, 266*b*. Between each lower and upper stator magnet, a portion of slidable rack 260*a*, 260*b* is visible. Ferromagnetic brushes 268*a*, 268*b* are positioned laterally between each lower stator magnet and a vertically-slidable center magnet 270. A center spring 272 is positioned below center magnet 270. The magnetic assembly shown in FIG. 5C is configured to induce parallel magnetic circuits of adjustable, e.g., switchable, magnetic strength for selectively engaging and disengaging die holder 252 with die 250 by exerting a reversible pulling force thereon or a reversible attractive force therebetween. Adjustments in magnetic strength may be caused via manipulation of actuator 254. In the locked, coupled or otherwise engaged state, when the magnetic strength is increased, the die holder 252 may hold die 250 in place for use in workpiece forming and/or folding operations. The downward force applied by die 250 may force center magnet 270 downward, thereby compressing spring 272. Because spring 272 is configured to compress in this manner, differently sized tangs 251 may be accommodated by die holder 252.

The magnetic components of die holder 252 may comprise a magnetic assembly configured to generate a magnetic flux coupling adapted for the selective engagement of the die holder body with die tang 251. In particular, the magnetic elements within die holder 252 may be magnetically oriented to generate a magnetic circuit in the engaged configuration shown. Each of the lower stator magnets 266*a*, 266*b* may be similarly oriented, for example such that its north pole is positioned above its south pole (and vice versa), and each of the upper stator magnets 264*a*, 264*b*, positioned directly above the lower stator magnets, may also be similarly oriented such that, for example, its north pole is oriented above its south pole. In various examples, the stator magnets may remain stationary or fixed within die holder 252, having a fixed magnetic orientation.

Likewise, rack magnets embedded within the slidable racks may also be oriented with the north pole facing up in the engaged configuration. Center magnet 270 may be magnetically oriented with its south pole facing up, e.g., in the reverse orientation relative to the stator magnets. When inserted into a receiving portion or cavity 258 defined by die holder 252, die tang 251 is positioned between each upper stator magnet 264*a*, 264*b* and above center magnet 270. As a result, a magnetic circuit may be established through the magnetic elements included in die holder 252. Parallel circuits may generate parallel magnetic fluxes that exert a downward magnetic force on die 250, thereby securely coupling die 250 with die holder 252 such that lateral movement, e.g., sliding, wobbling and/or shifting, of die 250 is prevented.

For instance, in the engaged configuration, a magnetic flux may pass vertically through upper stator magnet 264*a*, rack magnet 262*a* and lower stator magnet 266*a*, pass laterally through ferromagnetic brush 268*a*, and then proceed vertically through center magnet 270, eventually looping through at least a portion of die tang 251, which may be ferromagnetic, and back through upper stator magnet 264*a*. A similar magnetic circuit may be simultaneously established through lower stator magnet 266*b*, rack magnet 262*b*, upper stator magnet 264*b*, tang 251, center magnet 270 and ferromagnetic brush 268*b*. Thus, parallel magnetic circuits may be established in the configuration shown, collectively creating a magnetic force sufficient to couple die 250 with die holder 252.

Additional or alternative magnetic components may be included in die holder 252, for example including one or more electromagnets (for example as shown with respect to a tool holder in FIGS. 8A-8H), rotatable magnets (for example as shown with respect to a tool holder in FIGS. 9A-9M), and/or rotatable ferromagnetic components (for example as shown with respect to a tool holder in FIGS. 10A-10E), each configuration to modulate the magnetic flux coupling generated between the holder and the die. Alternative examples may include fixed, stationary magnets, e.g., non-switchable magnets within die holder 252, such that the body of the die holder has a receiving portion configured for engagement with a coupling end of a machine die. The magnetic coupling assembly of the die holder in such examples may thus include one or more magnetic elements configured to generate a magnetic coupling adapted for the engagement of the die holder body with the coupling end of machine die 250.

Such embodiments may be sufficient for coupling smaller dies, in particular, and may exert a magnetic flux coupling readily overcome by manual engagement. Non-switchable magnetic elements in such embodiments may include one or more permanent magnets and/or one or more ferromagnetic components. Example arrangements of such magnets are shown with respect to a tool holder in FIGS. 6A-6D and 12A-12D of this disclosure. In some examples, non-switchable magnets of a die holder may exert a constant magnetic coupling force such that one or more decoupling members, e.g., levers or pry bars, may be used to mechanically urge the die away from the body of the die holder to facilitate die removal, for example as shown by pry bars 1206 in FIGS. 12A-12D of this disclosure.

In some embodiments, one or more mechanical clamping mechanisms may be included in die holder 252. Such mechanical mechanisms may be implemented to provide additional clamping strength as necessary to retain a die 250. In some examples, a mechanical clamping mechanism may include one or more fasteners 257 acting in concert with a clamping bar configured to apply a lateral pressure against tang 251, similar to clamping bar 235.

Figure 5D:
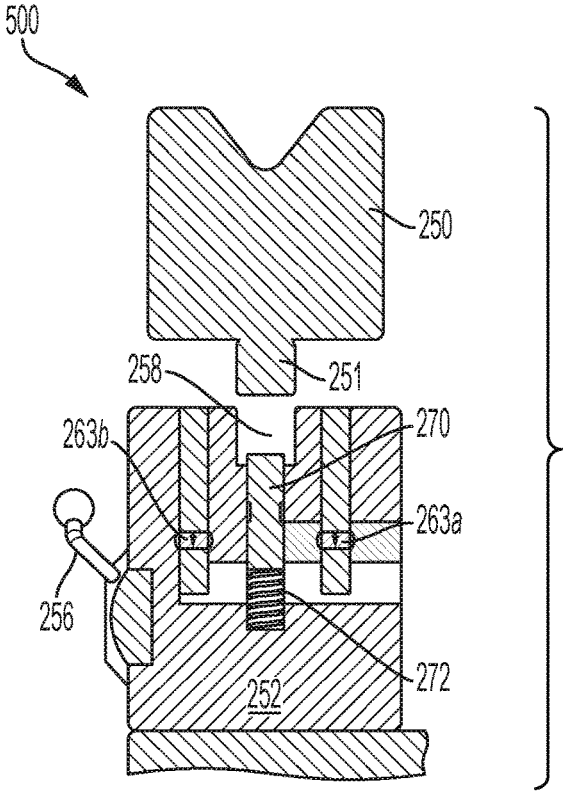
FIG. 5D is a section view of the magnetic die holder assembly, in a disengaged configuration.

FIG. 5D is a section view of machine tool holder apparatus 500 with die holder 252 and die 250 in a disengaged configuration. In the unclamped, unlocked or otherwise disengaged state, the magnetic circuits described above can be disrupted or at least weakened by longitudinal movement of sliding racks 260*a*, 260*b* through the die holder body such that rack magnets 263*a*, 263*b*, which are in the reverse magnetic orientation relative to the rack magnets 262*a*, 262*b*, are positioned between the upper and lower stator magnets. Upon weakening the magnetic circuit, die 250 may be installed or removed from die holder 252.

The slidable racks 260*a*, 260*b* may be moved via manual engagement with actuator 254, which thereby modulates the strength of the magnetic flux between the die holder and the die. As further shown, alleviation of the downward force applied by die 250 upon its removal may cause spring 272 to extend upward and center magnet 270 to move upward, protruding into receiving cavity 258. In some examples, the slidable racks may be responsive to the actuator, such that the locked and unlocked configurations of the die holder are bi-stable or non-momentary.

In some embodiments, one or more mechanical removal mechanisms may be included in die holder 252. Such mechanical removal mechanisms may be implemented for directly leveraging or pry die 250 away from die holder 252. Mechanical removal mechanisms may be necessary for overcoming particularly strong magnetic circuits, which may continue to retain die tang 251 within receiving cavity 258 even after switching to the disengaged state. In some examples, mechanical removal mechanisms may include one or more decoupling members, such as pry bars, similar to the pry bars shown in FIG. 11A.

Magnetic Clamping Mechanisms

Figure 6A:
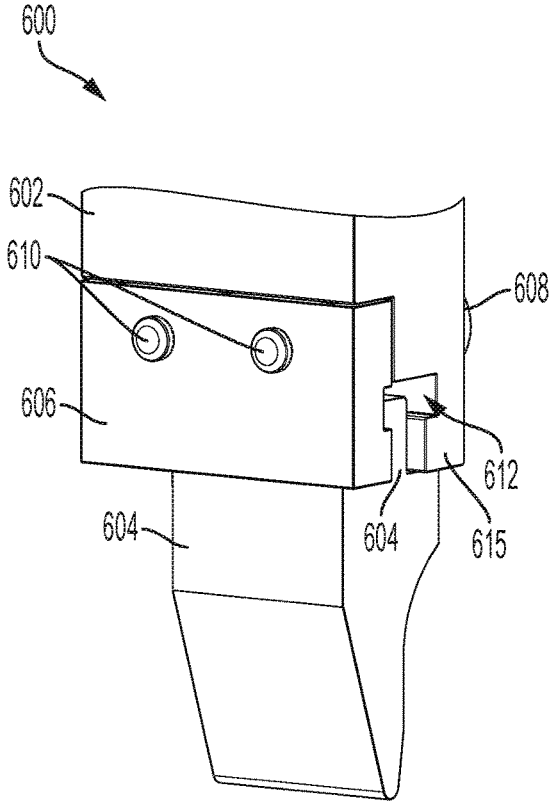
FIG. 6A is an isometric view of a machine tool holder and clamping assembly for a press brake or punch apparatus.

FIG. 6A is an isometric view of a machine tool holder and clamping assembly 600 with a tool holder 602 having a movable (mechanical) clamping bar 606 with magnetic components, which is selectively couplable with a machine tool or tool insert 604 for a press brake, punch or similar machine tool apparatus. Holder 602 includes a clamping mechanism 608, which may be electric or hydraulic, and comprises lateral caps 610. A receiving portion or cavity 612 configured to receive an upper portion or tang 614 of tool 604 is also defined by holder 602. Clamping bar 606 may provide a movable side of receiving cavity 612, opposite a stationary shoulder portion 615 of the holder.

Figure 6B:
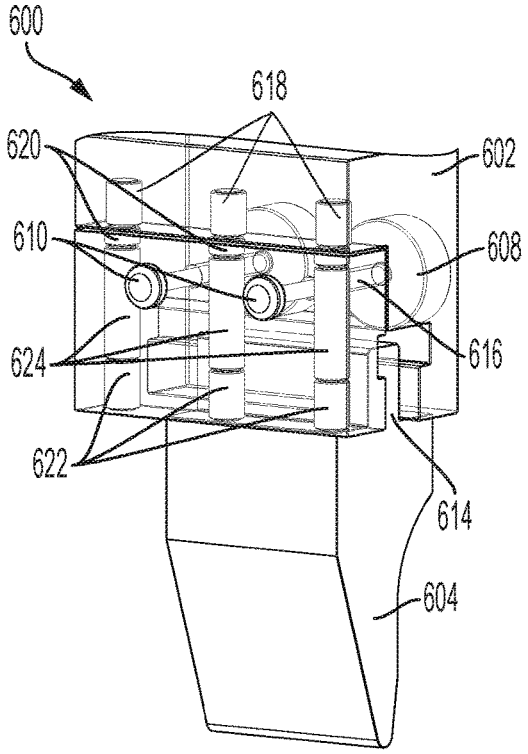
FIG. 6B is an isometric view of machine tool holder and clamping assembly in FIG. 6A, showing the internal configuration.

FIG. 6B is an isometric view of a machine tool assembly 600 with tool holder 602, showing the internal configuration of holder 602 and magnetic clamping bar 606. Clamping bar 606 includes arrays of magnetic elements that may induce a magnetic circuit with the magnetic elements included within the body of holder 602, thereby tightly securing clamping bar 606 against the body of holder 602 and preventing the clamping bar from drooping or dropping downward within receiving cavity 612.

To couple holder 602 with tool 604, mechanical clamping mechanism 608 may move clamping bar 606 in the lateral direction via extension or retraction of each axle 616 and thus each cap 610. When pulled tightly against the surface of tang 614, clamping bar 606 may secure tool 604 within receiving cavity 612. The magnetic circuit established between holder 602 and the vertical arrays of magnetic elements within clamping bar 606 can minimize or eliminate air gaps between tool 604, clamping bar 606 and holder 602, which may enhance the coupling strength between holder 602 and tool 604. In some embodiments, the magnetic circuit created between the magnetic elements of clamping bar 606 and holder 602 may be sufficient in magnetic strength to at least temporarily coupled tool 604 with holder 602.

In the particular arrangement shown, the body of holder 602 includes three holder magnets 618 positioned proximate to three vertical arrays of magnetic elements positioned within clamping bar 606. Each array includes an upper clamp magnet 620, a lower clamp magnet 622, and a high-permeability insert 624. To propagate a magnetic flux between the holder magnets and the magnetic components of the clamping bar, adjacent components may be arranged in alternating fashion, e.g., north-up, then south-up, north-up, then south-up, etc. In some examples, this configuration of magnetic components may be non-switchable, such that clamping bar 606 is consistently prevented from hanging loosely or dropping by maintaining a magnetic circuit with holder 602, thereby positioning clamping bar 606 to effectively couple tool 604 with holder 602.

The arrangement of magnetic components in clamping bar 606 and holder 602 may vary in different embodiments. Example configurations may include magnetic components, e.g., permanent magnets or ferromagnetic inserts, installed only in a top portion of the clamping bar, e.g., upper clamp magnets 620. Some embodiments may comprise one or more magnetic components, e.g., permanent magnets or ferromagnetic inserts, installed only in a bottom portion of clamping bar 235, e.g., lower clamp magnets 622. In some examples, holder magnet 618 may be supplemented or replaced by one or more ferromagnetic inserts. One or more electromagnets may also be included within clamping bar 606 and/or holder 602.

The vertical arrays of magnetic components within clamping bar 606 may be configured as cylindrical island assemblies within non-ferromagnetic isolating tubes, as rectangular block assemblies having flat isolating shims, or as solid magnets installed directly into the clamping bar and/or the body of the holder. Direct installation of one or more magnets may be more cost-efficient to manufacture. The clamping bar may comprise a ferromagnetic material or a non-ferromagnetic material.

Figure 6C:
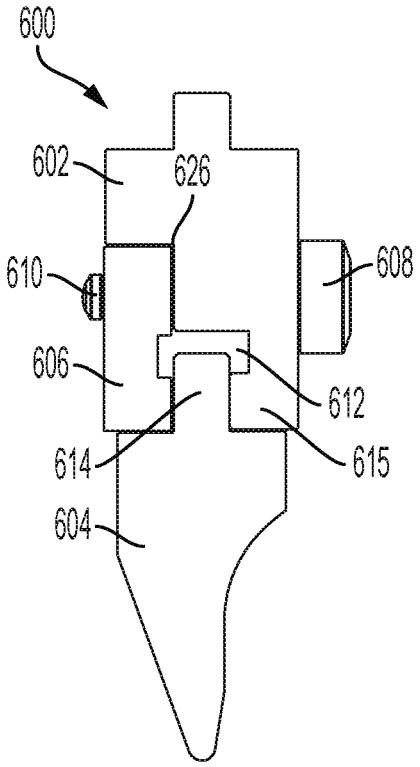
FIG. 6C is a side view of the machine tool holder and clamping assembly engaged with a machine tool component.

FIG. 6C is a side view of a machine tool assembly 600 with holder 602 and clamping bar 606 coupled with tool 604. Receiving cavity 612 is shown, with clamping bar 606 in an engaged configuration. Clamping mechanism 608, along with the magnetic circuit established between holder 602 and clamping bar 606, pulls the clamping bar into place, flush against the surfaces of tool 604 and tang 614. A narrow air gap 626 may exist, even in the engaged configuration, between the inner surfaces of clamping bar 606 and the body of holder 602.

Figure 6D:
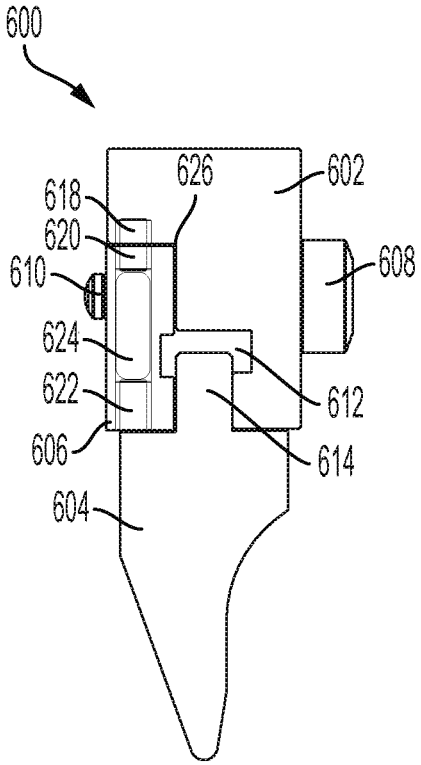
FIG. 6D is a section view of the machine tool holder and clamping assembly engaged with the machine tool component.

FIG. 6D is a section view of a machine tool assembly 600 with holder 602 and clamping bar 606 coupled with tool 604 in the engaged configuration. The magnetic circuit may be established through holder magnet 618, upper clamp magnet 620, insert 624, and lower clamp magnet 622. Tool 604 may be ferromagnetic, thus contributing to the circuit.

Figure 7A:
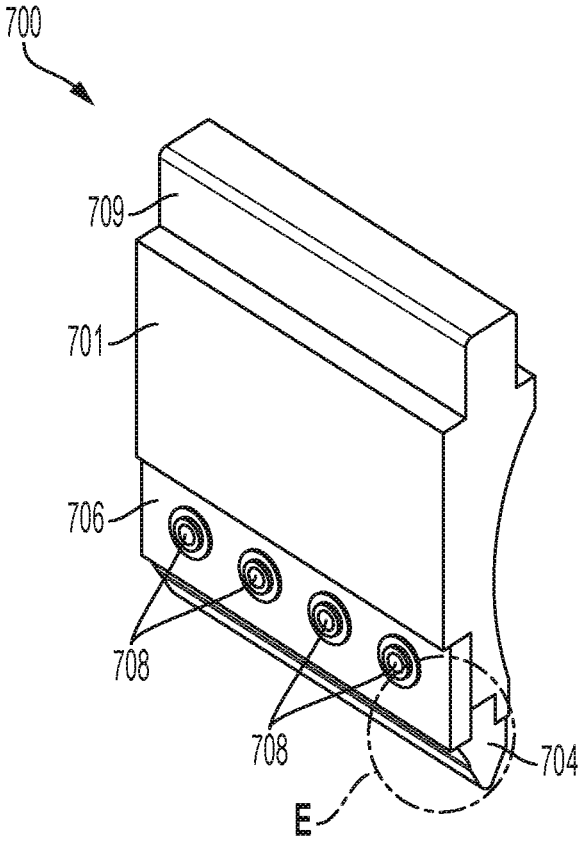
FIG. 7A is an isometric view of a magnetic adapter assembly engaged with a punch or press tool insert for a press brake apparatus.

FIG. 7A is an isometric view of a magnetic adapter assembly 700 including a press brake or punch tool body 701 coupled with an insert 704 for a machine tool apparatus. Insert 704 includes the working end of the press brake or punch tool component, and is coupled to tool body 701, e.g., via a magnetic clamping bar or similar magnetic coupling member 706, forming a magnetically engaged tool holder apparatus for insert 704. The adapter assembly includes a magnetic clamping bar 706 and, in the example shown, a plurality of fasteners 708. Adapter assembly 700 defines an upper portion or adapter tang 709 configured for installation and removal with respect to a tool holder, such as holder 202. The adapter assembly may allow particularly small tools, such as punch insert 704, to be coupled with standard-sized tool holders, e.g., holder 202.

Figure 7B:
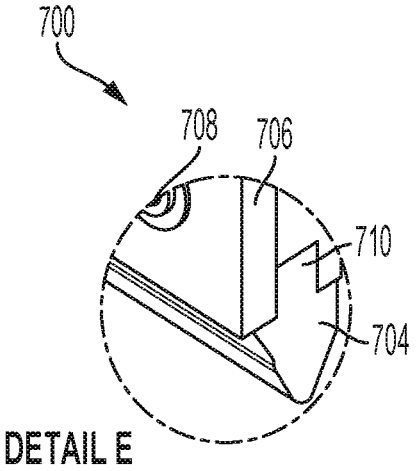
FIG. 7B is a detail view of the adapter assembly, taken at detail E of FIG. 7A.

FIG. 7B is a detail view of the adapter assembly 700 and punch tool or tool insert 704, taken at detail E of FIG. 7A. As shown, punch insert 704 may comprise an upper portion or tang 710 configured to couple with a receiving portion or cavity in a tool holder apparatus defined by the combination of tool body 701 and magnetic clamping bar 706. Clamping bar 706 is configured to selectively engage with punch insert 704 upon manipulation of one or more internal magnetic components and in some embodiments, concurrent tightening of one or more fasteners 708.

Figure 7C:
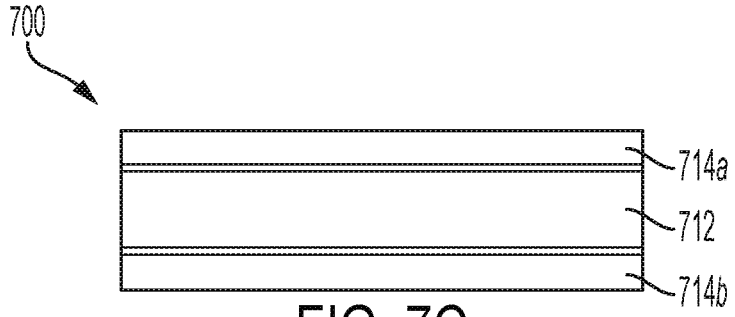
FIG. 7C is a top view of the adapter assembly holding the punch or press tool insert.

FIG. 7C is a top view of the adapter assembly 700, showing a top surface 712 of adapter tang 709 and two shoulder portions 714*a*, 714*b* of tool body 701, which extend laterally outward with respect to tang 709.

Figure 7D:
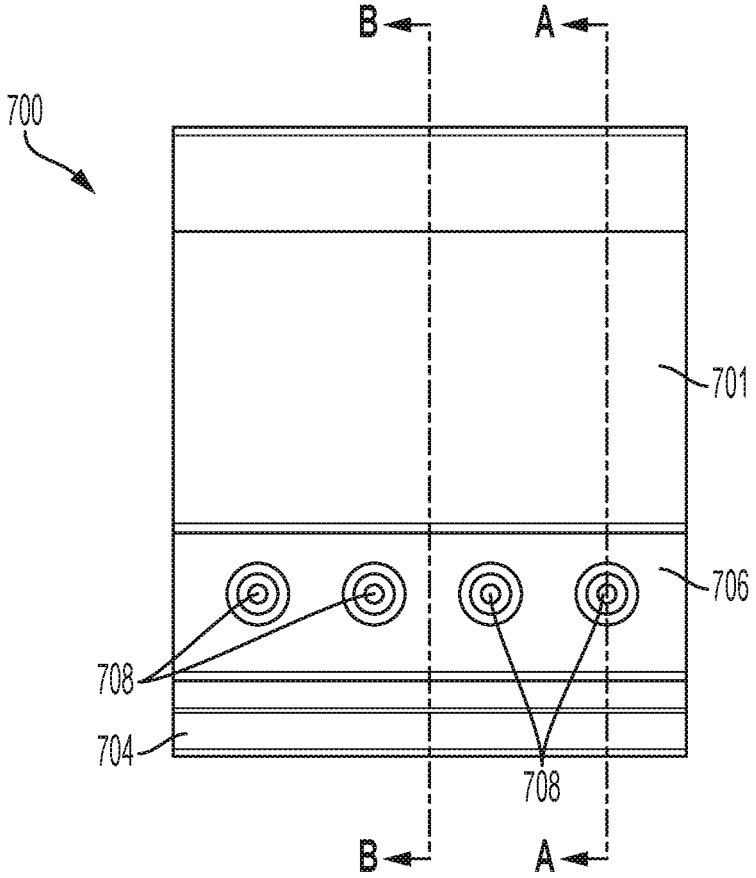
FIG. 7D is a front view of the adapter assembly holding the punch or press tool insert.

FIG. 7D is a front view of adapter assembly 700 with tool body 701 coupled with punch tool insert 704, showing fasteners 708. The number of fasteners, if included in the adapter assembly, may vary. In embodiments, the number of fasteners may range from 0 to about 5, 0 to about 10, 0 to about 15, 0 to about 20, or any suitable range therebetween, depending on the size of clamping bar 706 and/or the weight of punch insert 704.

Figure 7E:
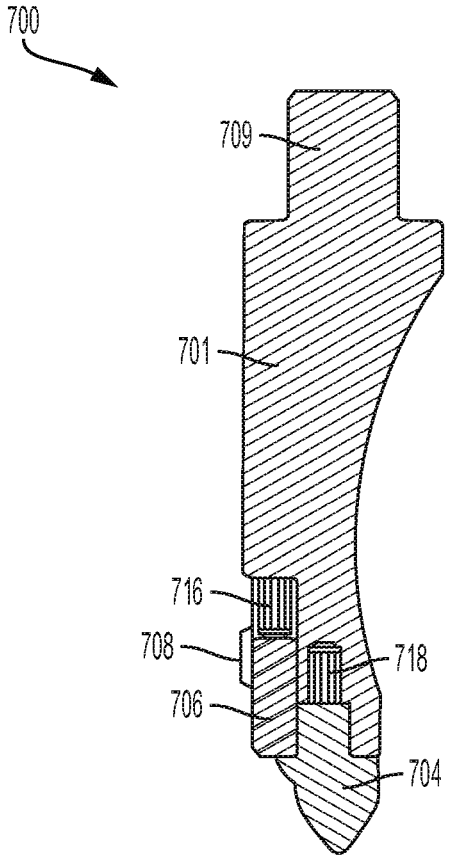
FIG. 7E is a section view of the adapter assembly and punch or press tool insert in FIG. 7A, taken along line B-B of FIG. 7D.

FIG. 7E is a section view of adapter assembly 700, with clamping bar 706 and punch insert 704, taken along line B-B of FIG. 7D. Clamping bar 706 includes a clamp magnet 716 and tool body 701 includes adapter magnet 718. The magnetic poles of clamp magnet 716 and adapter magnet 718 may be oriented reversely relative to each other, to induce a magnetic circuit through punch insert 704, thereby coupling the tool with tool body 701 of adapter assembly 700.

Figure 7F:
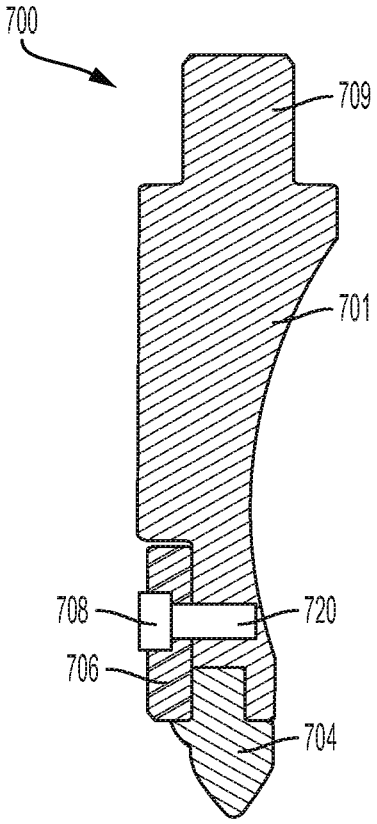
FIG. 7F is a section view of the adapter assembly and punch or press tool insert in FIG. 7A, taken along line A-A of FIG. 7D.

FIG. 7F is a section view of adapter assembly 700, clamping bar 706 and punch insert 704, taken along line A-A of FIG. 7D. An elongate portion 720 of fastener 708 protrudes through clamping bar 706 and tool body 701 in this example. By tightening fastener 708 in a lateral direction, clamping bar 706 may be moved laterally toward tool body 701, thereby clamping punch insert 704 within the receiving cavity defined by the tool body 701 and clamping bar 706. Thus, adapter assembly 700 forms a holder for tool insert 704. In some examples, the strength of the magnetic circuit induced through punch insert 704 via one or both of clamp magnet 716 and adapter magnet 718 may be sufficient to at least temporarily couple punch insert 704 with tool body 701, rendering the physical coupling provided by one or more fasteners unnecessary.

Electromagnetic Flux Generation

Figure 8A:
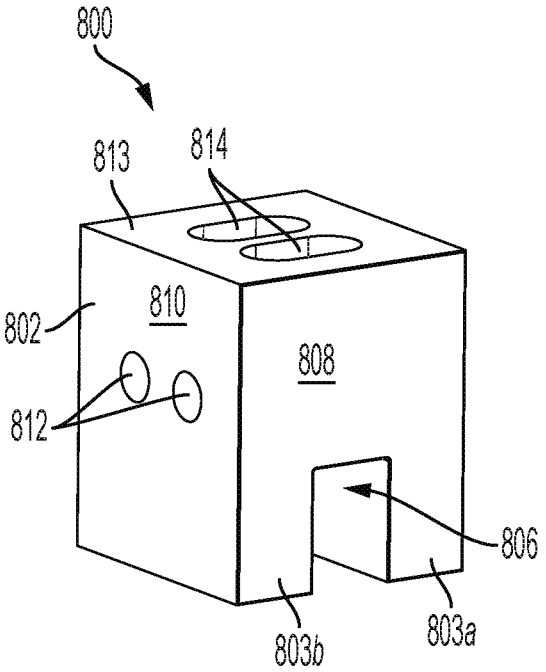
FIG. 8A is an isometric view of a machine tool holder with an electromagnetic engagement system for press brake or punch tooling.

FIG. 8A is an isometric view of a magnetically engaged machine tool holder system 800 with machine tool holder 802 for a press brake, punch or similar machine tool apparatus. Holder 802 includes two shoulder portions 803*a*, 803*b*, which define the lateral surfaces of a receiving portion or cavity 806 configured to receive a tool. Holder 802 includes a side surface 808 and a front surface 810, the front surface defining two laterally disposed apertures 812. A top surface 813 defines two vertically disposed apertures 814. In embodiments, the shape of holder 802 may vary. Holder 802 is configured to selectively couple with a tool via electromagnetic modulation.

Figure 8B:
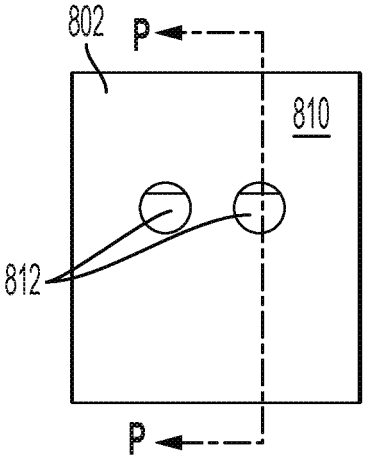
FIG. 8B a front view of the machine tool holder in FIG. 8A.

FIG. 8B is a front view of holder 802, showing front apertures 812. In embodiments, the number of apertures defined by the front surface may vary, ranging from 0 to about 10, depending on the number and/or arrangement of internal magnetic components in the holder.

Figure 8C:
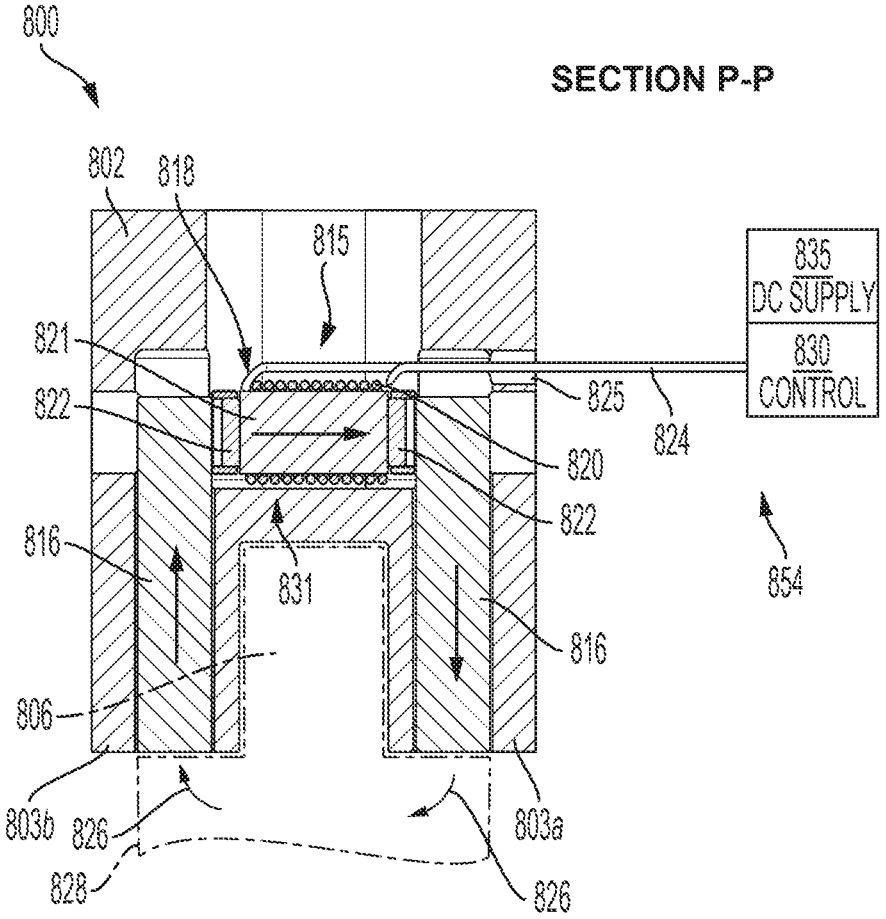
FIG. 8C is a section view of the tool holder system, taken along line P-P of FIG. 8B.

FIG. 8C is a section view of machine tool system 800 and tool holder 802, taken along line P-P of FIG. 8B. FIG. 8C depicts numerous magnetic components that may contribute to the adjustable magnetic coupling mechanism of holder 802. In particular, holder 802 includes a pair of ferromagnetic shoulder rods 816, one rod positioned within each shoulder portion 803*a*, 803*b*. The shoulder rods 816 may each be cylindrical and may have an elongate body portion, extending vertically from a bottom surface of each shoulder 803*a*, 803*b* to a position approximately in line with at least one electromagnet 818, which may include a solenoid 820 comprised of coils wrapped around a ferromagnetic core 821. Laterally-disposed ferromagnetic inserts 822 may be positioned proximate to electromagnet 818, and at least one solenoid lead 824 may extend laterally through a control aperture 825 defined by holder 802.

In operation, the magnetic components of holder 802 may induce a magnetic circuit 826 (represented by the arrows). Selective activation of electromagnet 818 modulates the strength of the magnetic flux coupling between holder 802 and a tool 828 inserted into receiving cavity 806. Electromagnet activation may switch the holder into an engaged state in which tool 828 is reversibly coupled with the holder. Electromagnetic deactivation may switch the holder into disengaged or unlocked state, which allows for the installation or removal of tool 828. The ferromagnetic components of the circuit, e.g., shoulder rods 816 and inserts 822, may concentrate the magnetic circuit such that the magnetic flux is in the direction of the arrows representing magnetic circuit 826.

To selectively adjust the magnetic flux coupling between holder 802 and tool 828, the solenoid lead 824 may be electrically coupled with an electronic controller 830, which may thus provide an actuator 854 for the magnetic flux coupling. For example, electrical voltage supplied by controller 830 may enter solenoid 820 via solenoid lead 824, thereby activating electromagnet 818 and inducing magnetic circuit 826. In some embodiments, controller 830 may include or be at least communicatively coupled with one or more sensors 831 configured to detect the presence or absence of tool 828 within receiving cavity 806. Based on this detection, sensor 831 can provide feedback signaling to controller 830. The magnetic coupling assembly 815 of the die holder 802 may thus include one or more magnetic elements configured to generate a magnetic coupling adapted for engagement of the die holder body with the coupling end of a machine die.

For instance, in response to detecting at least a portion of tool 828, e.g., a tang, within receiving cavity 806, sensor 831 can transmit a signal to controller 830 prompting the controller to activate magnetic flux coupling via electromagnet 818. Likewise, in response to detecting no or zero tool components within receiving cavity 806 (or the absence thereof), sensor 831 may transmit a signal to controller 830 prompting the controller to deactivate magnetic flux coupling via electromagnet 818 by reducing or cutting off a voltage supply.

In some embodiments, controller 830 may adjust the magnetic strength of holder 802 by increasing, decreasing, or maintaining the voltage transmitted to the electromagnet, thus providing an adjustment mechanism for altering the maximum strength of the holder as necessary to accommodate machine tools of varying weights. The position of sensor 831 may vary and is not limited to the example position shown. In some embodiments, the electromagnet may be responsive to the electronic controller, such that the locked and unlocked configurations of the holder are bistable or non-momentary.

In some examples, a high frequency signal is superimposed on a DC supply 835 to the electromagnet(s), reacting with the inductance of the solenoid coils of the electromagnet(s), the amplitude of which can be assessed or demodulated. Since the magnetic circuit through the electromagnet (s) is effectively part of the flux coupling core of said electromagnet(s), and the magnetic circuit passes through the tool, when present, the presence or absence, or even proximity of a tool within the holder, will change the inductance of said electromagnet(s) and thus attenuate the high frequency signal and so could be measurable by the electronic controller with A to D conversion and programming. The data measured by the controller may then be used to present an indication of the presence or proper seating of the tool within the holder, or even to increase the DC voltage, thereby increasing the magnetic strength of the holder to maintain secure seating of the tool within the holder, or for an intermediate holding force such as to facilitate hand movement of the tool(s) coupled with the holder, which may be useful for staging or alignment of tools together for a particular function.

Figure 8D:
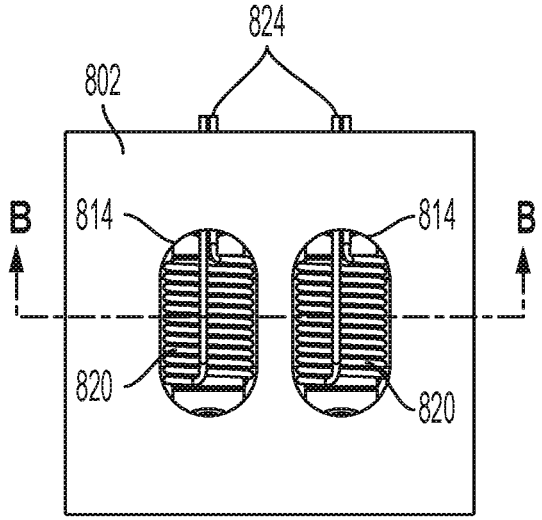
FIG. 8D is a top view of the tool holder.

FIG. 8D is a top view of holder 802. Through apertures 814, solenoids 820 are visible, each solenoid disposed horizontally within holder 802. A portion of each lead 824 is also shown protruding beyond the body of holder 802. As shown, solenoids 820 may be approximately parallel.

Figure 8E:
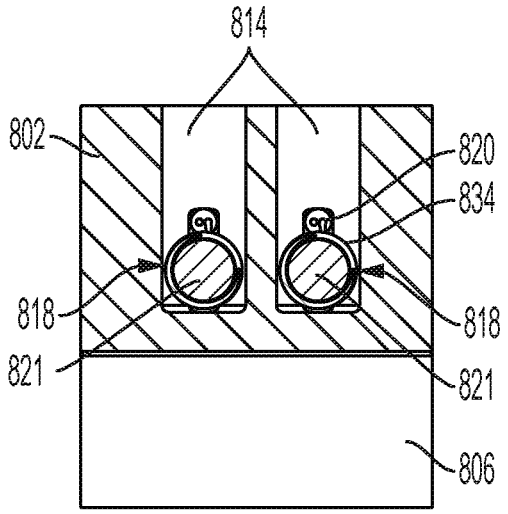
FIG. 8E is a section view of the tool holder, taken along line B-B of FIG. 8D.

FIG. 8E is a section view of holder 802, taken along line B-B of FIG. 8D. Each electromagnet core 821 is shown encapsulated by a solenoid 820. Each vertical aperture 814 may extend downward into holder 802. In some examples, each electromagnet 818 may be affixed, e.g., glued, into place within holder 802 and/or cast into pockets of the holder by a thermally conductive potting compound 834. The body, or frame, of holder 802 may comprise various materials. In some examples, the body of holder 802 may include austenitic stainless steel. The material comprising holder 802 may be slightly ferromagnetic or non-ferromagnetic in various embodiments.

Figure 8F:
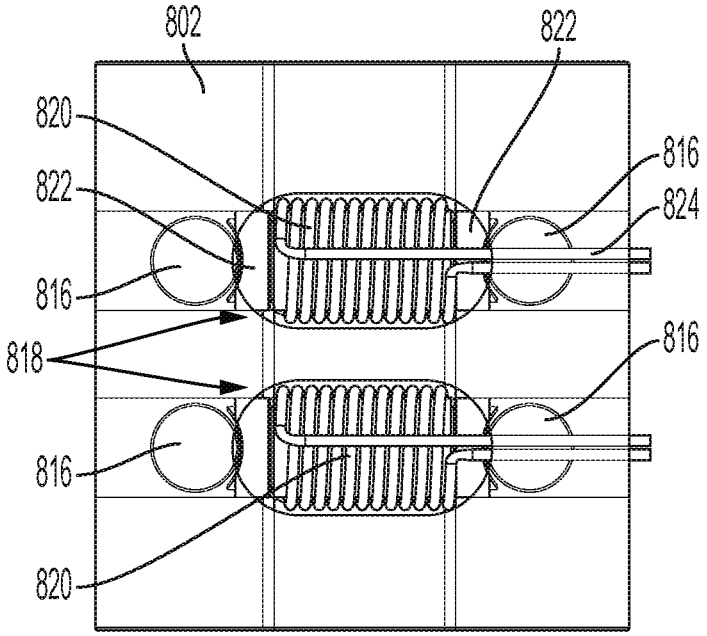
FIG. 8F is a top view of the tool holder, showing the internal magnetic assembly.

FIG. 8F is a top view of holder 802, showing the internal configuration of several magnetic components embedded therein, including a pair of electromagnets 818, each comprising a coiled solenoid 820 positioned between a pair of laterally-oriented ferromagnetic inserts 822. The ends of vertically-oriented ferromagnetic rods 816 included in the shoulders of holder 802 appear circular due to their cylindrical shape in the embodiment shown.

Figure 8G:
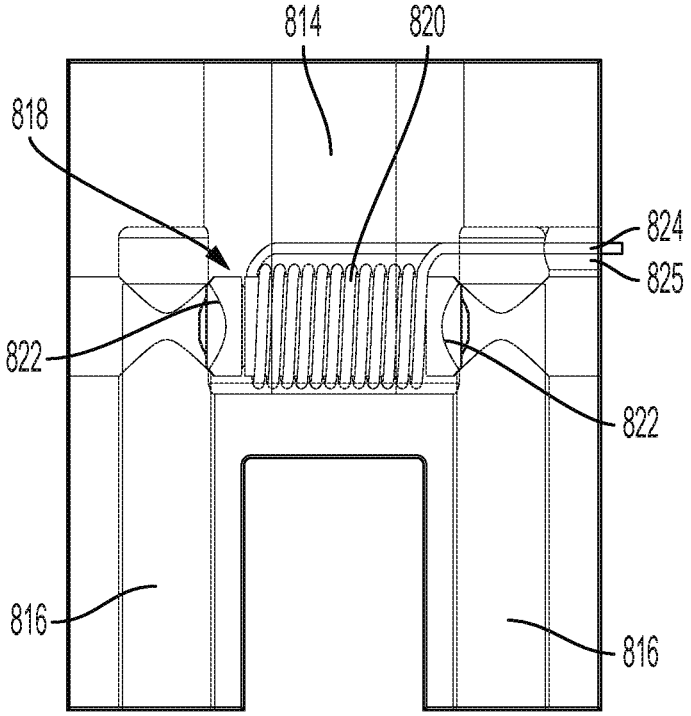
FIG. 8G is a side view of the tool holder, showing the internal magnetic assembly.

FIG. 8G is side view of holder 802, showing the internal configuration of the magnetic components depicted in FIG. 8F. Rods 816 are shown, extending vertically downward away from electromagnet 818 and inserts 822. Controller aperture 825 is also shown, with leads 824 extending therethrough. In some embodiments, rods 816 may be permanent magnets, such that the solenoid coils can be energized to oppose the permanent magnets, thereby engaging the magnetic coupling mechanism without supplying energy to the coils. Examples may include one or more permanent magnets in addition to or instead of rods 816 to generate a magnetic circuit.

Figure 8H:
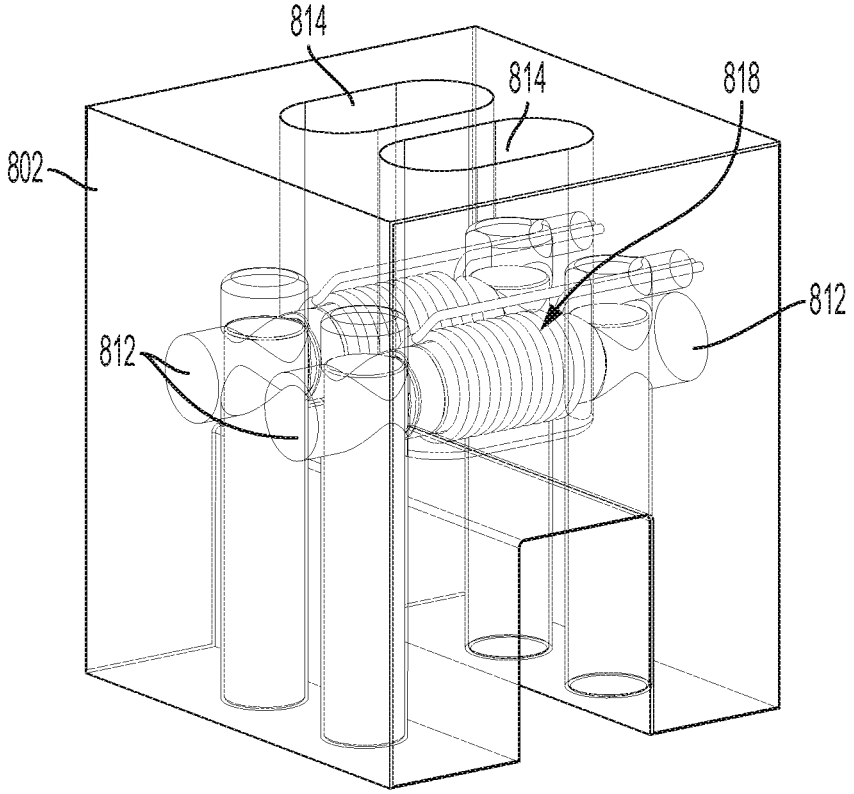
FIG. 8H is an isometric view of the tool holder, showing the internal magnetic assembly.

FIG. 8H is an isometric view of holder 802, showing the internal configuration of the magnetic components depicted in FIG. 8F. Lateral apertures 812 extend through a portion of the body of the holder, forming cylindrical cavities along the longitudinal axis of electromagnet 818. More generally, either permanent magnet or electromagnet flux generation can be applied to any of the magnetically engaged machine tool application described herein.

Rotary and Lateral Magnetic Engagement

Figure 9A:
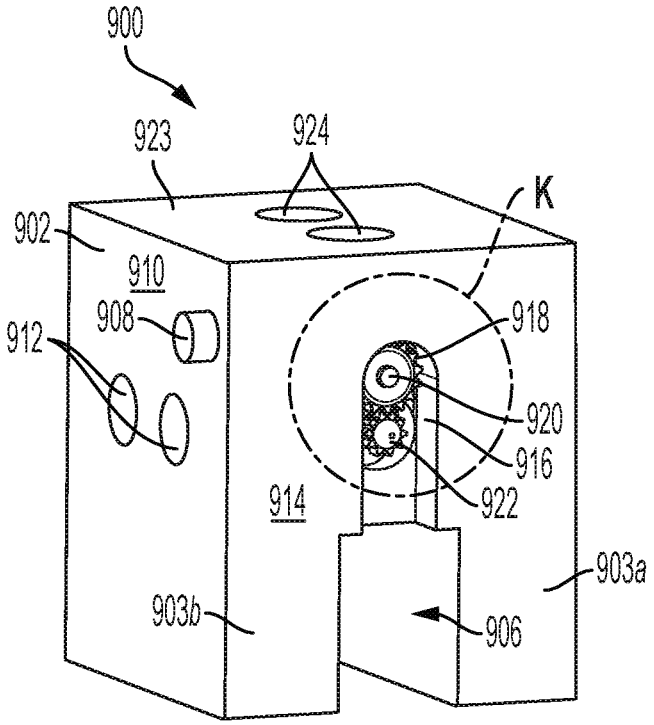
FIG. 9A is an isometric view of a machine tool holder apparatus having a rotatable magnetic engagement system for press brake or punch tooling.

FIG. 9A is an isometric view of a machine tool apparatus 900 with magnetic tool holder 902 for a press brake, punch, or similar machine tool apparatus. Holder 902 defines two shoulder portions 903*a*, 903*b* and receiving portion or cavity 906, which may receive an upper portion or tang of a tool. Holder 902 further includes a slidable pin 908, which at least in a first, engaged position, may protrude laterally outward from front surface 910, which defines two apertures 912 that extend laterally within holder 902.

At a side surface 914, holder 902 defines a gear window 916. Within gear window 916, the holder includes a rotatable pinion 918 configured to engage with pin 908 such that together, the two components comprise a rack and pinion assembly, the slidable pin functioning as the rack. An idler 920 centrally disposed within pinion 918 couples the pinion to the holder. A gear member 922 is positioned proximate to pinion 918, where it may rotatably engage the pinion upon lateral movement of pin 908. Defined in a top surface 923 of holder 902 are vertical apertures 924. Holder 902 is configured for selective engagement and disengagement of a tool, e.g., a punch, upon manipulation of one or more magnetic components included in the holder.

Figure 9B:
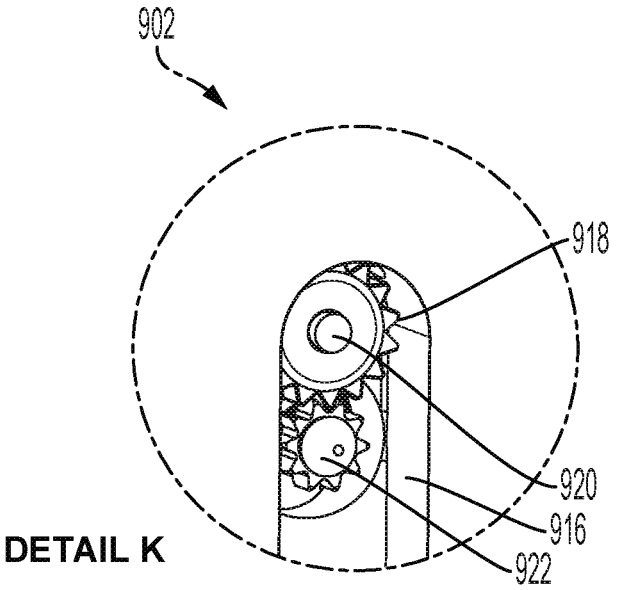
FIG. 9B is a detail view of the machine tool holder, taken at detail K of FIG. 9A.

FIG. 9B is a detail view of holder 902, taken at detail K of FIG. 9A. FIG. 9B provides a magnified view of gear window 916, showing idler 920 mounted within a central portion of pinion 918. Gear member 922, positioned below pinion 918 in the example shown, rotates upon rotation of the pinion.

Figure 9C:
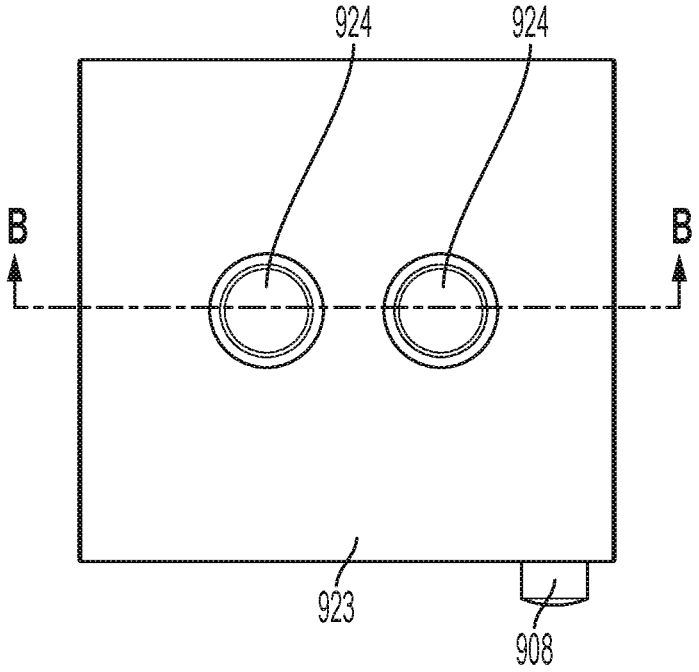
FIG. 9C is a top view of the machine tool holder, in an engaged configuration.

FIG. 9C is a top view of holder 902 in an engaged or locked configuration, showing the openings to vertical apertures 924 within top surface 923, and pin 908 protruding from a side of the holder. As shown, vertical apertures 924 may be approximately circular and equally sized, positioned near the center of top surface 923.

Figure 9D:
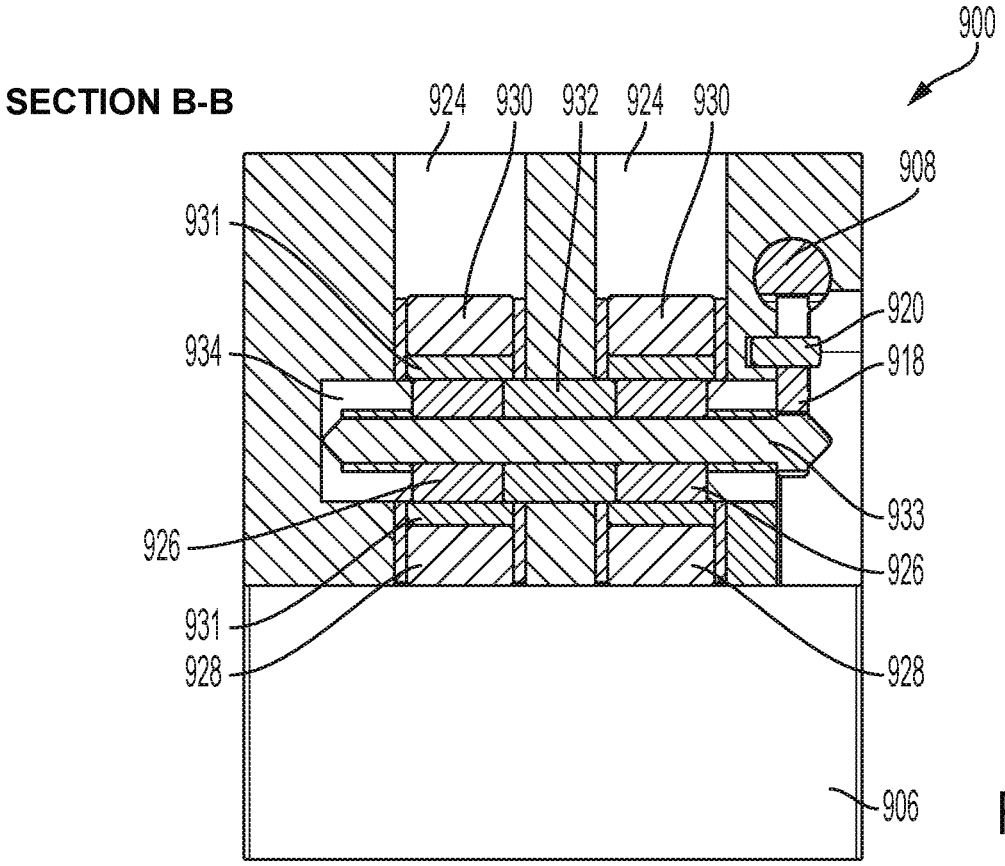
FIG. 9D is a section view of the holder apparatus, taken along line B-B of FIG. 9C.

FIG. 9D is a section view of machine tool holder apparatus 900 and tool holder 902, taken along line B-B of FIG. 9C. The internal magnetic components of holder 902 are shown, including two rotatable magnets 926, two fixed lower magnets 928, two fixed upper magnets 930, and ferromagnetic inserts 931. A cylindrical rotatable insert 932 is shown between rotatable magnets 926. As further shown, an axle 933 coupled with gear member 922 may extend laterally through an internal cavity 934 defined by holder 902, mounting each rotatable magnet 926 and rotatable insert 932. A cross-section of pin 908 is also shown, along with pinion 918 and idler 920.

In operation, lateral sliding of pin 908 (e.g., into and out of the page) can cause pinion 918, and thus gear member 922, to rotate. Consequently, axle 933, which may be coupled, fixed, or formed integrally with gear member 922, also rotates. Rotation of axle 933 causes rotation of rotatable magnets 926 and rotatable insert 932 attached thereto. Rotation of rotatable magnets 926 modulates the magnetic alignment of the rotatable magnets with lower magnets 928 and upper magnets 930.

As shown in the configuration of FIG. 9D, rotatable magnets 926 may have identical magnetic orientations, which relative to each other, may remain the same. The rotatable magnets may each be quadrupolar, each comprising two opposing north poles and two opposing south poles. In the configuration shown, each rotatable magnet 926 is oriented such that its north poles are vertically aligned. By contrast, lower magnets 928 and upper magnets 930, which may be dipolar, are each oriented such that a south pole is positioned above a north pole, thereby aligning the north poles of the rotatable magnets with the south poles of the fixed magnets.

This particular arrangement may induce a magnetic circuit that loops through holder 902 and receiving cavity 906. The circuit may induce a magnetic flux coupling adapted for the selective engagement of holder 902 with the coupling end of a machine tool. Ferromagnetic inserts 931, positioned between the rotatable magnets and each set of upper and lower magnets, may concentrate the magnetic circuit through the tool coupled with holder 902.

Figure 9E:
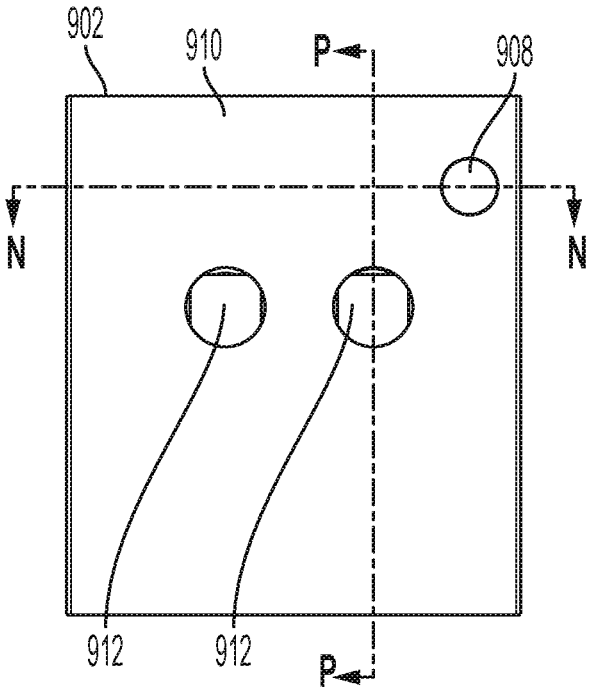
FIG. 9E is a front view of the machine tool holder.

FIG. 9E is a front view of holder 902, showing front face 910. Lateral apertures 912 are shown, along with pin 908.

Figure 9F:
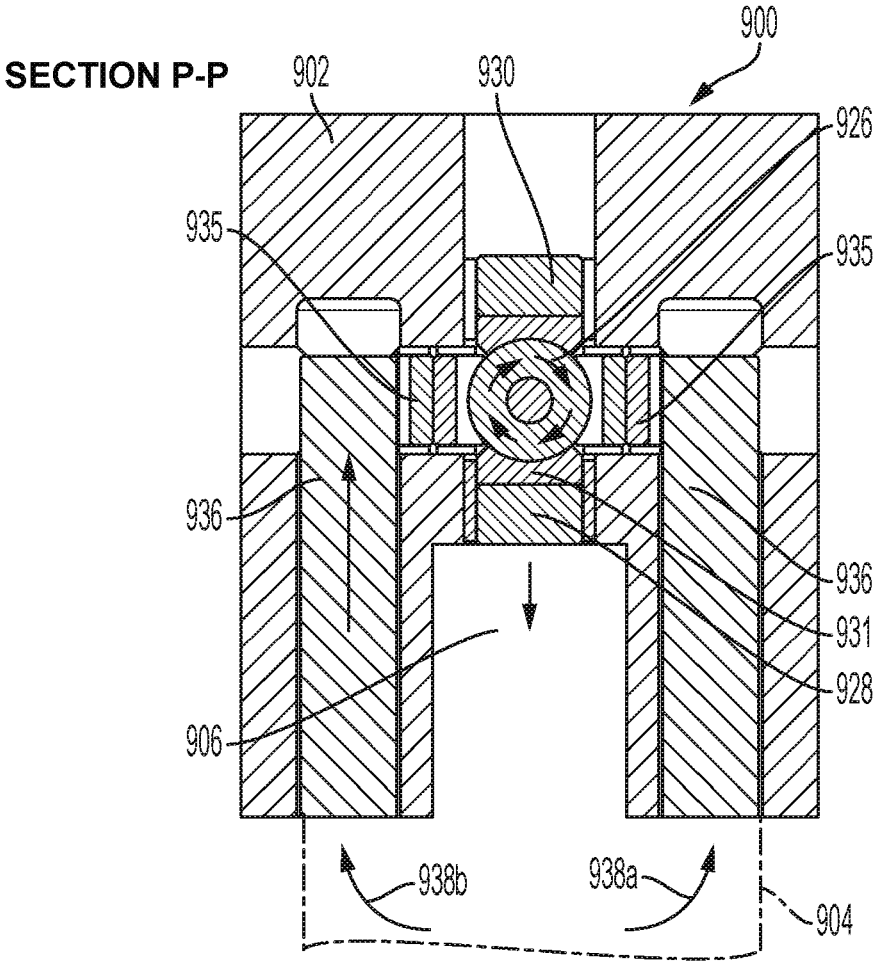
FIG. 9F is a section view of the holder apparatus in the engaged configuration, taken along line P-P of FIG. 9E.

FIG. 9F is a section view of machine tool holder apparatus 900 in an engaged configuration, taken along line P-P of FIG. 9E. Holder 902 includes laterally oriented magnets 935 positioned between each rotatable magnet 926 and shoulder inserts 936. Like lower magnets 928 and upper magnets 930, lateral magnets 935 may be dipolar and fixed within the body of holder 902. In this engaged configuration of holder 902, the magnetic orientation of the poles of rotatable magnet 926 adjacent to lateral magnets 935 may be reversed with respect to each lateral magnet 935, such that the south pole of each lateral magnet faces one of the north poles of the rotatable magnet, or vice versa. With respect to each other, the magnetic orientations of lateral magnets 935 may be reversed.

Rotatable magnet 926 can modulate the strength of the magnetic circuit induced through holder 902 by rotating, via movement of pin 908, such that its magnetic poles move in and out of alignment with each upper magnet 930, lower magnet 928, and lateral magnets 935. Shoulder inserts 936 may comprise ferromagnetic material configured to concentrate the magnetic circuit induced by the magnets through a tool 904 inserted within receiving cavity 906. As indicated by the arrows, the magnetic components of holder 902 may induce two magnetic circuits 938*a*, 938*b* generating oppositely-directed magnetic flux paths. The net magnetic flux generated by both circuits act cooperatively to retain tool 904. The rotatable magnets may be configured for various degrees of rotation. In some embodiments, each rotatable magnet may rotate a maximum of about 90° to effect switching between engaged and disengaged configurations.

Figure 9G:
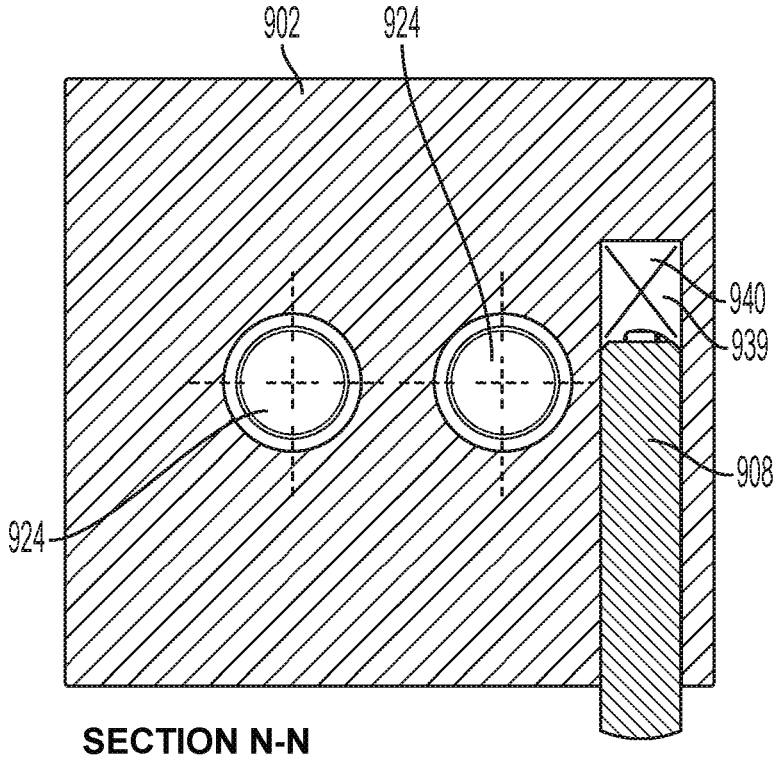
FIG. 9G is a section view of the machine tool holder, taken along line N-N of FIG. 9E.

FIG. 9G is a section view of holder 902, taken along line N-N of FIG. 9E. As shown, vertical aperture 924 may extend within the body of holder 902, and pin 908 may extend laterally within holder 902. Pin 908 may be configured to slide within a pin cavity 939 upon receiving a lateral force applied by an operator. In some examples, pin cavity 939 includes a spring 940 at one end. Upon insertion of pin 908 within cavity 939, the spring 940 may be compressed. In some examples, alleviation of the lateral force applied by the operator causes spring 940 to extend, thus pushing pin 908 into the resting state shown in FIG. 9G, in which a portion of the pin protrudes laterally from the holder.

Figure 9H:
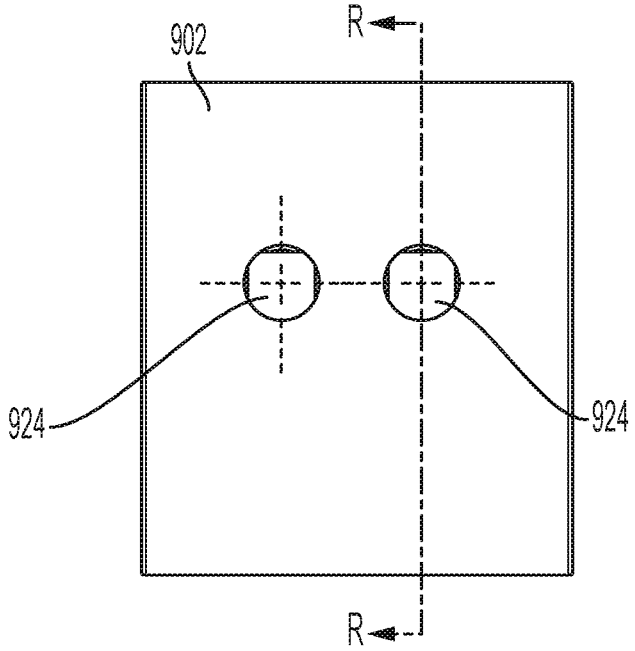
FIG. 9H is a top view of the machine tool holder, in a disengaged configuration.

FIG. 9H is a top view of holder 902 in a disengaged, unlocked or released configuration. In this configuration, pin 908 may be inserted entirely into the body of holder 902. In additional embodiments, pin 908 may be partially inserted into the holder.

Figure 9I:
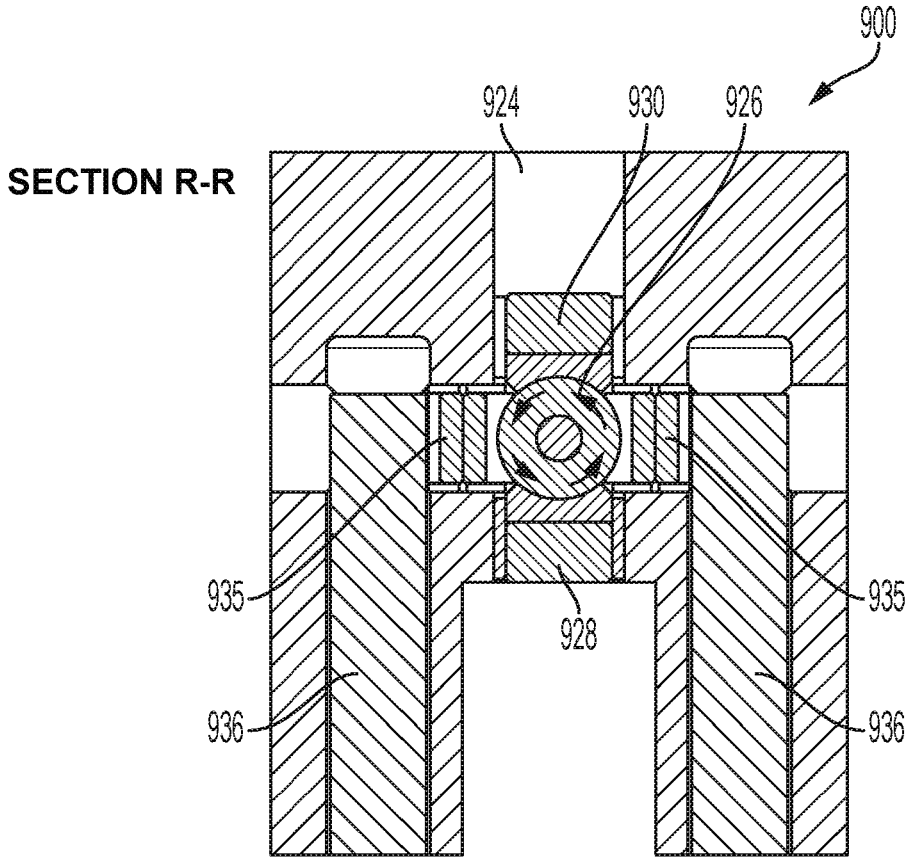
FIG. 9I is a section view of the holder apparatus, taken along line R-R of FIG. 9H.

FIG. 9I is a section view of machine tool holder apparatus 900 and tool holder 902, taken along line R-R of FIG. 9H. As shown in this disengaged configuration, the magnetic poles of each rotatable magnet 926 may be misaligned with the poles of each lateral magnet 935, lower magnet 928 and upper magnet 930, such that the south poles of the rotatable magnet face the south poles of each lateral magnet and each upper and lower magnet, or vice versa. In this configuration, the magnetic circuit between the magnetic components of the holder may be disrupted or at least diminished, such that a tool may be removed or installed.

Figure 9J:
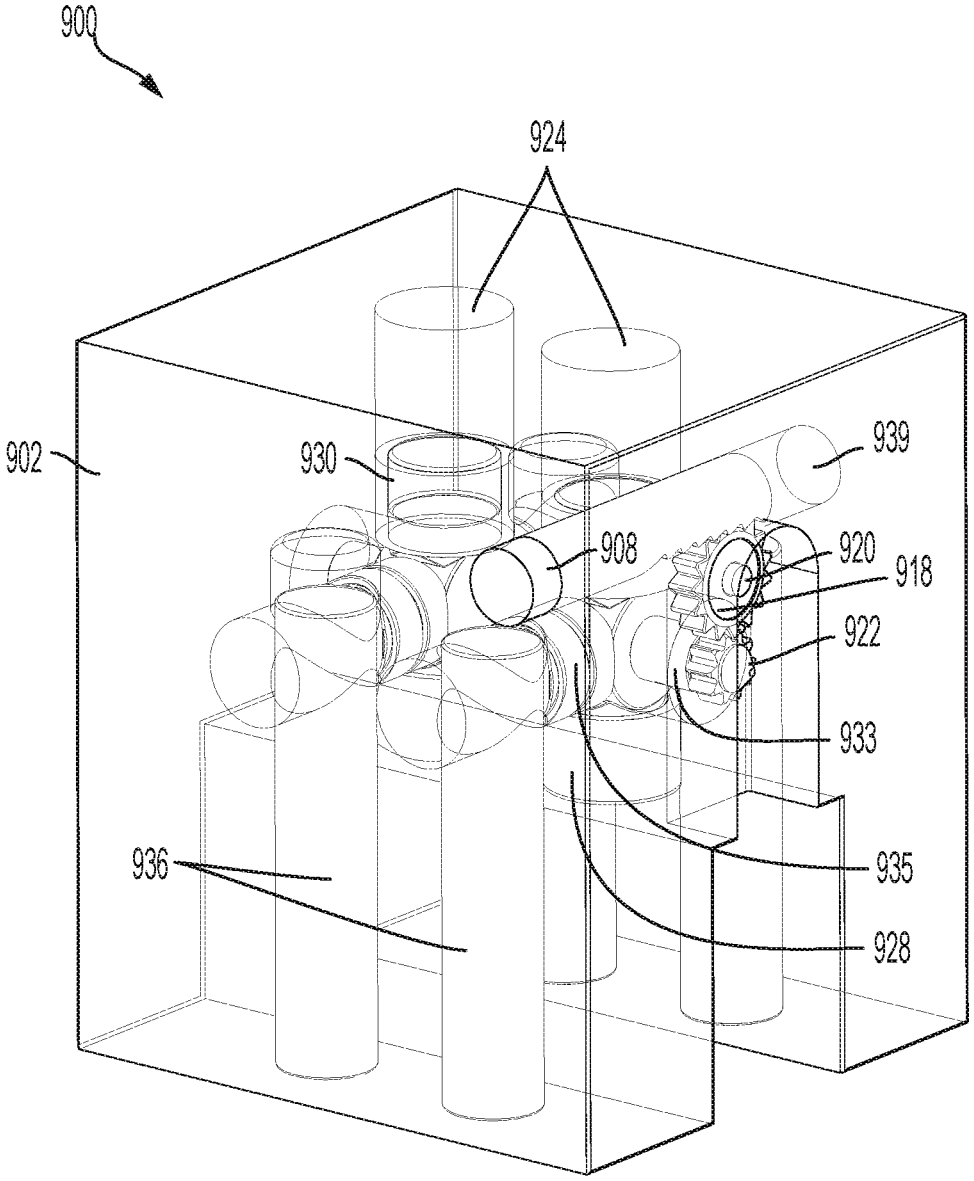
FIG. 9J is an isometric internal view of the tool holder apparatus, in an engaged configuration.

FIG. 9J is an isometric view of machine tool holder apparatus 900, showing the internal structure of the tool holder 902 in an engaged configuration. In addition to the components illustrated in FIGS. 9A through 9I, FIG. 9J shows the position of two upper magnets 930 within vertical apertures 924. The number of magnetic components may vary in different embodiments. For example, embodiments may include more than one slidable pin to allow locking/unlocking of holder at various access points. In addition or alternatively, more than two rotatable magnets may be included in a single holder, especially if such a holder has a greater length than holder 902.

Figure 9K:
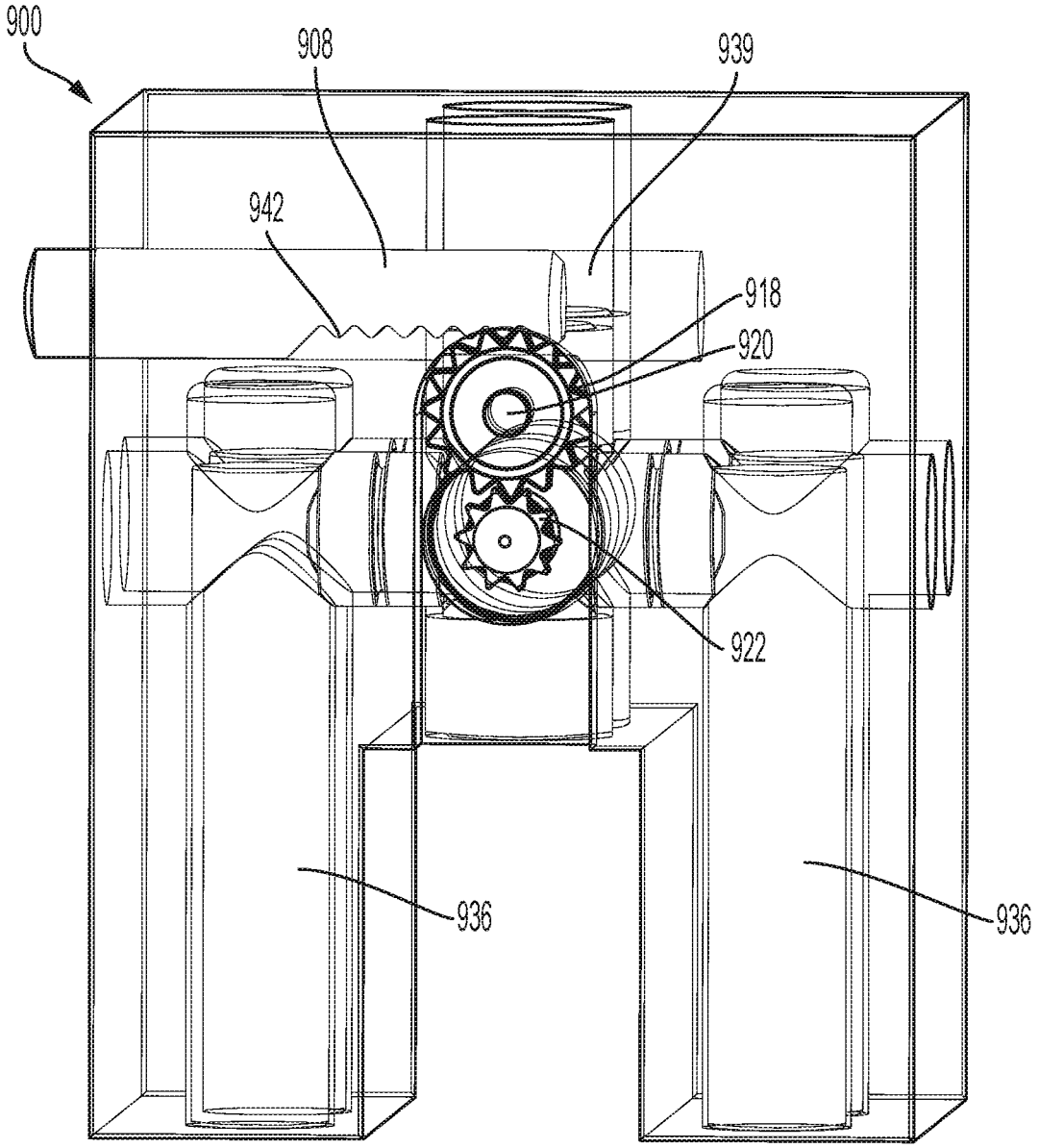
FIG. 9K is a side internal view of the tool holder apparatus, in the engaged configuration.

FIG. 9K is a side view of machine tool holder apparatus 900, showing the internal structure of the tool holder 92 in an engaged configuration. As shown, pin 908 may define a gear surface 942 configured to engage with pinion 918 such that lateral movement of pin 908 drives rotation of pinion 918, and thus gear member 922. Rotation of gear member 922 rotates rotatable magnets 926, thereby modulating the magnetic strength of the magnetic flux coupling between the holder and a tool.

Figure 9L:
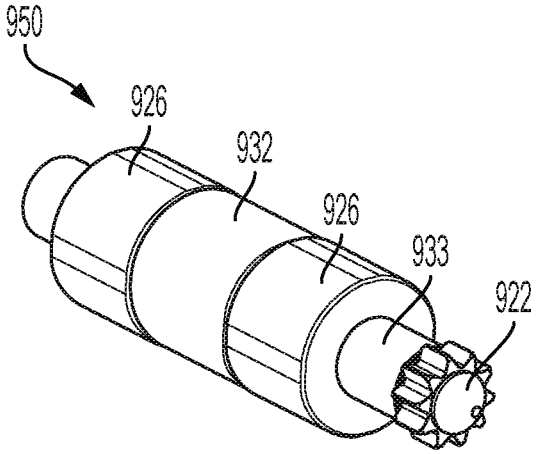
FIG. 9L is an isometric view of a rotatable magnetic assembly for the tool holder apparatus.

FIG. 9L is an isometric view of a rotatable magnet assembly 950. Within holder 902, rotatable magnet assembly 950 may be positioned within internal cavity 934. Gear member 922 is coupled with axle 933. Rotatable magnet assembly 950 further includes rotatable magnets 926 and rotatable insert 932. Rotatable insert 932, which may comprise a ferromagnetic material, may rotate in unison with the rotatable magnets 926.

Figure 9M:
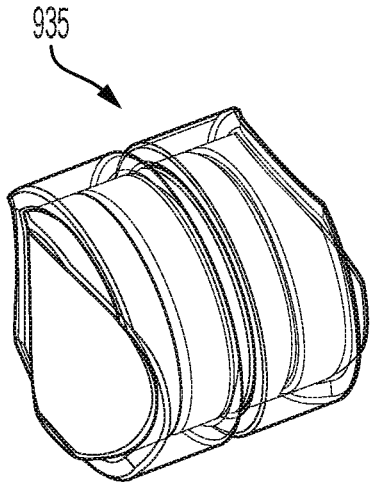
FIG. 9M is an isometric view of a laterally oriented magnetic assembly for the tool holder apparatus.

FIG. 9M is an isometric view of a lateral magnet 935. The lateral magnet may define arcuate portions at each end to mate with rotatable magnet assembly 950 at one end and a shoulder insert 936 at the other end. In some examples, lateral magnet 935 may comprise two or more sub-components, e.g., two or more magnets and/or ferromagnetic inserts.

Figure 10A:
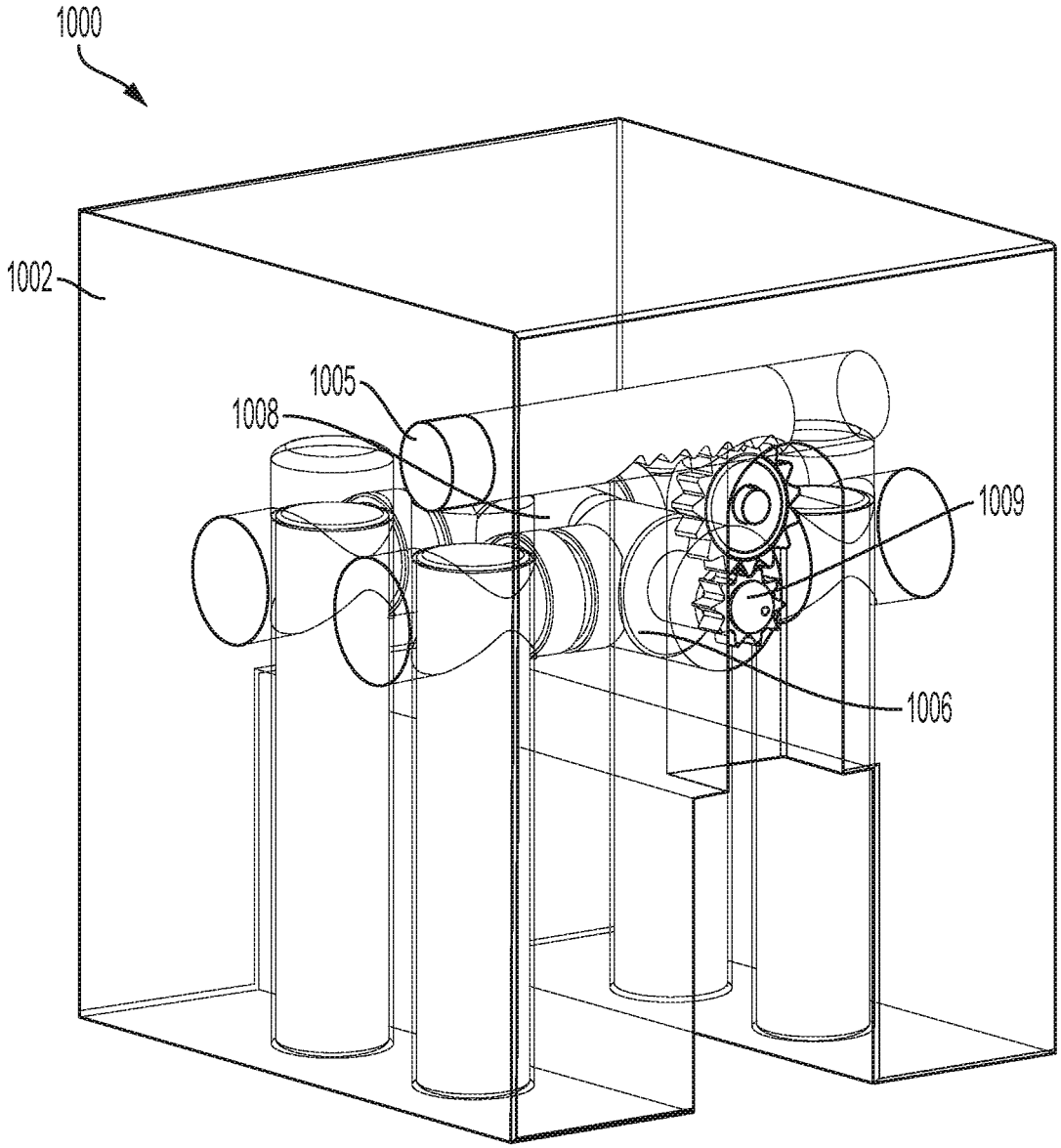
FIG. 10A is an isometric internal view of a machine tool holder assembly with rotatable ferromagnetic components, in an engaged configuration.

FIG. 10A is an isometric view of a machine tool assembly 1000 with tool holder 1002, showing the internal configuration of the holder in an engaged configuration. Holder 1002 may comprise numerous magnetic components that are identical or at least analogous to the magnetic components of holder 902. For instance, holder 1002 also comprises a slidable pin 1005, which is configured to modulate the strength of a magnetic flux coupling generated by the components of the holder.

Instead of rotatable magnets, holder 1002 may include a rotatable ferromagnetic paddle 1006, which may be positioned adjacent to rotatable insert 1008. Together with gear member 1009, these components may comprise a rotatable magnetic assembly that is manipulable via lateral movement of the pin. In the engaged configuration shown, holder 1002 may be selectively coupled with a tool via a magnetic flux coupling.

Figure 10B:
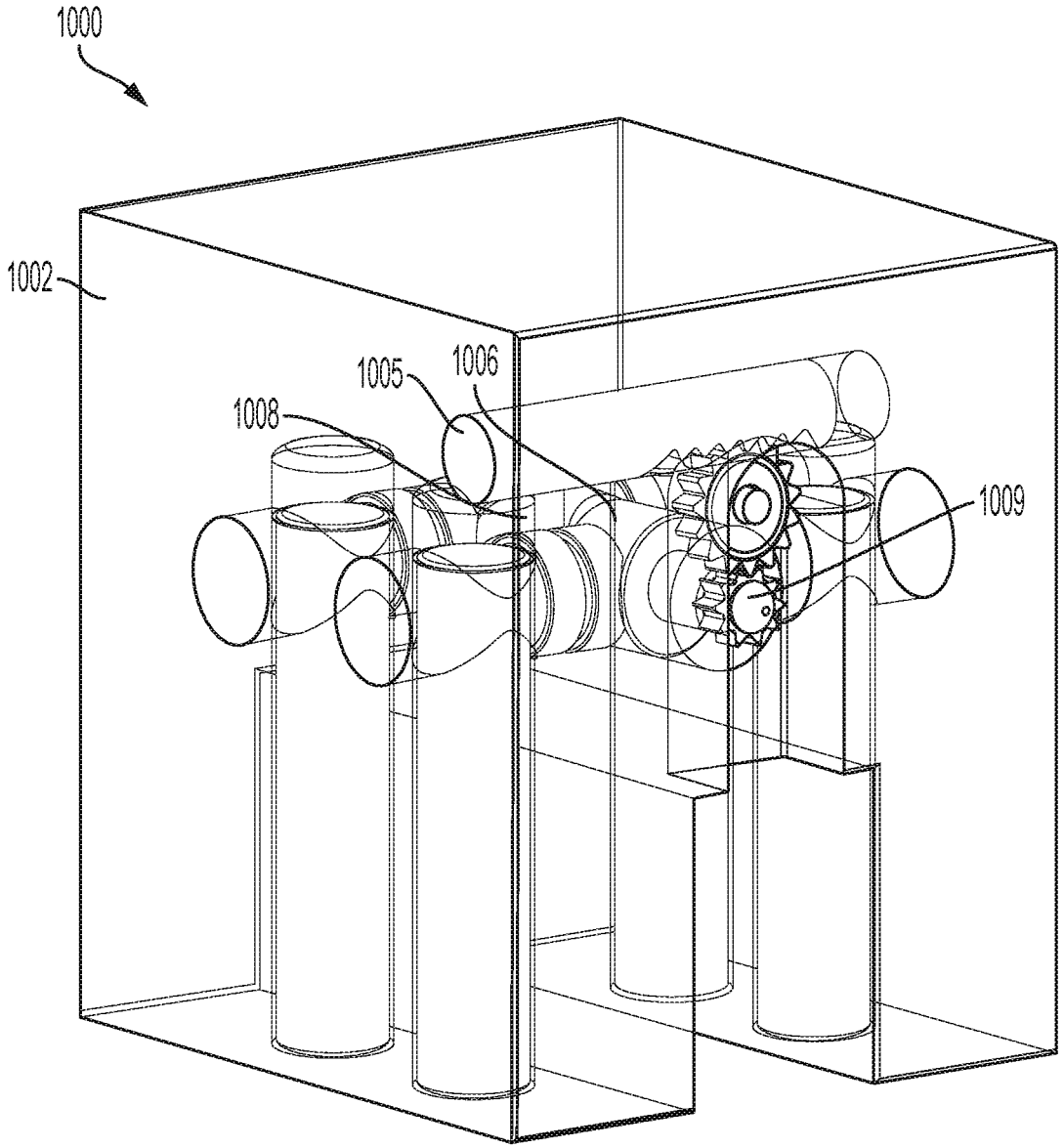
FIG. 10B is an isometric internal view of the machine tool holder assembly, in a disengaged configuration.

FIG. 10B is an isometric view of machine tool holder assembly 1000, showing the internal structure of the tool holder 1002 in a disengaged configuration. As shown, pin 1005 is inserted to a greater depth within holder 1002 relative to the position of pin 1002 in the engaged configuration of FIG. 10A. Ferromagnetic paddle 1006 has been rotated approximately 90° due to the repositioning of pin 1005. In this configuration, paddle 1006 may disrupt or at least weaken the strength of a magnetic circuit established via the configuration shown in FIG. 10A by introducing large air gaps between the magnetic components of holder 1002, such that a tool coupled with the holder may be installed or removed.

Figure 10C:
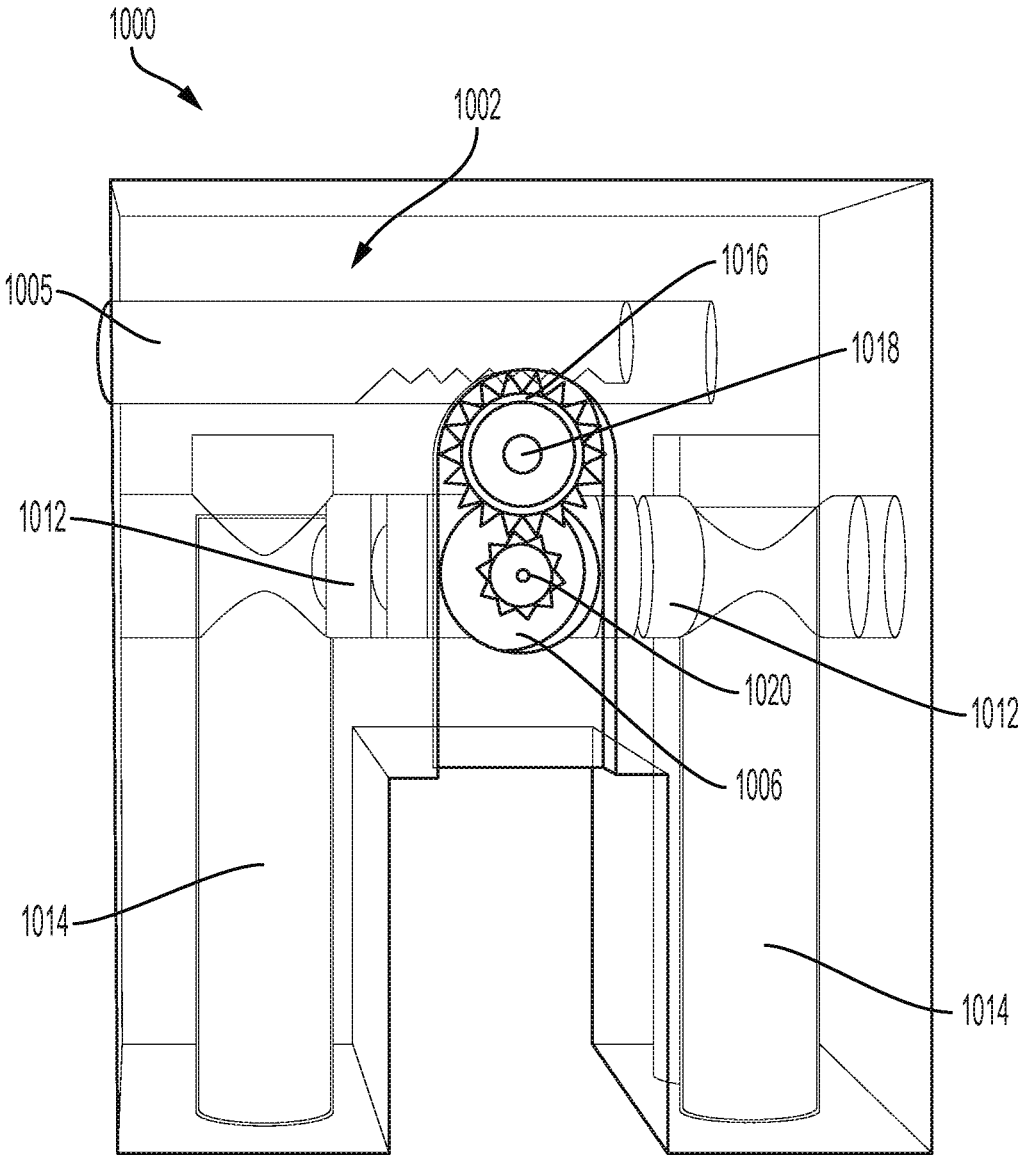
FIG. 10C is a side internal view of the machine tool holder assembly, in a disengaged configuration.

FIG. 10C is a side view of machine tool holder assembly 1000, showing the internal configuration of the tool holder 1002 in the disengaged configuration. As shown, holder 1002 may lack upper and lower magnets and/or ferromagnetic components, such as components 928, 930, and 931 included within holder 902. Lateral magnets 1012 are also shown within holder 1002.

Rotation of ferromagnetic paddle 1006 drives modulation of the strength of the magnetic circuits induced by holder 1002. The shape of paddle 1006 may alternate the magnetic strength. In particular, paddle 1006 may not be cylindrical, like the rotatable magnets 926 shown in FIG. 9. Instead, paddle 1006 may comprise a greater width than height, such that in one orientation, the ends of the paddle may contact, or be in close proximity with, each of the lateral magnets 1012. This proximity may allow paddle 1006 to contribute to a magnetic circuit passing through the lateral magnets 1012 and ferromagnetic shoulder inserts 1014.

In the disengaged configuration shown in FIG. 10C, the ends of paddle 1006 may not contact, or be in close proximity with, each of the lateral magnets 1012, thereby disrupting or diminishing the magnetic circuit passing through the lateral magnets. In this manner, rotation of paddle 1006 may modulate the magnetic coupling strength of holder 1002. Like holder 902, holder 1002 may include a pinion 1016, idler 1018 and gear member 1020 which cooperate to translate lateral sliding of pin 1005 into rotation of ferromagnetic paddle 1006.

Figure 10D:
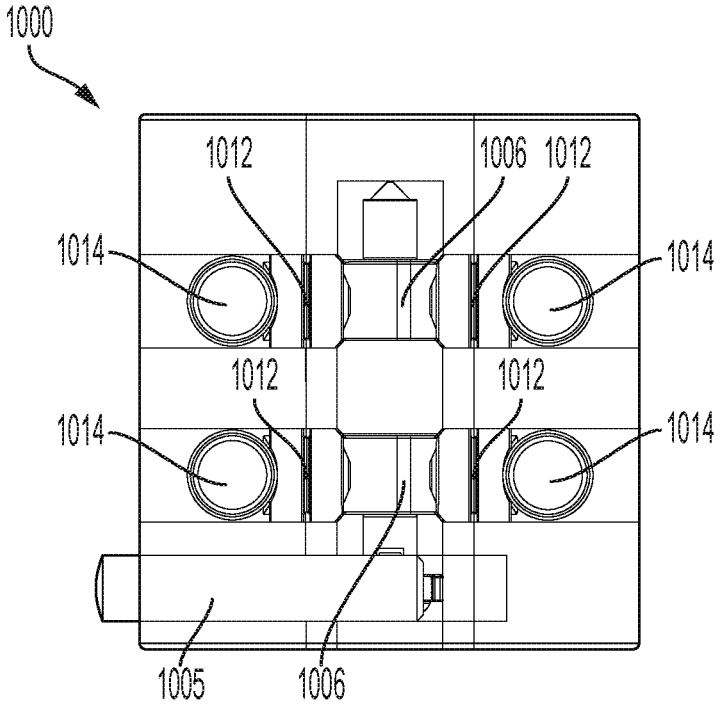
FIG. 10D is a top internal view of the machine tool holder assembly, in an engaged configuration.

FIG. 10D is a top view of machine tool holder assembly 1000, showing the inner configuration of the tool holder 1002 in an engaged configuration. The circular cross-sectional shape of shoulder inserts 1014 is shown, but in embodiments, the shape may vary. Four lateral magnets 1012 are also shown, each positioned laterally between a shoulder insert 1014 and a ferromagnetic paddle 1006. The orientation of the ferromagnetic paddles, such that each paddle abuts two lateral magnets, strengthens the strength of a magnetic circuit passing through the lateral magnets, coupling the holder with a tool.

Figure 10E:
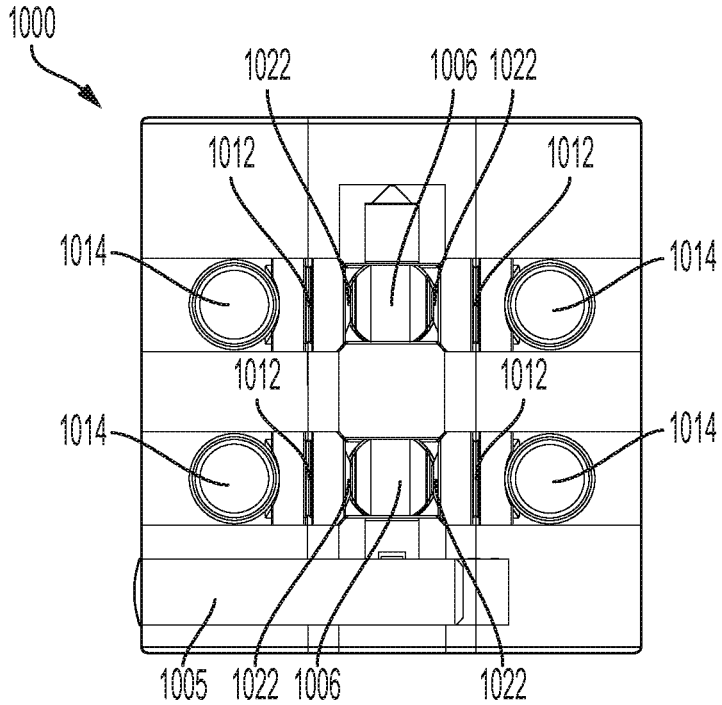
FIG. 10E is an internal plan view of the machine tool holder assembly, in the disengaged configuration.

FIG. 10E is a plan view of machine tool holder assembly 1000, showing the internal structure of the tool holder 1002 in a disengaged configuration. As shown, rotation of each ferromagnetic paddle 1006 creates a lateral air gap 1022 between each paddle and each lateral magnet 1012, thereby disrupting or at least diminishing the magnetic circuit passing therethrough. In his configuration, a tool may be released from the holder.

Decoupling Elements

Figure 11A:
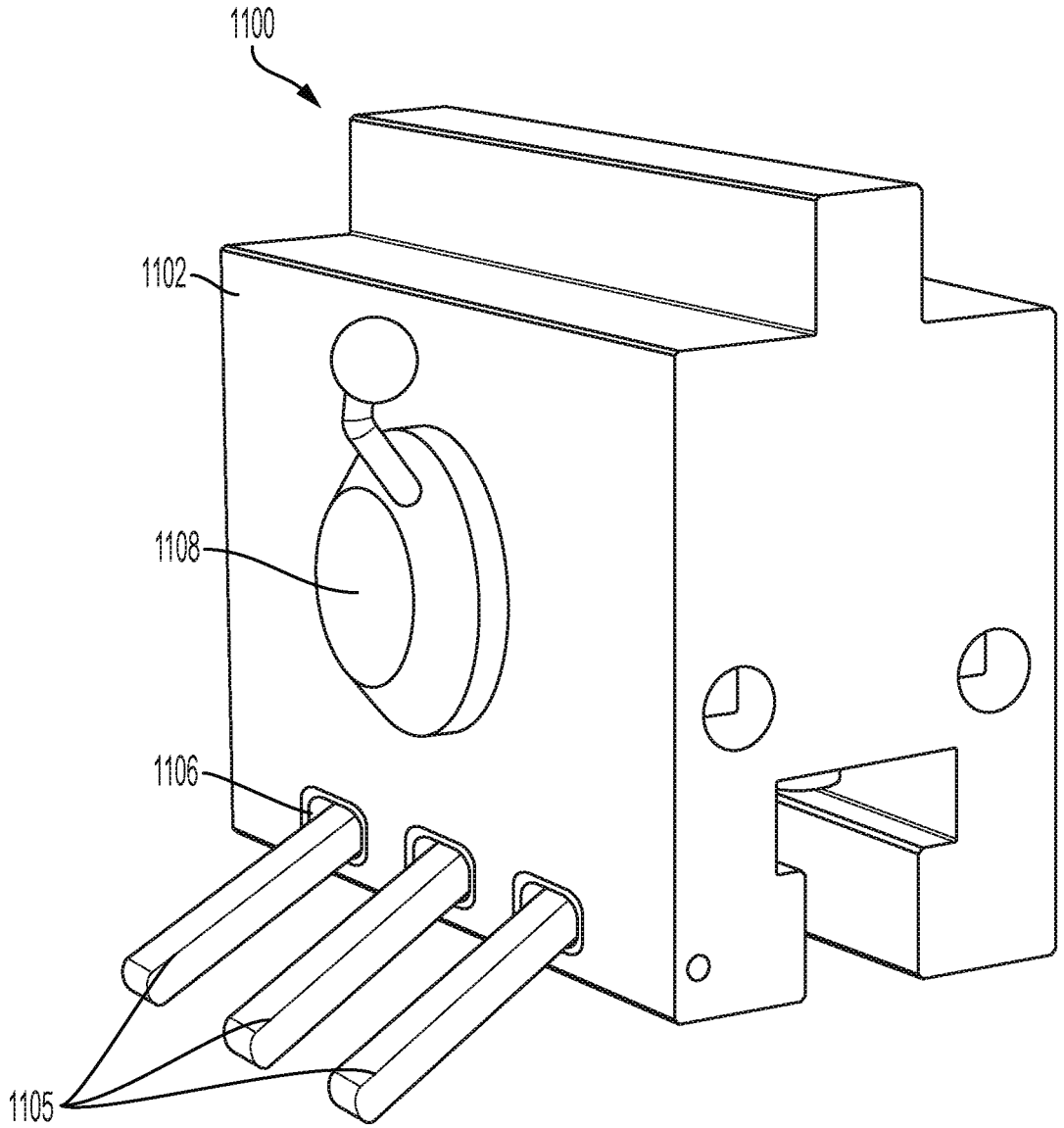
FIG. 11A is an isometric view of a machine tool holder system with a pry bar or lever assembly.

FIG. 11A is an isometric view of a machine tool holder system 1100 with tool holder 1102 including an assembly of pry bars or lever members 1105. Pry bars or lever members 1105 may assist in the removal of a tool from holder 1102 by leveraging or prying the tool away from the holder, or at least far enough away so as to weaken a magnetic circuit induced within the holder, which may be induced according to the same or similar mechanism as holder 202. To selectively engage and disengage holder 1102 from a tool, the holder also includes an actuator 1108 manipulable by an operator.

The particular embodiment shown includes three pry bars or levers 1105, but the number of pry bars may vary. In various examples, the number of pry bars may range from one to about five, from one to about ten, from one to about fifteen, or from one to about twenty or more. Greater numbers of pry bars may be necessary to remove tools from a holder having a relatively high magnetic strength even in a disengaged configuration. The pry or lever members 1105 can provide enhanced safety to operators by serving as an additional component requiring manipulation before a tool may be released from the holder, in addition to the magnetic coupling components operably coupled with actuator 1108. The pry bars shown in FIG. 11A comprise straight, elongate bars, but in various embodiments, the length and shape of the pry bars may vary.

Figure 11B:
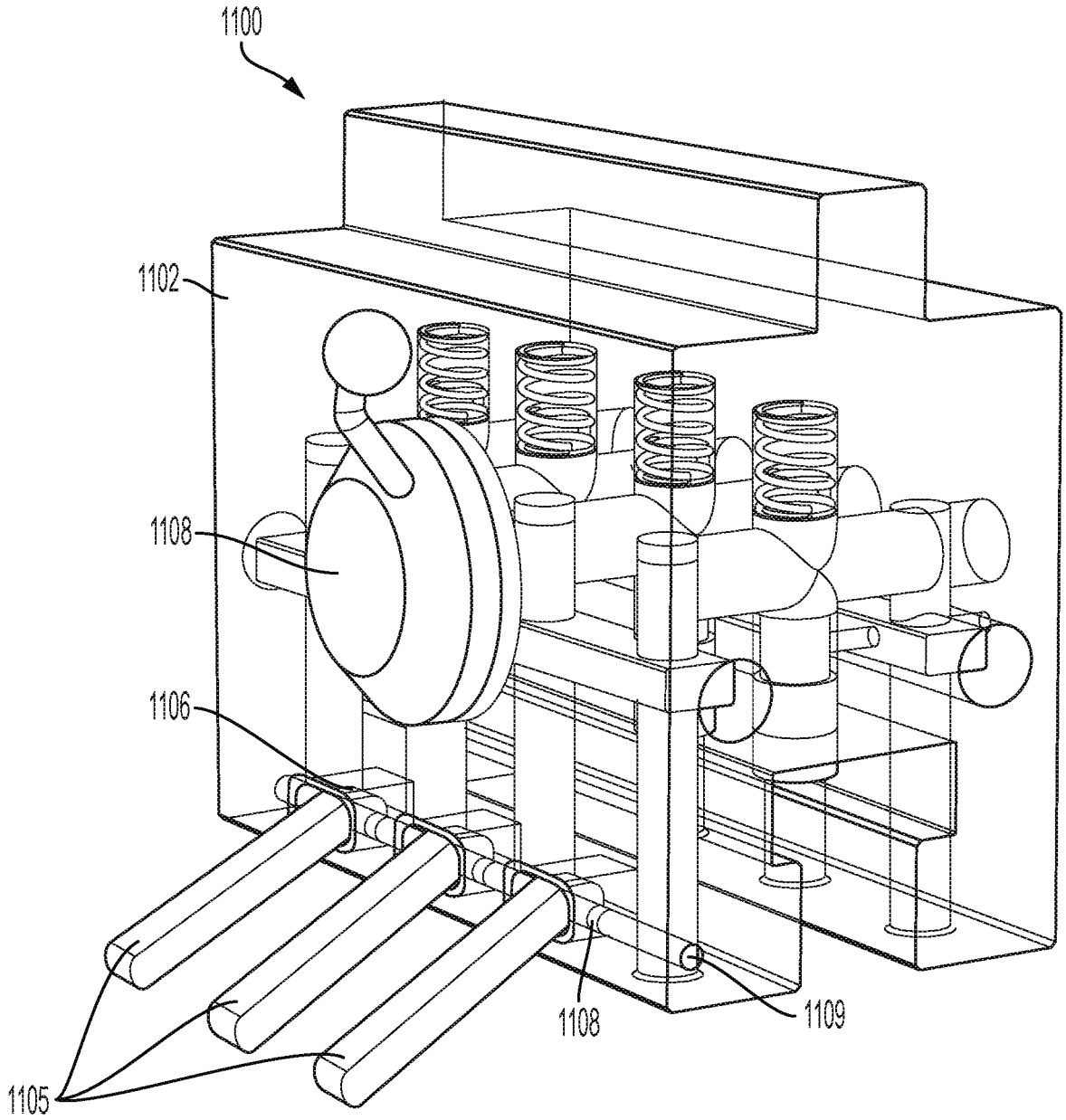
FIG. 11B is an isometric internal view of the machine tool holder system in FIG. 11A, in an engaged configuration.

FIG. 11B is an isometric view of machine tool holder system 1100, showing the internal configuration of the tool holder 1102 in an engaged configuration. With the exception of the pry bars or levers 1105, the components of holder 1102 are similar in form and function to holder 202 (as shown particularly in FIG. 2H). In the engaged configuration, each pry bar is angled downward. A portion of each pry bar extends within pry cavities 1106, where the pry bars are rotatably engaged with cylindrical anchor rods 1108 positioned with a longitudinally extending anchor cavity 1109. The pry bars can rotate about the rods when manipulated by a user, for example by moving the pry bars up and down. The embodiment shown includes pry bars one side of the holder. In additional embodiments, pry bars may be coupled with two or more sides of the holder.

Figure 11D:
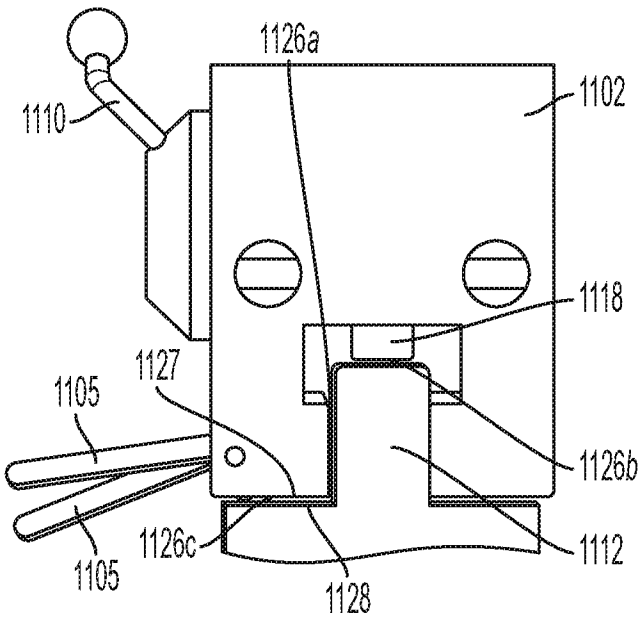
FIG. 11D is a section view of the machine tool holder, in a disengaged configuration.
Figure 11C:
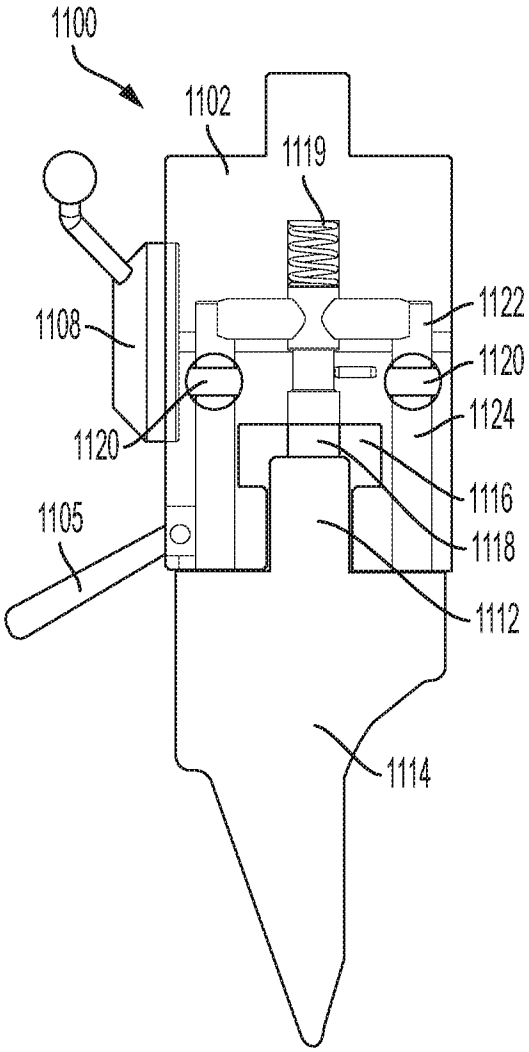
FIG. 11C is a section view of the machine tool holder system, in the engaged configuration.

FIG. 11C is a section view of machine tool holder system 1100 with tool holder 1102 in an engaged configuration. Each pry bar or lever 1105 is similarly oriented in a downward position. An upper portion or tang 1112 of tool 1114 is positioned within a receiving portion or cavity 1116 defined by holder 1102. A top surface of tang 1112 abuts a center magnet 1118, thereby compressing spring 1119. In this configuration, slidable racks 1120 position rack magnets in magnetic alignment with upper stator magnets 1122 and lower stator magnets 1124, inducing a magnetic circuit through tool 1114 and holder 1102.

FIG. 11D is a section view of the tool holder 1102 with a portion of machine tool 1114 with at least one pry bar or lever 1105 in a disengaged configuration. As shown, manipulation of a pry bar 1105 can create separation between tool 1114 and holder 1102, forming a gap 1126*a* between a side surface of tang 1112 and the body of holder 1102, a gap 1126*b* between a top surface of tang 1112 and center magnet 1118, and a gap 1126*c* between a surface of the receiving shoulder 1127 of the holder and the upper shoulder 1128 of the tool. The creation of gap 1126*c* may be useful in facilitating removal of tool 1114 from holder 1102. In embodiments, movement of one or more pry bars may be utilized to initiate release of the tool from the holder. Movement of a single pry bar into a disengaged position may be sufficient to disrupt or diminish relatively weak magnetic circuits, while movement of two or more pry bars may be necessary to disrupt or diminish relatively strong magnetic circuits.

Figure 12B:
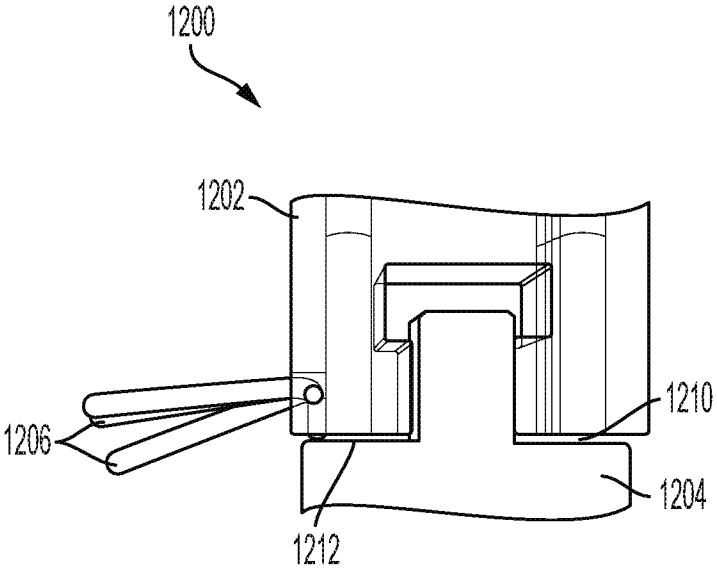
FIG. 12B is a side view of the tool holder and pry bar or lever assembly in FIG. 12A, showing the internal configuration.
Figure 12A:
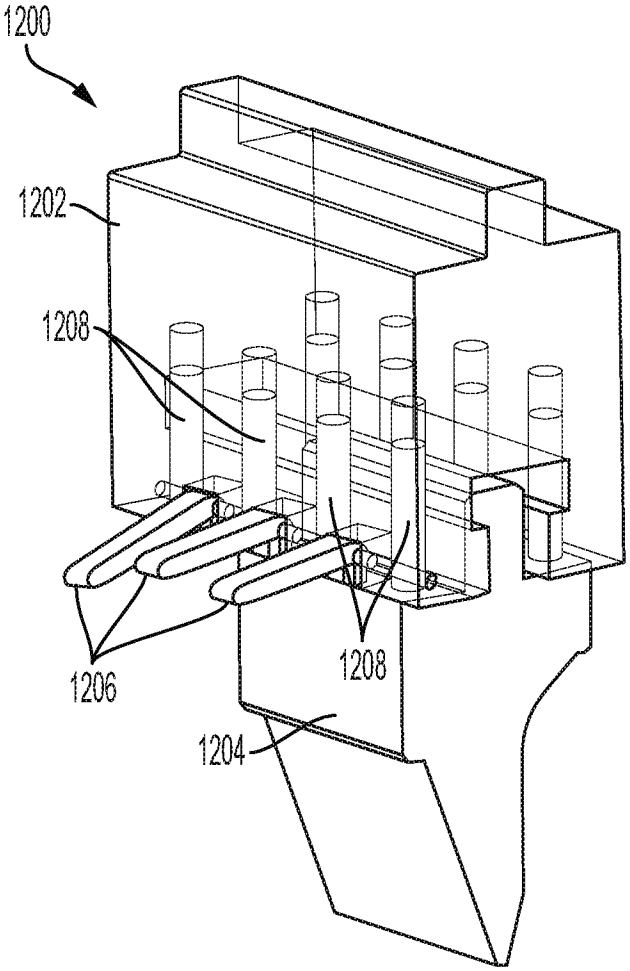
FIG. 12A is an isometric view of a tool holder and pry bar or lever assembly, in an embodiment with non-adjustable magnetic components.

FIG. 12A is an isometric view of a machine tool holder and pry bar assembly 1200 with tool holder 1202 engaging machine tool component 1204, showing the internal configuration of the tool holder 1202. In addition to pry bars 1206, holder 1202 includes a plurality of permanent, rod-like magnets 1208 fixed, e.g., not adjustable or switchable, within the holder. Magnets 1208 may generate magnetic circuits that include portions of tool 1204.

The strength of the circuits may be sufficient to at least temporarily couple tool 1204 with holder 1202. Because the magnetic strength of magnets 1208 may not be modulated, pry bars 1206 may selectively switch holder 1202 between engaged and disengaged configurations. In particular, the pry bars mechanically leverage or pry the tool away from the holder, overcoming the retaining strength of the magnetic circuit induced by magnets 1208 and ferromagnetic components included in the holder and tool. In some embodiments, the pry bars may suffice to release tool 1204 from holder 1202. In other embodiments, the pry bars, alone, may be insufficient to fully separate tool 1204 from holder 1202. Such embodiments may require an operator to manually remove tool 1204 from holder 1202. In various examples, this manual removal step may be performed with ease.

FIG. 12B is a side view of the machine tool holder and pry bar or lever assembly 1200 with tool holder 1202 and machine tool component 1204, showing the internal configuration of tool holder 1202. As shown, movement of at least one pry bar 1206 may create a gap 1210 between a shoulder portion 1212 of tool 1204 and holder 1202. In some examples, movement of only one pry bar to create separation between tool 1204 and holder 1202 may be sufficient to release tool 1204 from holder 1202. In some embodiments, movement of two or more pry bars may be required.

Figure 12C:
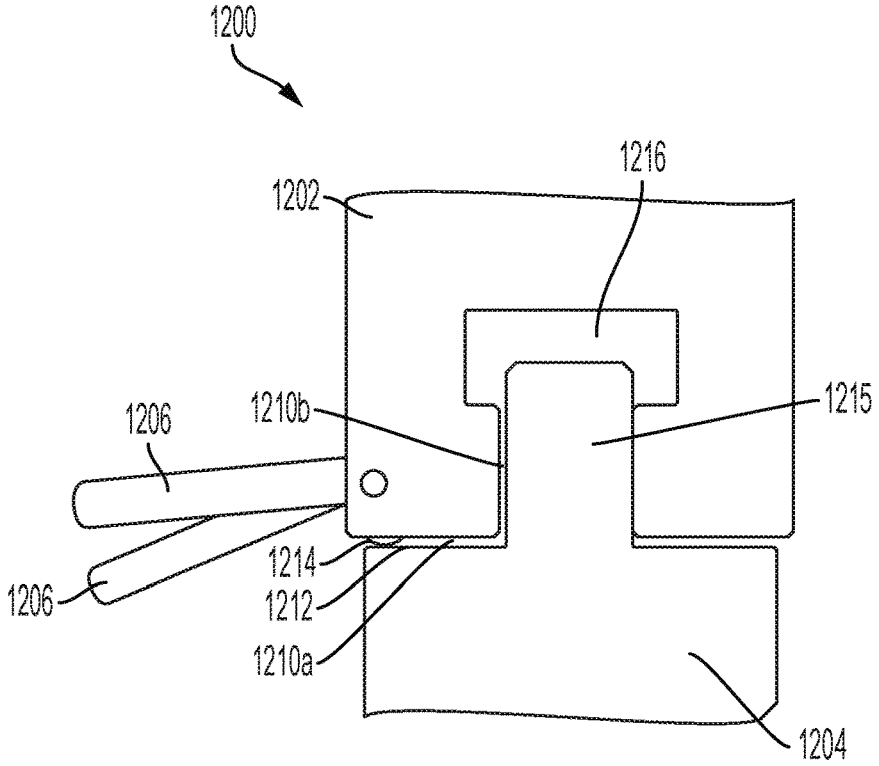
FIG. 12C is a side view of the tool holder and pry bar or lever assembly, in a disengaged configuration.

FIG. 12C is a side view of the machine tool holder and pry bar assembly 1200 with tool holder 1202 and tool 1204, after movement of at least one pry bar 1206 into a disengaged configuration. Separation between the holder and the tool is evident at a vertical gap 1210*a* and horizontal gap 1210*b*. A leveraging portion 1214 of a pry bar is also shown. Each pry bar 1206 comprises a leveraging portion 1214, which directly contacts the tool and may be irregular or oblong in shape. Leveraging portion 1214 rotates upon manipulation of the pry bar, pushing downward against the shoulder portion 1212 of tool 1204. An upper portion or tang 1215 of the tool is shown protruding into a receiving portion or cavity 1216 defined by the holder.

Figure 12D:
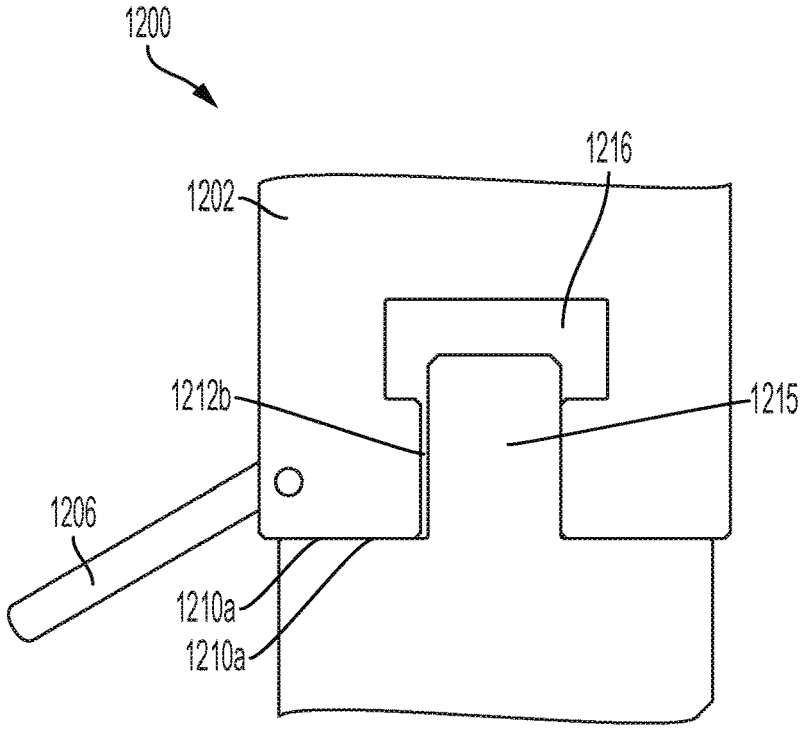
FIG. 12D is a side view of the tool holder and pry bar or lever assembly, in an engaged configuration.

FIG. 12D is a side view of holder 1202 and tool 1204 in an engaged configuration. When engaged, vertical gap 1210*a* may be partially or entirely closed, such that shoulder portion 1212 of tool 1204 is in direct contact with holder 1202. Horizontal gap 1210*b* may be maintained, partially closed, or entirely closed in various embodiments. Due to the tightening of tool 1204 with holder 1202, tang 1215 protrudes a greater distance within receiving cavity 1216 compared to the position of tang 1215 shown in FIG. 12C, when at least one pry bar is leveraging the tool away from the holder.

Sliding Actuator Elements

Figure 13A:
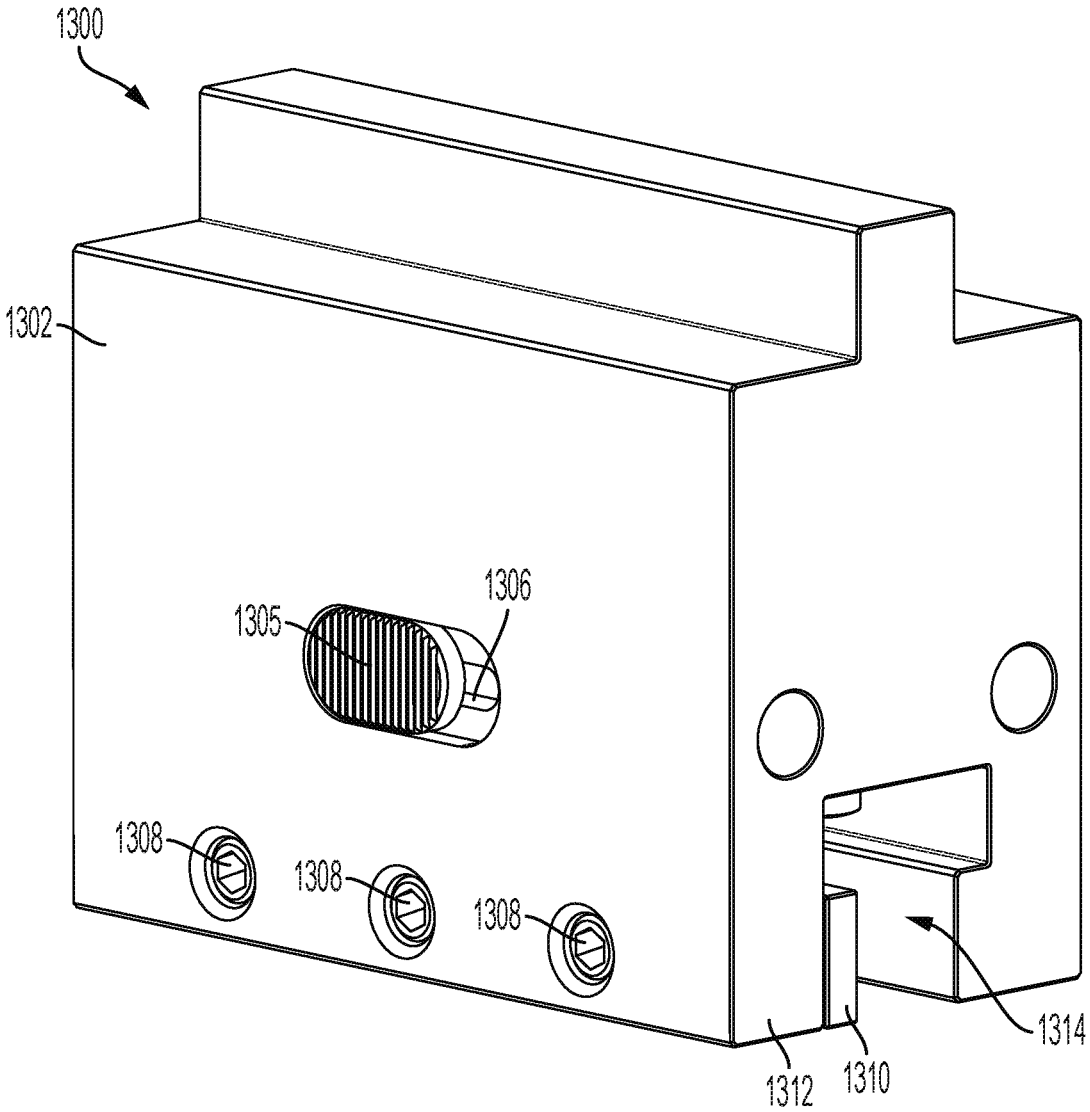
FIG. 13A is an isometric view of a tool holder assembly with slidable magnetic actuator.

FIG. 13A is an isometric view of a machine tool holder assembly 1300 with tool holder 1302 comprising a slidable actuator 1305. Like holder 202, holder 1302 may be configured for selective engagement and disengagement with a tool via an adjustable magnetic flux coupling. The slidable actuator 1305 is positioned within an actuator window 1306. Holder 1302 also includes a plurality of fasteners 1308, e.g., set screws, configured to adjust the position of clamping bar 1310 with respect to shoulder 1312. Holder 1302 defines a receiving portion or cavity 1314 configured to receive a tool.

Figure 13B:
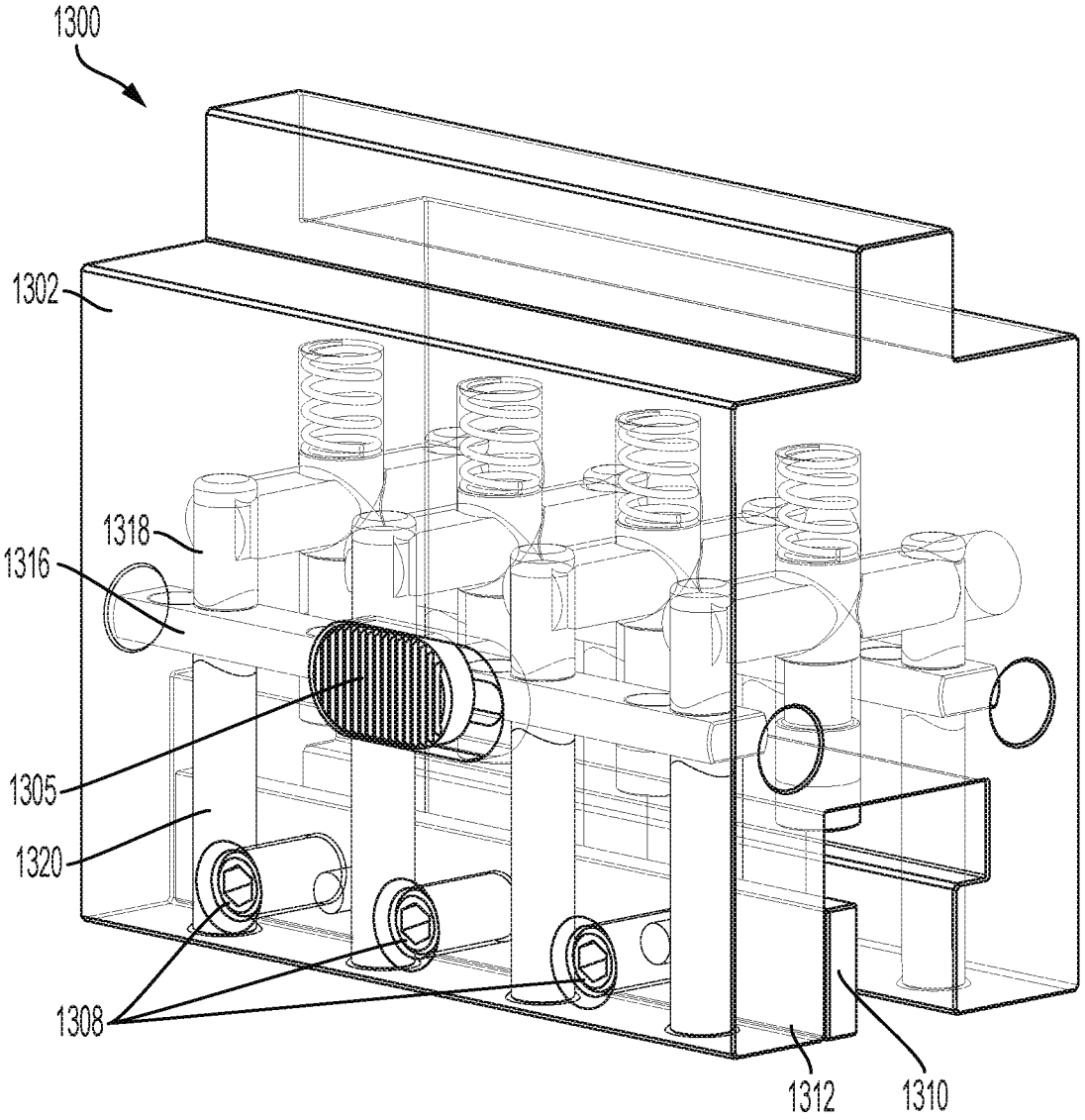
FIG. 13B is an isometric view of tool holder assembly in FIG. 13A, showing the internal configuration.

FIG. 13B is an isometric view of machine tool holder assembly 1300, showing the internal configuration of the holder 1302. Like holder 202, holder 1302 includes two slidable racks 1316, each rack including a plurality of alternately-oriented rack magnets between upper stator magnets 1318 and lower stator magnets 1320. To slide each rack 1316 within the body of the holder, slidable actuator 1305 may be slid back and forth within actuator window 1306. The textured surface of actuator 1305 may facilitate manual engagement, e.g., gripping, by an operator.

In various embodiments, actuator 1305 may be physically or operatively coupled with rack 1316. Movement of the actuator can cause equal, parallel movement of rack 1316. By moving actuator 1305 laterally within window 1306, holder 1302 may be switched between engaged and disengaged configurations, the holder configured to induce a magnetic circuit capable of retaining a tool in the engaged configuration. In some examples, the engaged and disengaged configurations of holder 1302 may be bi-stable or non-momentary.

Figure 13C:
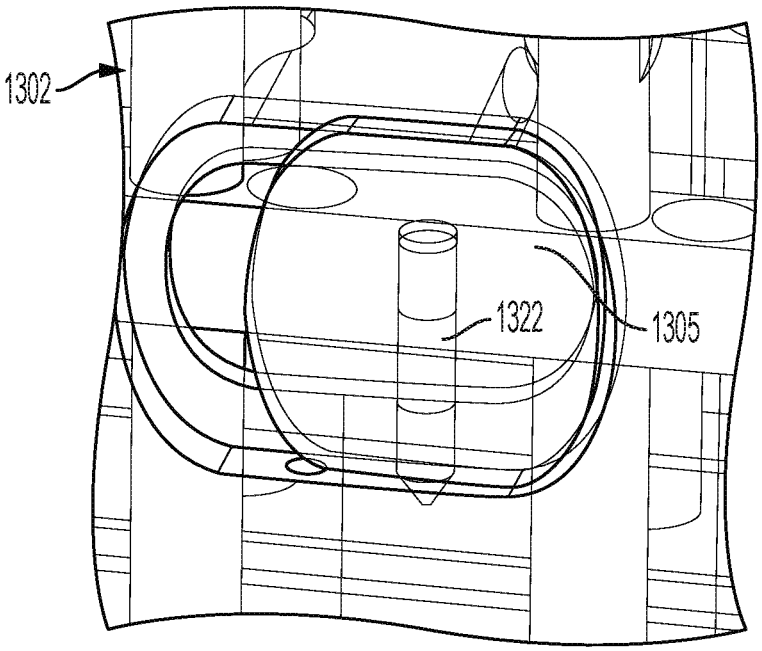
FIG. 13C is an isometric view of the tool holder, showing the internal slidable magnetic actuator configuration.

FIG. 13C is an isometric view of tool holder 1302 and actuator 1305, showing the internal configuration of the actuator and a portion of the holder. As shown, the actuator may include a locking pin 1322. The pin may be vertically oriented, transverse to rack 1316.

Figure 13D:
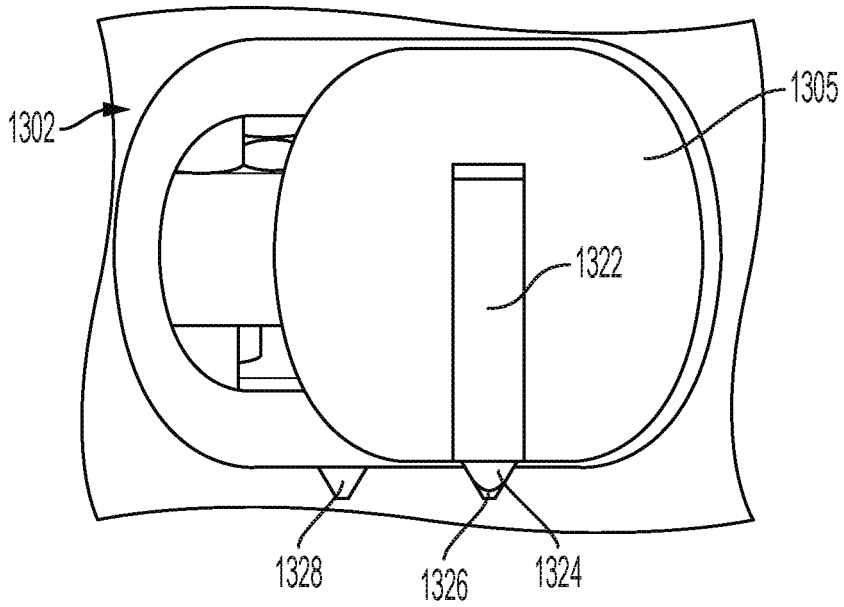
FIG. 13D is an isometric view of the tool holder and slidable magnetic actuator, in an embodiment with a locking pin.

FIG. 13D is an isometric view of tool holder 1302 and actuator 1305, showing a tip portion 1324 of locking pin 1322 seated in a first groove 1326 defined by the body of holder 1302. A second groove 1328, also configured to seat tip portion 1324 of locking pin 1322, is vacant in the configuration shown. Locking pin 1322 can secure actuator 1305, and thus holder 1302, in an engaged or disengaged configuration when an operator is not biasing actuator toward either end of actuator window 1306. In some examples, the locking pin may automatically snap into the grooves defined by the holder upon being positioned above one of the grooves. Embodiments may include a compression spring configured to urge the locking pin into each of the grooves.

Figure 13E:
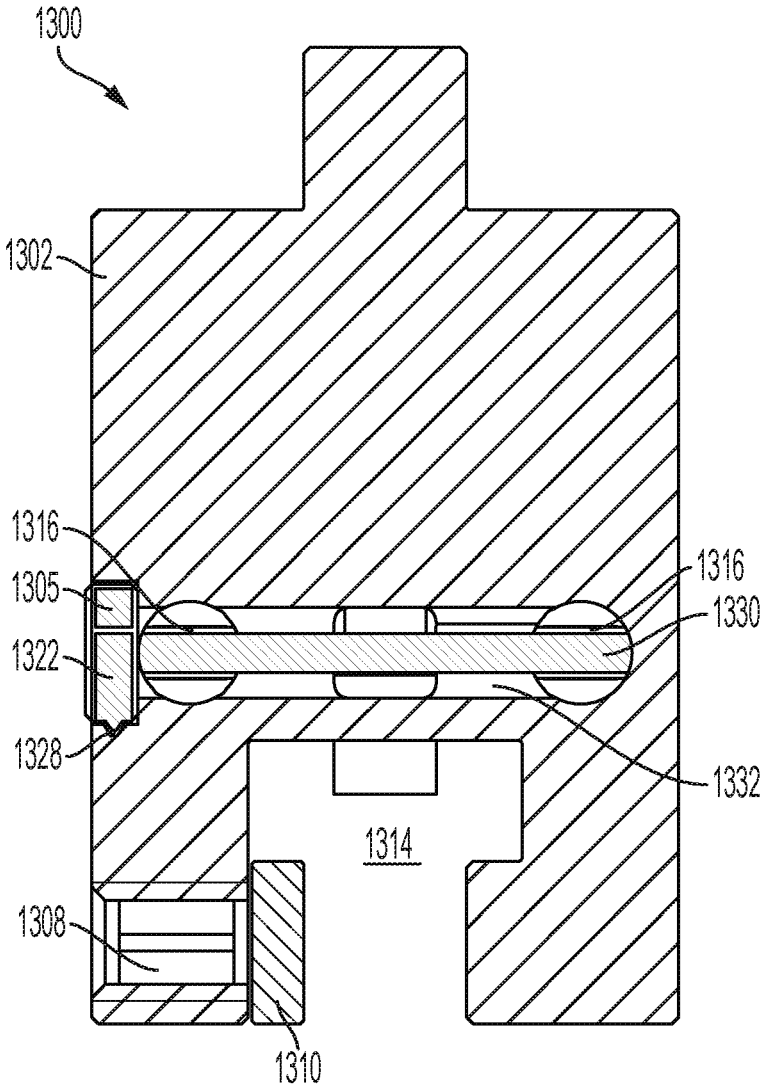
FIG. 13E is a section view of the magnetic tool holder assembly in FIG. 13D.

FIG. 13E is a section view of machine tool holder assembly 1300 with holder 1302, showing an elongate rod portion 1330 formed or coupled with the manually engageable portion of actuator 1305. The rod portion 1330 extends through the body of the holder, passing perpendicularly through each of the slidable racks 1316 such that movement of the elongate rode drives equal movement of the racks.

EXAMPLES

In accordance with examples and embodiments of the above disclosure, a machine tool apparatus includes a holder body having a receiving portion configured for selective engagement with a coupling end of a machine tool; a magnetic coupling assembly including one or more magnetic elements configured to generate a magnetic coupling adapted for the selective engagement of the holder body with the coupling end of the machine tool; and an actuator configured to manipulate at least one of the magnetic elements to modulate a strength of the magnetic coupling for selective engagement and disengagement of the holder body with the coupling end of the machine tool.

In some embodiments, the actuator may be configured to manipulate at least one of the magnetic elements of the magnetic coupling assembly between a locked position, in which the coupling end of the machine tool is selectively engaged within the receiving portion of the holder body, and an alternate unlocked position, in which the coupling end of the machine tool is selectively disengaged from the receiving portion of the holder body. In some embodiments, the one or more magnetic elements may be responsive to actuation of the actuator such that the locked and unlocked positions are bi-stable. In some examples, in the locked position, the magnetic coupling may support a weight of the machine tool disposed within the receiving portion of the holder body. Some embodiments may further include an adjustment mechanism configured to adjust a maximum strength of the magnetic coupling to support the weight of the machine tool.

In any of the above examples and embodiments, the magnetic elements may include one or more permanent magnets and one or more ferromagnetic components, and the actuator may be configured to selectively move at least one of the permanent magnets or ferromagnetic components to modulate the strength of the magnetic coupling by forming a flux path therebetween.

In some embodiments, at least one of the magnetic elements may be configured to slide to selectively form the flux path and/or to modulate a magnetic impedance thereof. In some implementations, at least one of the magnetic elements may be configured to rotate to selectively form the flux path and/or to modulate a magnetic impedance thereof. In some examples, the one or more magnetic elements may include at least one electromagnet configured to selectively generate a magnetic flux to modulate the strength of the magnetic coupling. According to such embodiments, the actuator may include an electronic controller electronically coupled with the magnetic coupling assembly. The electronic controller may be coupled with a feedback sensor configured to detect the machine tool within the receiving portion of the holder body.

In any of the above examples and embodiments, the receiving portion of the holder body may comprise a cavity defined by an inner surface of the holder body and a clamping member configured for selective engagement with the coupling end of the machine tool disposed within the cavity. In some embodiments, the magnetic coupling assembly further includes one or more magnetic elements embedded within the clamping member. In some examples, the magnetic coupling assembly further includes one or more magnetic elements embedded within the inner surface of the holder body.

In any of the above examples and embodiments, the magnetic coupling may define a magnetic flux circuit that passes through the coupling end of the machine tool and at least a portion of the holder body. Some examples may further include one or more mechanical coupling members comprising at least one clamp, screw, cam, or lever configured to secure the coupling end of the machine tool within the receiving portion of holder body. Embodiments may further include one or more decoupling members configured to mechanically urge the machine tool away from the holder body such that the machine tool may be removed from the receiving portion of the holder body. In some examples, the magnetic coupling assembly may include one or more magnetic coupling sub-assemblies arranged along a length of the holder body, each of the sub-assemblies including one or more magnetic elements configured to generate a magnetic coupling adapted for the selective engagement of the holder body with the coupling end of the machine tool.

A machine tool assembly in accordance with the present disclosure may include a holder body having a receiving portion configured for engagement with a coupling end of a machine tool; and a magnetic coupling assembly comprising one or more magnetic elements configured to generate a magnetic coupling adapted for the engagement of the holder body with the coupling end of the machine tool. In some embodiments, the receiving portion of the holder body comprises a cavity defined by an inner surface of the holder body and a clamping member, the clamping member configured for engagement with the coupling end of the machine tool in response to activation of the magnetic coupling.

In some examples, the magnetic coupling assembly may further include one or more magnetic elements embedded within the inner surface of the holder body. In some embodiments, the magnetic coupling assembly may further include one or more magnetic elements embedded within the clamping member. Some implementations may further include one or more decoupling members configured to mechanically urge the machine tool away from the holder body such that the machine tool may be removed from the receiving portion of the holder body.

A machine die apparatus in accordance with the present disclosure may include a holder body having a receiving portion configured for selective engagement with a coupling end of a machine die; and a magnetic coupling assembly comprising one or more magnetic elements configured to generate a magnetic coupling adapted for the selective engagement of the holder body with the coupling end of the machine die. Examples may further include an actuator configured to manipulate at least one of the magnetic elements to modulate a strength of the magnetic coupling for selective engagement and disengagement of the holder body with the coupling end of the machine die.

In some embodiments, the magnetic elements may include one or more permanent magnets and one or more ferromagnetic components, and the actuator may be configured to selectively move at least one of the permanent magnets or ferromagnetic components to modulate the strength of the magnetic coupling by forming a flux path therebetween. In some examples, the actuator may be configured to manipulate at least one of the magnetic elements of the magnetic coupling assembly between a locked position, in which the coupling end of the machine die is selectively engaged within the receiving portion of the holder body, and an alternate unlocked position, in which the coupling end of the machine die is selectively disengaged from the receiving portion of the holder body. In some embodiments, in the locked position, the magnetic coupling may support a weight of the machine die disposed within the receiving portion of the holder body.

In any of the above examples and embodiments, the one or more magnetic elements may include at least one electromagnet configured to selectively generate a magnetic flux to modulate the strength of the magnetic coupling. Some embodiments may further include one or more mechanical coupling members comprising at least one clamp, screw, cam, or lever configured to secure the coupling end of the machine die within the receiving portion of holder body. Examples may further include one or more decoupling members configured to mechanically urge the machine die away from the holder body such that the machine die may be removed from the holder body.

Methods of operating a machine tool apparatus can be performed according to any of the examples and embodiments above. Suitable applications of the mechanisms and techniques described in this disclosure also include, but are not limited to, the following enumerated examples and embodiments.

Example 1

A punch holder, or an upper tool holder for a folding press or press brake, is disclosed. The punch holder has a downward opening cavity designed to receive a punch or punch insert with a top protrusion or tang that fits into said holder cavity. The punch holder includes a magnetic restraining means for holding said punch or punch insert in said press brake using magnets or a magnetic assembly that urge or retain the punch or punch insert upward into a holder receiving cavity for placement or staging until said holder is fully activated, whence said punch is solidly clamped in place for use.

Example 2

In the above example, the punch holder may comprise a switchable or adjustable magnetic assembly for holding a punch or punch insert in said press brake, said magnetic assembly having two or more states: one state with a stronger magnetic attraction for retaining the punch or punch insert in the holder, and another state with less or nil magnetic attraction to allow release of said punch or punch insert from said tool holder. The tool holder thus has a locked position, wherein said punch or punch insert is securely held in said holder, an unlocked position, wherein said punch or punch insert can be manually installed in or removed from said punch holder, and/or any variety of intermediate states of magnetic attraction, such as could be useful for staging a set of punches or punch inserts for use.

Example 3

In any of the above examples and embodiments, the punch holder may comprise an assembly of permanent magnets and ferromagnetic parts arranged to work cooperatively in a magnetic circuit, with some magnet or magnets configured to be selectively moveable such that said magnetic circuit can be debilitated or weakened, as for punch or punch insert installation or removal, or alternatively positioned so as to be optimized or enabled, to facilitate secure retention of punch or punch insert in the holder until said holder is activated to clamp said punch or punch insert solidly in the holder for folding operation.

Example 4

In any of the above examples and embodiments, the punch holder may comprise an assembly of permanent magnets and ferromagnetic parts arranged to work cooperatively in a magnetic circuit, with some ferromagnetic part or parts configured to be selectively moveable such that said magnetic circuit can be debilitated or weakened (as for punch or punch insert installation or removal), or alternatively positioned so as to be optimized or enabled, to facilitate secure retention of punch or punch insert in the holder.

Example 5

In any of the above examples and embodiments, the punch holder may comprise a magnetic assembly that includes one or more electromagnets which can be switchable or adjustable to selectively aid or conflict with the magnetic circuit, thereby effecting retention or release of said punch or punch insert.

Example 6

In any of the above examples and embodiments, the punch holder may comprise a downward opening cavity in said tool holder formed by a solid or stationary protrusion extending downward on one side of said opening, and a moveable or articulated downward extending protrusion on the other side of a gap. Together, the solid or stationary protrusion and moveable or articulated protrusion form said opening, which is designed to receive a punch or punch insert with a top protrusion or tang that fits into said holder cavity or opening, with said magnetic assembly configured to urge both punch or punch insert and said moveable protrusion tightly into an acceptable position for use or for further clamping.

Example 7

In any of the above examples and embodiments, the punch holder may comprise a magnetic assembly that completes a magnetic circuit through the punch or punch insert, which may be made of a highly ferromagnetic material.

Example 8

In any of the above examples and embodiments, the punch holder may comprise a magnetic force sufficiently strong in the clamped or locked state such that no additional clamping means is needed for press operation.

Example 9

In any of the above examples and embodiments, the punch holder may comprise a supplementary mechanical clamping means, such as a cam and lever, or set screws, to solidly clamp the punch or punch insert in place for folding press operation.

Example 10

In any of the above examples and embodiments, the selectively moveable magnet or magnets may move slidably.

Example 11

In any of the above examples and embodiments, the selectively moveable magnet or magnets may move rotatably.

Example 12

In any of the above examples and embodiments, the selectively moveable ferromagnetic part or parts may move slidably.

Example 13

In any of the above examples and embodiments, the selectively moveable ferromagnetic part or parts may move rotatably.

Example 14

In any of the above examples and embodiments, optimization of the magnetic circuit, and thus the magnetic force on the punch or punch insert may be fully adjustable.

Example 15

In any of the above examples and embodiments, the magnetic clamping means may be controlled electronically and may include feedback from a sensor detecting the presence of the punch or punch insert, such that the magnetic force can be increased as needed to keep the punch or punch insert seated in the holder.

Example 16

In any of the above examples and embodiments, the magnetic assembly may employ electromagnets or permanent magnets built into the articulated or moveable part of the holder.

Example 17

In any of the above examples and embodiments, the magnetic assembly may employ electromagnets or permanent magnets built into the fixed or non-moveable part of the holder.

Example 18

In any of the above examples and embodiments, a mechanical means may be included for leveraging or prying the punch or punch insert away from the holder, or at least far enough away so as to weaken the magnetic circuit sufficiently to allow removal of said punch or punch insert from said holder.

Example 19

In any of the above examples and embodiments, the magnetic assembly or assemblies may employ a bi-stable or non-momentary clamped and released state.

Example 20

In any of the above examples and embodiments, one or more magnetic assemblies or multiple banks of magnetic holder subassemblies may be arranged along the length of the punch holder.

Example 21

A punch holder for holding a punch in a folding press or press brake with a downward opening cavity in said tool holder is disclosed. The punch holder is designed to receive a punch or punch insert with a top protrusion or tang that fits into said holder cavity, said holder using a non-switchable permanent magnet assembly or a permanent magnet or an array of magnets to urge or retain the punch or punch insert upward into said receiving cavity.

Example 22

In any of the above examples and embodiments, said downward opening cavity in said tool holder may be formed by a solid or stationary protrusion extending downward on one side of said opening, and a moveable or articulated downward extending protrusion on the other side of a gap, forming said opening, which is designed to receive a punch or punch insert with a top protrusion or tang that fits into said holder cavity or opening, with said magnetic assembly configured to urge both punch or punch insert and said moveable protrusion tightly into an acceptable position for use or for further clamping.

Example 23

In any of the above examples and embodiments, the magnetic assembly may employ a magnet or magnets built into the fixed or non-moveable part of the holder.

Example 24

In any of the above examples and embodiments, the magnetic assembly may employ a magnet or magnets built into the articulated or moveable part of the holder.

Example 25

In any of the above examples and embodiments, a mechanical means for directly leveraging or prying the punch or punch insert away from the holder may be included.

Example 26

A die holder, or lower tool holder for a folding press or press brake, is disclosed. The die holder may include an upward opening cavity designed to receive a die or die insert with a bottom protrusion or tang that fits into said holder cavity, with a magnetic restraining means for securing said die or die insert in said press brake, thereby sufficiently holding said die or die insert securely in place for use or until additional clamping is engaged.

Example 27

In any of the above examples and embodiments, the die holder may comprise a switchable or adjustable magnetic assembly to urge or retain the die securely in said holder receiving cavity, thus clamping said die or die insert solidly in place for use, the die holder thus having a clamped position wherein said die or die insert is securely restrained in said die holder, or a released position, wherein said die or die insert can be manually installed in or removed from said die holder.

Example 28

In any of the above examples and embodiments, an assembly of permanent magnets and ferromagnetic parts may be arranged to work cooperatively in a magnetic circuit, with some magnet or magnets, or ferromagnetic parts, configured to be selectively moveable such that said magnetic circuit can be debilitated or weakened, as for die or die insert installation or removal, or alternatively positioned so as to be optimized or enabled, to facilitate secure retention of the die or die insert in the holder.

Example 29

In any of the above examples and embodiments, the magnetic assembly may include one or more electromagnets which can be switchable or adjustable to selectively aid or conflict with the magnetic circuit, thereby effecting retention or release of said die or die insert.

Example 30

In any of the above examples and embodiments, the magnetic force may be sufficiently strong in the clamped state so that no additional clamping means is needed for press operation.

Example 31

In any of the above examples and embodiments, the die holder may comprise a supplementary mechanical clamping means, such as a cam and lever, or set screws, to solidly clamp the die or die insert in place for folding press operation.

Example 32

In any of the above examples and embodiments, the die holder may comprise a mechanical means for directly leveraging or prying the die or die insert away from the holder.

Example 33

A machine tool apparatus is disclosed. The machine tool apparatus includes a tool holder defining a receiving portion configured for selective engagement with a coupling end of a machine tool insert; a magnetic coupling assembly comprising one or more magnetic elements configured to generate a magnetic coupling adapted for the selective engagement of the tool holder with the coupling end of the machine tool insert; and an actuator configured to manipulate at least one of the magnetic elements to modulate a strength of the magnetic coupling for selective engagement and disengagement of the tool holder with the coupling end of the machine tool insert.

Example 34

In the above example, the magnetic elements may comprise one or more permanent magnets or one or more ferromagnetic components, the actuator being configured to selectively move at least one of the permanent magnets or the ferromagnetic components with respect to another of the permanent magnets or the ferromagnetic components to modulate the strength of the magnetic coupling by modulating a magnetic reluctance of a flux path therebetween.

Example 35

In any of the above examples and embodiments, the magnetic elements may comprise one or more flux guides configured to guide a magnetic flux between the tool holder and the machine tool insert, the strength of the magnetic coupling being further responsive to the magnetic flux guided therebetween.

Example 36

In any of the above examples and embodiments, the actuator may be configured to manipulate at least one of the magnetic elements of the magnetic coupling assembly between an engaged position in which the coupling end of the machine tool insert is selectively engaged within the receiving portion and an alternate disengaged position in which the coupling end of the machine tool insert is selectively disengaged from the receiving portion.

Example 37

In any of the above examples and embodiments, the actuator may be configured to manipulate the at least one magnetic element by rotation or displacement with respect to another of the magnetic elements.

Example 38

In any of the above examples and embodiments, the one or more magnetic elements may be responsive to actuation of the actuator such that the engaged and disengaged positions are bi-stable.

Example 39

In any of the above examples and embodiments, in the engaged position, the magnetic coupling may support a weight of the machine tool insert disposed within the receiving portion.

Example 40

In any of the above examples and embodiments, the machine tool apparatus may further comprise an adjustment mechanism configured to adjust a maximum strength of the magnetic coupling to support the weight of the machine tool insert when disposed within the receiving portion.

Example 41

In any of the above examples and embodiments, at least one of the magnetic elements may be configured to slide to selectively form the flux path, and to break or modulate the strength thereof.

Example 42

In any of the above examples and embodiments, at least one of the magnetic elements may be configured to rotate to selectively form the flux path, and to break or modulate the strength thereof.

Example 43

In any of the above examples and embodiments, the one or more magnetic elements may comprise at least one electromagnet configured to selectively generate a magnetic flux to modulate the strength of the magnetic coupling.

Example 44

In any of the above examples and embodiments, the actuator may comprise an electronic controller electronically coupled with the magnetic coupling assembly, the electronic controller coupled with a feedback sensor configured to detect the machine tool insert within the receiving portion.

Example 45

In any of the above examples and embodiments, the receiving portion may comprise a cavity defined by an inner surface of the tool holder and a clamping member configured for selective engagement with the coupling end of the machine tool insert disposed within the cavity.

Example 46

In any of the above examples and embodiments, the magnetic coupling assembly may further comprise one or more magnetic elements embedded within the clamping member or the inner surface of the tool holder.

Example 47

In any of the above examples and embodiments, the one or more magnetic elements may comprise one or more permanent magnets and one or more ferromagnetic components.

Example 48

In any of the above examples and embodiments, the machine tool apparatus may further comprise one or more mechanical coupling members comprising at least one clamp, screw, cam, or lever configured to secure the coupling end of the machine tool insert within the receiving portion.

Example 49

In any of the above examples and embodiments, the machine tool apparatus may further comprise one or more decoupling members configured to mechanically urge the machine tool insert away from the tool holder such that the machine tool insert may be removed from the receiving portion.

Example 50

In any of the above examples and embodiments, the magnetic coupling assembly may comprise a plurality of magnetic tool holder sub-assemblies arranged along a length of the tool holder, each of the sub-assemblies comprising one or more magnetic elements configured to generate magnetic flux to provide the magnetic coupling adapted for the selective engagement of the tool holder with the coupling end of one or more such machine tool inserts.

Example 51

In any of the above examples and embodiments, a plurality of machine tool inserts may be engaged within the plurality of magnetic tool holder subassemblies.

Example 52

A machine tool assembly is disclosed. The machine tool assembly may comprise a tool holder body defining a receiving portion configured for engagement with a coupling end of a machine tool insert; and a magnetic coupling assembly comprising one or more magnetic elements configured to generate a magnetic coupling adapted for the engagement of the tool holder with the coupling end of the machine tool insert.

Example 53

In the above example, the receiving portion of the tool holder body may comprise a cavity defined by an inner surface of the tool holder body and a clamping member, the clamping member configured for engagement with the coupling end of the machine tool insert in response to activation of the magnetic coupling.

Example 54

In any of the above examples and embodiments, the magnetic coupling assembly may further comprise one or more magnetic elements embedded within the inner surface of the tool holder body.

Example 55

In any of the above examples and embodiments, the magnetic coupling assembly may further comprise one or more magnetic elements embedded within the clamping member.

Example 56

In any of the above examples and embodiments, the machine tool assembly may further comprise one or more decoupling members configured to mechanically urge the machine tool insert away from the tool holder body such that the machine tool insert may be removed from the receiving portion of the tool holder body.

Example 57

A machine die apparatus is disclosed. The machine die apparatus may comprise a tool holder body having a receiving portion configured for selective engagement with a coupling end of a machine die; and a magnetic coupling assembly comprising one or more magnetic elements configured to generate a magnetic coupling adapted for the selective engagement of the tool holder body with the coupling end of the machine die.

Example 58

In the above example, the machine die apparatus may further comprise an actuator configured to manipulate at least one of the magnetic elements to modulate a strength of the magnetic coupling for selective engagement and disengagement of the tool holder body with the coupling end of the machine die.

Example 59

In any of the above examples and embodiments, the magnetic elements may comprise one or more permanent magnets and one or more ferromagnetic components, and the actuator may be configured to selectively move at least one of the permanent magnets or ferromagnetic components to modulate the strength of the magnetic coupling by inducing a flux path therebetween.

Example 60

In any of the above examples and embodiments, the actuator may be configured to manipulate at least one of the magnetic elements of the magnetic coupling assembly between a locked position in which the coupling end of the machine die is selectively engaged within the receiving portion of the tool holder body and an alternate unlocked position in which the coupling end of the machine die is selectively disengaged from the receiving portion of the tool holder body.

Example 61

In any of the above examples and embodiments, in the locked position, the magnetic coupling may prevent lateral movement of the machine die disposed within the receiving portion of the tool holder body.

Example 62

In any of the above examples and embodiments, the one or more magnetic elements may comprise at least one electromagnet configured to selectively generate a magnetic flux to modulate the strength of the magnetic coupling.

Example 63

In any of the above examples and embodiments, the machine die apparatus may further comprise one or more mechanical coupling members comprising at least one clamp, screw, cam, or lever configured to secure the coupling end of the machine die within the receiving portion of tool holder body.

Example 64

In any of the above examples and embodiments, the machine die apparatus may further comprise one or more decoupling members configured to mechanically urge the machine die away from the tool holder body such that the machine die may be removed from the tool holder body.

Example 65

A machine die apparatus is disclosed. The machine die apparatus may comprise a tool holder body having a receiving portion configured for engagement with a coupling end of a machine die; and a magnetic coupling assembly comprising one or more magnetic elements configured to generate a magnetic coupling adapted for the engagement of the tool holder body with the coupling end of the machine die.

Example 66

In the above example, the magnetic elements may comprise one or more permanent magnets and one or more ferromagnetic components.

Example 67

In any of the above examples and embodiments, the machine die apparatus may further comprise one or more decoupling members configured to mechanically urge the machine die away from the tool holder body such that the machine die may be removed from the tool holder body.

Example 68

A method of operating a machine tool apparatus is disclosed, according to any of the examples and embodiments above.

While this invention has been described with respect to particular examples and embodiments, changes can be made and equivalents can be substituted in order to adapt these teaching to other configurations, materials and applications, without departing from the spirit and scope of the invention. The invention is not limited to the particular examples that are disclosed, but encompasses all embodiments that fall with the scope of the claims.

The invention claimed is:

1. A machine tool apparatus comprising:

a tool holder defining a receiving portion configured for selective engagement with a coupling end of a machine tool insert, wherein the tool holder holds the machine tool insert in place for a forming operation on a workpiece;

a magnetic coupling assembly comprising one or more electromagnetic elements configured to selectively generate a magnetic flux coupling adapted for the selective engagement of the tool holder with the coupling end of the machine tool insert;

a feedback sensor configured to detect presence or absence of the machine tool insert within the receiving portion of the tool holder; and an electronic controller configured to modulate a strength of the magnetic flux coupling for the selective engagement and for selective disengagement of the tool holder with the coupling end of the machine tool insert, wherein the feedback sensor provides feedback signaling the electronic controller to activate or deactivate the magnetic flux coupling in response to the presence or absence of the machine tool insert in the receiving portion of the tool holder.

2. The machine tool apparatus of claim 1, wherein the magnetic assembly further comprises one or more ferromagnetic elements configured to guide magnetic flux between the tool holder and the machine tool insert, the strength of the magnetic flux coupling being responsive to the magnetic flux guided therebetween.

3. The machine tool apparatus of claim 1, wherein the electronic controller is configured to switch the magnetic coupling assembly between an engaged state in which the coupling end of the machine tool insert is selectively engaged within the receiving portion and an alternate disengaged state in which the coupling end of the machine tool insert is selectively disengaged from the receiving portion of the tool holder.

4. The machine tool apparatus of claim 3, wherein the one or more electromagnetic elements are responsive to actuation of the electronic controller such that the engaged and disengaged states are bi-stable.

5. The machine tool apparatus of claim 3, wherein in the engaged state, the magnetic flux coupling supports a weight of the machine tool insert disposed within the receiving portion of the tool holder.

6. The machine tool apparatus of claim 5, further comprising the electronic controller being configured to adjust the strength of the magnetic flux coupling to support the weight of the machine tool insert when disposed within the receiving portion of the tool holder, in the engaged state.

7. The machine tool apparatus of claim 1, wherein the electronic controller is configured to measure a change in inductance of one or more of the electromagnetic elements configured to selectively generate the magnetic flux, responsive to the presence or absence of the machine tool insert.

8. The machine tool apparatus of claim 7, further comprising a DC voltage supply configured to supply a DC voltage to one or more electromagnetic elements, wherein the electronic controller is configured to superpose a signal on the DC voltage and electronically coupled with the feedback sensor to detect the presence or absence of the machine tool insert within the receiving portion based on attenuation of the signal.

9. The machine tool apparatus of claim 1, wherein the receiving portion comprises a cavity defined by an inner surface of the tool holder and further comprising a clamping member configured for selective engagement with the machine tool insert with the coupling end disposed within the cavity.

10. The machine tool apparatus of claim 9, wherein the magnetic coupling assembly comprises the one or more electromagnetic elements embedded within the inner surface of the tool holder.

11. The machine tool apparatus of claim 10, wherein the one or more electromagnetic elements comprise one or more ferromagnetic components.

12. The machine tool apparatus of claim 1, further comprising one or more mechanical coupling members comprising at least one clamp, screw, cam, or lever configured to secure the coupling end of the machine tool insert within the receiving portion of the tool holder.

13. The machine tool apparatus of claim 1, further comprising one or more decoupling members configured to mechanically urge the machine tool insert away from the tool holder.

14. The machine tool apparatus of claim 1, wherein the magnetic coupling assembly comprises a plurality of electromagnetic elements configured to generate magnetic the magnetic flux coupling adapted for the selective engagement of the tool holder with the coupling end of one or more such machine tool inserts.

15. The machine tool apparatus of claim 14, wherein a plurality of such machine tool inserts are engaged within the tool holder.

16. A machine tool assembly comprising:

a tool holder having a tool holder body defining a receiving portion configured for engagement with a coupling end of a machine tool insert, wherein the tool holder holds the machine tool insert in place for a forming operation on a workpiece; and a magnetic coupling assembly comprising one or more electromagnetic elements configured to selectively generate a magnetic flux coupling adapted for the engagement of the tool holder with the coupling end of the machine tool insert;

a feedback sensor configured to detect presence or absence of the machine tool insert in the receiving portion of the tool holder; and an electronic controller configured to modulate a strength of the magnetic flux coupling for the selective engagement and for selective disengagement of the tool holder with the coupling end of the machine tool insert, wherein the feedback sensor provides feedback signaling the electronic controller to change the strength of the magnetic flux coupling in response to the feedback.

17. The machine tool assembly of claim 16, wherein the receiving portion of the tool holder body comprises a cavity defined by an inner surface of the tool holder body and further comprising a clamping member, the clamping member configured for engagement with the coupling end of the machine tool insert in response to activation of the magnetic coupling.

18. The machine tool assembly of claim 17, wherein the magnetic coupling assembly comprises the one or more electromagnetic elements embedded within the inner surface of the tool holder body.

19. The machine tool assembly of claim 17, wherein the magnetic coupling assembly further comprises one or more magnetic elements embedded within the clamping member.

20. The machine tool assembly of claim 16, further comprising one or more decoupling members configured to mechanically urge the machine tool insert away from the tool holder body.

21. A machine tool apparatus comprising:

a tool holder having a tool holder body defining a receiving portion configured for selective engagement with a coupling end of a machine tool insert, wherein the machine tool insert comprises a machine die and the tool holder holds the machine tool insert comprising the machine die in place for a forming operation; and a magnetic coupling assembly comprising one or more electromagnetic elements configured to selectively generate a magnetic flux coupling adapted for the selective engagement of the tool holder body with the coupling end of the machine tool insert comprising the machine die;

a feedback sensor configured to detect presence or absence of the machine tool insert comprising the machine die in the receiving portion of the tool holder; and an electronic controller configured to modulate a strength of the magnetic flux coupling for the selective engagement and for selective disengagement of the tool holder with the coupling end of the machine tool insert comprising the machine die, wherein the feedback sensor provides feedback signaling the electronic controller to change the strength of the magnetic flux coupling in response to the feedback.

22. The machine tool apparatus of claim 21, wherein the electronic controller is configured to switch the magnetic coupling assembly between an engaged state in which the coupling end of the machine die is selectively engaged within the receiving portion of the tool holder body and a disengaged state in which the coupling end of the machine die is selectively disengaged from the receiving portion of the tool holder body.

23. The machine tool apparatus of claim 22, wherein in the engaged sate, the magnetic flux coupling prevents lateral movement of the machine die disposed within the receiving portion of the tool holder body.

24. The machine tool apparatus of claim 21, wherein the electronic controller is configured to measure a change in inductance of one or more of the electromagnetic elements configured to selectively generate the magnetic flux coupling, and to modulate the strength of the magnetic flux coupling in response to the change.

25. The machine tool apparatus of claim 21, further comprising one or more mechanical coupling members comprising at least one clamp, screw, cam, or lever configured to secure the coupling end of the machine die within the receiving portion of tool holderbody.

26. The machine tool apparatus of claim 21, further comprising one or more decoupling members configured to mechanically urge the machine die away from the tool holder body.

27. The machine tool apparatus of claim 21, wherein the magnetic assembly further comprises one or more permanent magnets and one or more ferromagnetic components.

28. A machine tool apparatus comprising:

a tool holder configured for selective engagement with machine tool or die, wherein the tool holder holds the machine tool or die in place for a forming operation on a workpiece; and one or more electromagnetic elements configured to selectively generate magnetic flux for magnetically coupling the machine tool or die in the selective engagement with the tool holder;

a sensor configured to detect presence or absence of the machine tool or die within the tool holder; and a controller configured to modulate a strength of the magnetic flux coupling for the selective engagement and for selective disengagement of the tool holder with the machine tool or die, wherein the sensor provides feedback signaling the electronic controller to change the strength of the magnetic flux coupling in response to the feedback.

29. The machine tool apparatus of claim 28, further comprising one or more ferromagnetic elements configured to guide magnetic flux from the one or more electromagnetic elements between the tool holder and the machine tool or die.

30. The machine tool apparatus of claim 28, wherein the controller is configured to adjust the strength of the magnetic flux coupling to support a weight of the machine tool or die when selectively engaged within the tool holder.

31. The machine tool apparatus of claim 28, wherein the controller is configured to measure a change in inductance of one or more of the electromagnetic elements configured to selectively generate the magnetic flux coupling, in response to the presence or absence of the machine tool or die in the tool holder.

32. The machine tool apparatus of claim 31, wherein the controller is configured to present an indication of proper seating of the machine tool or die within the tool holder based on the change in inductance.

33. The machine tool apparatus of claim 28, further comprising a DC supply configured to provide a DC voltage to the one or more electromagnetic elements.

34. The machine tool apparatus of claim 33, wherein the controller is configured to increase, decrease, or maintain the DC voltage to alter the strength of the magnetic flux coupling.

35. The machine tool apparatus of claim 33, wherein the controller is configured to superimpose a signal on the DC voltage and to detect the presence or absence of the machine tool insert within the tool holder based on attenuation of the signal.

* * * * *